US005085979A

United States Patent [19]

Yamagami et al.

[11] Patent Number: 5,085,979

[45] Date of Patent: Feb. 4, 1992

[54] SILVER HALIDE COLOR PHOTOGRAPHIC MATERIALS AND PROCESSING METHOD

[75] Inventors: Hiroyuki Yamagami; Shunichi Aida, both of Kanagawa, Japan

[73] Assignee: Fuji Photo Film Co., Ltd., Kanagawa, Japan

[21] Appl. No.: 680,039

[22] Filed: Mar. 29, 1991

Related U.S. Application Data

[63] Continuation of Ser. No. 211,191, Jun. 24, 1988, abandoned.

[30] Foreign Application Priority Data

Jun. 25, 1987 [JP] Japan ..... 62-158339

[51] Int. Cl.[5] ..... G03C 1/035; G03C 7/305

[52] U.S. Cl. ..... 430/505; 430/544; 430/567; 430/957

[58] Field of Search ..... 430/567, 362, 957, 544, 430/504, 505

[56] References Cited

U.S. PATENT DOCUMENTS

| | | | |
|---|---|---|---|
| 3,227,554 | 1/1966 | Barr et al. | 430/505 |
| 3,617,291 | 11/1971 | Sawdey | 430/544 |
| 4,221,863 | 9/1980 | Overman et al. | 430/567 |
| 4,276,372 | 6/1981 | Wernicke et al. | 430/362 |
| 4,444,877 | 4/1984 | Koitabashi et al. | 430/567 |
| 4,599,301 | 7/1986 | Ohashi et al. | 430/505 |
| 4,686,175 | 8/1987 | Ogawa et al. | 430/505 |
| 4,728,602 | 3/1988 | Shibahara et al. | 430/567 |
| 4,762,778 | 8/1988 | Yamazaki et al. | 430/567 |

FOREIGN PATENT DOCUMENTS

| | | | |
|---|---|---|---|
| 0115304 | 8/1984 | European Pat. Off. . | |
| 0264954 | 4/1988 | European Pat. Off. | 430/567 |
| 1077842 | 4/1986 | Japan | 430/957 |
| 61-261741 | 5/1986 | Japan . | |
| 2058246 | 3/1987 | Japan | 430/567 |
| 1252066 | 11/1971 | United Kingdom . | |
| 1586412 | 3/1981 | United Kingdom . | |
| 2165058 | 4/1986 | United Kingdom . | |

OTHER PUBLICATIONS

Patent Abstracts of Japan 11:116 (Apr. 1987).

*Primary Examiner*—Charles L. Bowers, Jr.
*Assistant Examiner*—Lee C. Wright
*Attorney, Agent, or Firm*—Sughrue, Mion, Zinn, Macpeak & Seas

[57] ABSTRACT

A silver halide color photographic material comprising at least one layer of, respectively, a blue-sensitive silver halide emulsion layer containing a yellow color coupler, a green-sensitive silver halide emulsion layer containing a magenta color coupler, and a red-sensitive silver halide emulsion layer containing a cyan color coupler, on a support; wherein a specific coupler is contained in at least one of the above-mentioned photosensitive silver halide emulsion layer, and wherein chemically sensitized silver halide grains are contained in at least one of the above-mentioned silver halide emulsion layers and are composed of grains with an interior core part consisting of a silver halide containing 10 to 40 mol % of silver iodide, wherein the core part is covered with a silver halide of a lower silver iodide content, and the surface of the grains, when analyzed by means of the XPS (X-Ray Photoelectron Spectroscopy) surface analysis method, consist of a silver halide containing greater than 5 mol % of silver iodide.

9 Claims, 3 Drawing Sheets

SILVER HALIDE COLOR PHOTOGRAPHIC MATERIALS AND PROCESSING METHOD

This is a continuation of application Ser. No. 07/211,191 filed June 24, 1988, now abandoned.

FIELD OF THE INVENTION

The present invention relates to silver halide photographic materials, particularly to silver halide photographic materials containing an emulsion comprising silver halide grains possessing a novel structure, and possessing high sensitivity and high image quality, whereby improvement of the interlayer inhibition effect is achieved giving excellent color reproduction.

BACKGROUND OF THE INVENTION

The basic performance features required in a silver halide emulsion for photographic use are high sensitivity, low fog, fine grain and high development activity. The silver halides are silver fluoride, silver chloride, silver bromide and silver iodide, but silver fluoride is usually not used in photographic emulsions because of its high water solubility. By combining the remaining three silver halides, endeavors have been made to improve the basic performance of the emulsion. Light absorption becomes stronger in the sequence silver chloride, silver bromide, silver iodide. On the other hand, development activity is reduced in this sequence, so that it is difficult to make light absorption and development activity compatible.

Klein and Moizaru disclosed mixed silver halide emulsions consisting of a silver halide core covered with a layer of different silver halides (concretely, a silver bromide nucleus, a primary layer of silver iodobromide containing 1% of silver bromide, and an outer layer of silver bromide), giving increased light sensitivity without impairing development activity (JP-B-43-13162). (The term "JP-B" as used herein means an examined Japanese patent publication.)

Koitabashi et al. disclosed that when a thin shell, having a thickness of 0.01 to 0.1 μm, was applied to core grains of comparatively low silver iodide content, desirable photographic characteristics, such as an increase in covering power, were obtained (U.S. Pat. No. 4,444,877).

Such inventions, with the silver iodide content of the core part low, and accordingly the total silver iodide content low, are useful. However, when high sensitivity and high image quality are aimed at, a high iodination of the emulsion is indispensable.

Heightened sensitivity and heightened image quality when the iodine content of the core part is increased are disclosed in, for example, JP-A-60-138538, 61-88253 (EP-A-171238), 59-177535 (GB-A-2138963), 61-112142 and 60-143331 (the term "JP-A" as used herein means an unexamined published Japanese patent application).

The technical concept in common in this series of patents is that by having the iodine content in the core as high as possible, and the iodine content in the shell part low, the development activity and the light sensitivity are compatible.

However, the double structure grain based on this technical concept still has problems, i.e., due to sensitizing dyes, characteristic desensitization is large; when the sensitive material is maintained under high humidity conditions the sensitizing dyes are easily desorbed, etc.

Image formation by means of a silver halide color photographic material is particularly excellent, in comparison with other image formation methods, in the beauty of the image obtained. Furthermore, in order to extend this point of excellence and provide beautiful images, or in order to make possible more convenient operation of image recording, much work is being expended on improvement of silver halide color photographic materials.

The principal factor in raising image quality is improvement in graininess. With this object, by the use of so-called DIR compounds which release a development inhibiting material by reaction with the oxidized form of the color developer, improvement of the performance of the above-mentioned silver halide grains is achieved. However, DIR compounds are often accompanied by a decrease in sensitivity; they are of only limited use as a means for high sensitivity and also high image quality of photosensitive materials.

Another important factor to be mentioned in raising image quality is color reproduction. With this object, for example, methods giving color photographic materials possessing satisfactory color reproduction are disclosed in U.S. Pat. No. 4,686,175; the maximum sensitivity wavelength ranges of their blue-sensitive emulsion layer, green-sensitive emulsion layer and red-sensitive emulsion layer are prescribed, and further, they contain a diffusion development inhibitor or a precursor thereof which releases compounds by reaction with the oxidized form of the color developer. Thus, by changing the color temperature of the light source at the time of photographing there are few changes in color reproduction. This invention is excellent, but methods of obtaining excellent graininess are not mentioned.

Utilization of the interlayer inhibition effect is known for improving color reproduction. Taking the example of color negatives, by giving a development inhibition effect from the green-sensitive layer to the red-sensitive layer, the color development of the red-sensitive layer in white light exposure can be suppressed as compared with the case of a red exposure light. For a color negative paper system, in the case of exposure to white light, it reappears as gray on the color print, because graduation is balanced; the above-mentioned interlayer effect brings about a higher density of cyan color, on exposure to red, than in the case of gray exposure, and cyan color development on the print is suppressed to allow more highly saturated red reproduction. Similarly, a development inhibition effect on a green-sensitive layer from a red-sensitive layer gives highly saturated green reproduction.

As methods of boosting the interlayer effect, increase of the iodine content of the emulsion or use of a DIR compound are known. However, the DIR compounds known in the prior art are not entirely sufficient for the improvement of color reproduction. In cases in which the spectral sensitivity distribution overlap was increased, they had no effect in improving poor color reproduction.

A method of stipulating the width of the maximum sensitivity of spectral distribution of blue-, green- and red-sensitive silver halide emulsion layers, and of including a diffuse DIR compound, is disclosed in JP-A-59-131937. The object is to provide color photographic materials possessing small changes in color reproduction with changes in the color temperature of the light source when photographing, and moreover, high chroma color reproduction.

The present inventors tried combining various means as mentioned above, but were not able to obtain photosensitive materials which were satisfactory with regard to changes in the color reproduction owing to color temperature changes in the light source while photographing, and faithful half tone reproduction of high saturation and primary colors. This shows that when restricted to stipulation of maximum sensitivity breadth and utilization of diffusive DIR compounds alone, it is possible to obtain a reduction in the changes in color reproduction due to changes in the color temperature of the light source and an increased saturation for some colors, but it is not possible to faithfully reproduce the numerous colors, other than primary colors, which exist in the natural world, i.e., intermediate colored objects, skin colors, etc.

SUMMARY OF THE INVENTION

An object of the present invention is to provide silver halide photographic materials of high sensitivity, and good graininess, and excellent color reproduction.

The present inventors, as a result of diligent research, have found out how to obtain color-sensitive materials with high sensitivity and good graininess and moreover with excellent color reproduction by means of the structures shown below.

Which is to say: by including the couplers of general formula (I) below in at least one photosensitive silver halide emulsion layer, and by including silver halide grains which have a silver iodobromide phase with a silver iodide mol ratio of 10 to 40% within the grain, this silver iodobromide phase being covered with a silver halide containing relatively less silver iodide and, moreover, the silver iodide value of the surface of the grains (that is, the part with a thickness of about 50 Å as measured by XPS (X-ray photoelectron spectroscopy) surface analysis methods) being more than 5 mol%, in a color photographic material which has, respectively, at least one red-sensitive silver halide emulsion layer with a cyan color coupler, green-sensitive silver halide emulsion layer with a magenta color coupler and blue-sensitive silver halide emulsion layer with a yellow color coupler, on a support, the inventors have found that they were able to obtain color photographic materials with high sensitivity and good graininess and with excellent color reproduction.

DETAILED DESCRIPTION OF THE INVENTION

Figure 1:
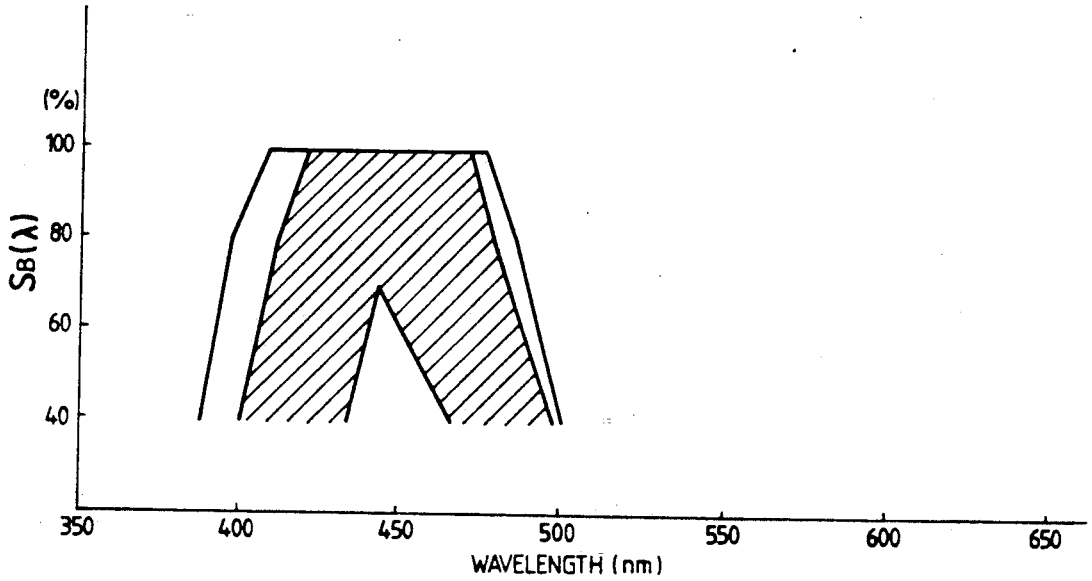
FIG. 1 shows, by way of the portion with oblique lines, the range of spectral sensitivity distribution of the blue-sensitive layer, as stipulated in claim 3.

When a so-called DIR compound which releases development inhibiting reagents via a reaction with the oxidized form of a color developer (simply termed DIR compounds below) is not present in a color photographic material which has, respectively, at least one red-sensitive silver halide emulsion layer with a cyan color coupler, green-sensitive silver halide emulsion layer with a magenta color coupler and blue-sensitive silver halide emulsion layer with a yellow color coupler, on a support, then, from the point of view of the sensitivity/grain form ratio, it is even better to use the aforementioned silver halide grains in the aforementioned photosensitive silver halide emulsion layer than it is to use silver halide grains of a so-called double structure where the silver iodide content of the portion to a depth of about 50 Å as measured by the XPS surface analysis method is less than 5 mol%. Nevertheless, in this kind of series with a DIR compound not present, the interlayer inhibition effect is small, but because deterioration of color reproduction is large they are of no practical use. On the other hand, in a series of the silver halide grains (grains with at least 5 mol% of silver iodide in the vicinity of the grain surface) of the present invention in which nondiffusive DIR compounds alone are present, it is difficult to keep color reproduction also satisfactory without impairing the superiority of the sensitivity/grain ratio. Thereupon, the present inventors diligently investigated means to make the color reproduction also sufficiently satisfactory, while retaining the upper limit of superiority in the sensitivity/grain ratio of the silver halide grains of the present invention. This resulted in a coupler of the general formula (I) shown below contained in at least one of the above-mentioned light-sensitive silver halide emulsion layers, moreover, at least one layer of the above-mentioned light-sensitive silver halide emulsion layers possesses the silver halide grains of the present invention, namely, a silver iodide phase having a mol fraction of 10 to 40% silver iodide is contained in the interior part of the grains, this silver iodide phase having a covering of a silver halide possessing a lower silver iodide content, furthermore, the grains, when analyzed by means of the XPS surface analysis method, consist of silver halide containing upwards of 5 mol% of silver iodide-containing silver halide grains in portion to a depth of about 50 Å. This effect is thought to be due to inhibiting effects being well controlled in the photosensitive layer containing the silver halide grains of this invention, and in other light-sensitive layers by means of the compounds shown by general formula (I). Surprisingly, however, this effect operates particularly effectively with silver halide grains having a silver iodide phase with a silver iodide mol ratio of 10 to 40 mol% within the grain, this silver iodide phase being covered by a silver halide having a lower silver iodide content. Moreover, the value of the silver iodide content of the grains, in a part to a depth of about 50 Å, as analyzed by XPS surface analysis is more than 5 mol%; is even more effective than with grains with a value for the silver iodide content in a part to a depth of about 50 Å, as measured by the XPS surface analysis method, of less than 5 mol%. Of course, a compound shown in general formula (I) may also be used jointly with a nondiffusive DIR coupler.

$$A\text{-}(TIME)_n\text{B} \quad \text{(I)}$$

In the formula, A denotes a coupler radical group which eliminates $(TIME)_n$-B by means of the coupling reaction with the oxidant of the primary aromatic amine developer, TIME denotes a timing group which bonds to the active coupling position in A and which releases B after separation from A due to the coupling reaction, B denotes a group represented by general formulae (IIa), (IIb), (IIc), (IId), (IIe), (IIf), (IIg), (IIh), (IIi), (IIj), (IIk), (IIl), (IIm), (IIn), (IIo), or (IIp) mentioned below, and n denotes an integer equal to 0 or 1, with the condition that when n is 0, B is directly bonded to A.

(IIa)

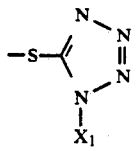

(IIb)

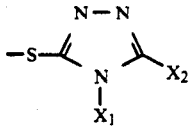

(IIc)

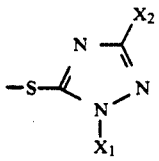

(IId)

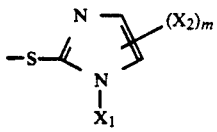

(IIe)

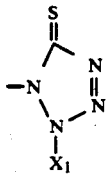

(IIf)

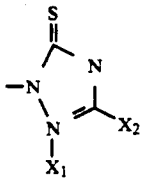

-continued (IIg)

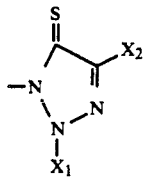

(IIh)

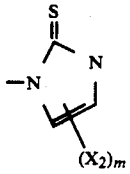

(IIi)

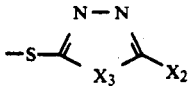

(IIj)

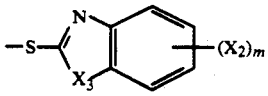

(IIk)

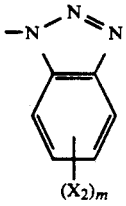

(IIl)

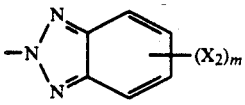

(IIm)

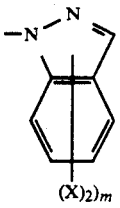

(IIn)

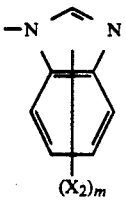

(IIo)

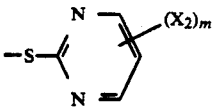

(IIp)

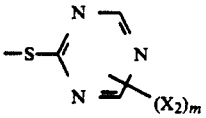

In the formulae, $X_1$ is chosen from a substituted or unsubstituted aliphatic group with 1 to 4 carbon atoms (the substituent group is chosen from an alkoxy group, an alkoxycarbonyl group, a hydroxyl group, an acylamine group, a carbamoyl group, a sulfonyl group, a sulfonamido group, a sulfamoyl group, an amino group, an acyloxy group, a cyano group, a ureido group, an acyl group, a halogen atom, or an alkylthio group. The number of carbon atoms contained in this substituent group is 3 or less), or a substituted phenyl group (the substituent group is chosen from a hydroxyl group, an alkoxycarbonyl group, an acylamino group, a carbamoyl group, a sulfonyl group, a sulfonamido group, a sulfamoyl group, an acyloxy group, a ureido group, a carboxyl group, a cyano group, a nitro group, an amino group, or an acyl group. The carbon atoms contained in such substituted group number is 3 or less). $X_2$ denotes a hydrogen atom, an aliphatic group, a halogen atom, a hydroxyl group, an alkoxy group, an alkylthio group, an alkoxycarbonyl group, an acylamino group, a carbamoyl group, a sulfonyl group, a sulfonamido group, a sulfamoyl group, an acyloxy group, a ureido group, a cyano group, a nitro group, an amino group, an alkoxycarbonylamino group, an aryloxycarbonyl group or an acyl group; $X_3$ is an oxygen atom, a sulfur atom, or an imino group with 4 or less carbon atoms, and m denotes an integer equal to 1 or 2, with the proviso that the number m of carbon atoms contained in $X_2$ is 8 or less, and when m is 2, two $X_2$ groups may be the same or may be different.

The compounds shown in general formula (I) are discussed in detail below.

Coupler residual groups which form dyes (for example, yellow, magenta, cyan) by means of a coupling reaction with the oxidized form of the primary aromatic amine developer, and coupler radicals which give coupling reactants with essentially no absorption in the visible light region are included as the coupler radicals represented by A in general formula (I).

As the yellow color image forming coupling radical denoted by A, there may be mentioned the pivaloylacetanilide group, benzoylacetanilide group, malonic acid diester group, malondiamide group, dibenzoylmethane group, benzothiazolylacetamide group, malonic acid ester monoamide group, benzothiazolyl acetate group, benzoxazolylacetamide group, benzoxazolylacetate malonic acid diester group, benzimidazolylacetamide group, or benzimidazolyl acetate groups as coupler radicals, coupler radicals derived from hetero ring-substituted acetamide or hetero ring-substituted acetate as in U.S. Pat. No. 3,841,880, or coupler radicals derived from acylacetamides as in U.S. Pat. 3,770,446, British Patent 1,459,171, DE-A-2503099, JP-A-50-139738, or as reported in *Research Disclosure*, No. 15737, or the hetero ring coupler radicals reported in U.S. Pat. No. 4,046,574.

Coupler radicals which possess a 5-oxo-2-pyrazoline nucleus, a pyrazolo[1,5-a]benzimidazole nucleus, a pyrazoloimidazole nucleus, a pyrazolotriazole nucleus, a pyrazolotetrazole nucleus, or a cyanoacetophenone-based coupler radical are preferred as the magenta color image forming coupler radical represented by A.

Coupler radicals which possess a phenol nucleus or an α-naphthol nucleus are preferred as the cyan color image forming coupler represented by A.

Furthermore, the effect of a coupler which releases a developer inhibitor after coupling with the oxidant which is the principal developer ingredient is essentially the same as that of a DIR coupler which also forms no dye.

As the form of coupler radical denoted by A there may be mentioned the coupler radicals reported in, for example, U.S. Pat. Nos. 4,052,213, 4,088,491, 3,632,345, 3,958,993, and 3,961,959.

The following are mentioned as desirable radicals for TIME in general formula (I): (1) Groups utilizing a hemiacetal cleavage reaction, as reported in U.S. Pat. No. 4,146,396, Japanese Patent Application Nos. 59-106223, 59-106224 and 59-75475, or groups denoted by the following general formula:

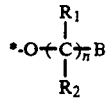

In the formula, * denotes the position which bonds with the coupling position of A, $R_1$ and $R_2$ denote hydrogen atoms or substituent group, and n denotes 1 or 2; when n is 2, two $R_1$ and $R_2$'s may be the same or different, or optionally there may be ring formation by bonding between two of the $R_1$ and $R_2$'s. B denotes the group defined in general formula (I).

(2) A group utilizing an intramolecular nucleophilic substitution reaction to bring about a cleavage reaction: e.g., the timing group as reported in U.S. Pat. No. 4,248,962.

(3) A group utilizing an electron transfer reaction along a conjugate series to bring about a cleavage reaction: e.g., the group reported in U.S. Pat. No. 4,409,323 or groups of the general formula mentioned below (groups reported in British Patent 2,096,783 A).

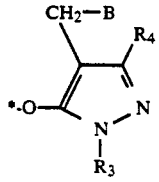

In the formula, * denotes the position which bonds with the coupling position of A, $R_3$ and $R_4$ denote hydrogen atoms or substituent groups, and B denotes the groups defined in general formula (I). Examples of $R_3$ are alkyl groups with 1 to 24 carbon atoms (e.g., methyl, ethyl, benzyl, dodecyl) or aryl groups with 6 to 24 carbon atoms (e.g., phenyl, 4-tetradecyloxyphenyl, 4-methoxyphenyl, 2,4,6-trichlorophenyl, 4-nitrophenyl, 4-chlorophenyl, 2,5-dichlorophenyl, 4-carboxyphenyl, p-tolyl,); examples of $R_4$ are a hydrogen atom, an alkyl group with 1 to 24 carbon atoms (e.g., methyl, ethyl, undecyl, pentadecyl), an aryl group with 6 to 36 carbon atoms (e.g., phenyl, 4-methoxyphenyl), a cyano group, an alkoxy group with 1 to 24 carbon atoms (e.g., methoxy, ethoxy, dodecyloxy), an amino group with 0 to 36 carbon atoms (e.g., amino, dimethylamino, piperidino, dihexylamino, anilino), a carboxamide group with 1 to 24 carbon atoms (e.g., acetamido, benzamide, tetradecanamido), a sulfonamido group with 1 to 24 carbon atoms (e.g., methylsulfonamido, phenylsulfonamido), a carboxy group, an alkoxycarbonyl group with 2 to 24 carbon atoms (e.g., methoxycarbonyl, ethoxydicarbonyl, dodecyloxycarbonyl), or a carbamoyl group with 1 to 24 carbon atoms (e.g., carbamoyl, dimethylcarbamoyl, pyrrolidinocarbonyl).

Examples are shown below of the substituent groups $X_1$, $X_2$ and $X_3$ of general formulae (IIa) to (IIp).

Examples of $X_1$ are a methyl group, an ethyl group, a propyl group, a butyl group, a methoxyethyl group, an ethoxyethyl group, an isobutyl group, an allyl group, a dimethylaminoethyl group, a propargyl group, a chloroethyl group, a methoxycarbonylmethyl group, a methylthioethyl group, a 4-hydroxyphenyl group, a 3-hydroxyphenyl group, a 4-sulfamoylphenyl group, a 3-sulfamoylphenyl group, a 4-carbamoylphenyl group, a 3-carbamoylphenyl group, a 4-dimethylaminophenyl group, a 3-acetamidophenyl group, a 4-propanamidophenyl group, a 4-methoxyphenyl group, a 2-hydroxyphenyl group, a 2,5-dihydroxyphenyl group, a 3-methoxycarbonylaminophenyl group, a 3-(3-methylureido)phenyl group, a 3-(3-ethylureido)phenyl group, a 4-hydroxyethoxyphenyl group, a 3-acetamido-4-methoxyphenyl group, etc.; examples of $X_2$ are: a hydrogen atom, a methyl group, an ethyl group, a benzyl group, an n-propyl group, an i-propyl group, an n-butyl group, an i-butyl group, a cyclohexyl group, a fluoro group, a chloro group, a bromo group, an iodo group, a hydroxymethyl group, a hydroxyethyl group, a hydroxy group, a methoxy group, an ethoxy group, an allyloxy group, a benzyloxy group, a methylthio group, an ethylthio group, a methoxycarbonyl group, an ethoxycarbonyl group, an acetamido group, a propanamido group, a butanamido group, an octanamido group, a benzamido group, a dimethylcarbamoyl group, a methylsulfonyl group, a methylsulfonamido group, a phenylsulfonamido group, a dimethylsulfamoyl group, an acetoxy group, a ureido group, a 3-methylureido group, a cyano group, a nitro group, an amino group, a dimethylamino group, a methoxycarbonylamino group, an ethoxycarbonylamino group, a phenoxycarbonyl group, a methoxyethyl group, an acetyl group, etc.; examples of $X_3$ are: a hydrogen atom, a sulfur atom, an imino group, a methylimino group, an ethylimino group, a propylimino group, an allylimino group, etc.

Among the groups denoted by general formulae (IIa) to (IIp), the groups denoted by general formulae (IIa), (IIb), (IIi), (IIj), (IIk) or (IIl) are preferable, and moreover those denoted by general formulae (IIa), (IIi), (IIj) or (IIk) are particularly preferable.

Specific examples are given below of the group denoted by B in general formula (I).

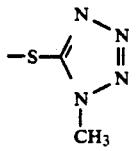

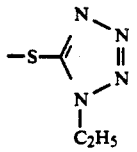

-continued

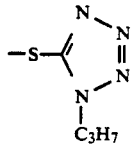

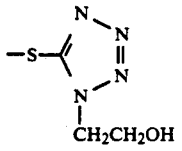

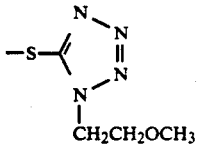

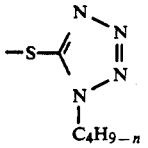

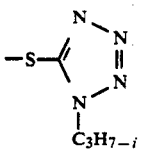

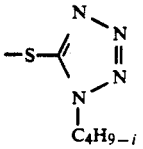

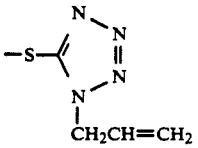

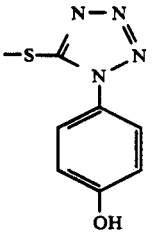

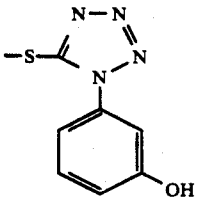

-continued
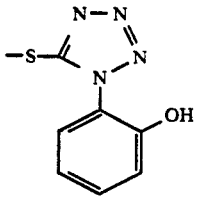
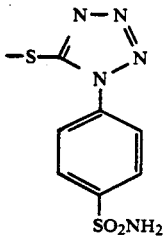
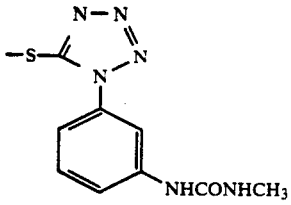
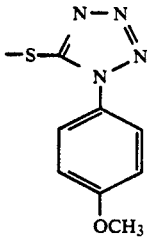
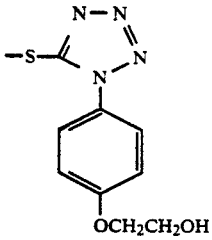
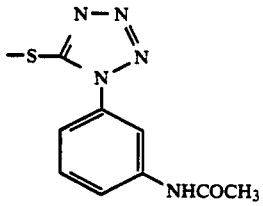
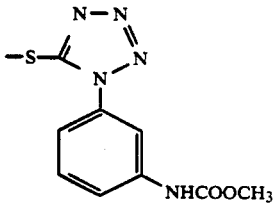
-continued
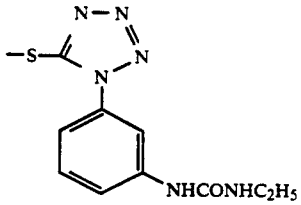
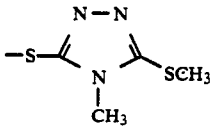
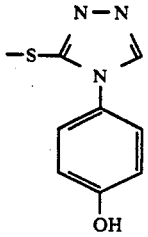
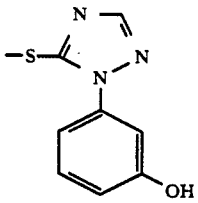
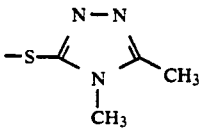
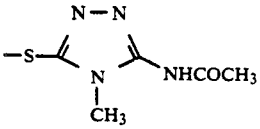
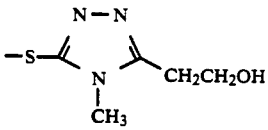
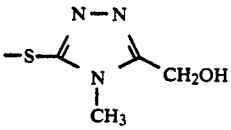
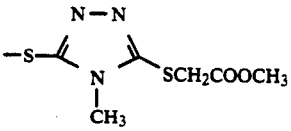
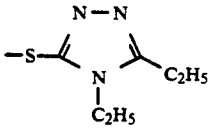

-continued
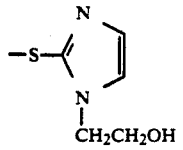
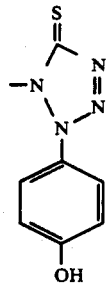
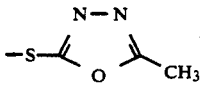
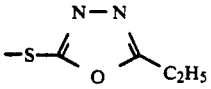
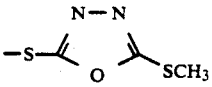
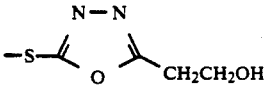
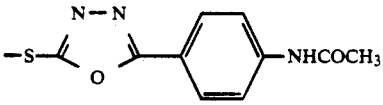
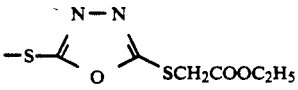
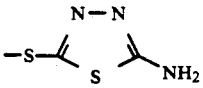
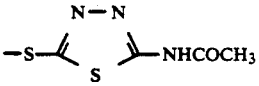
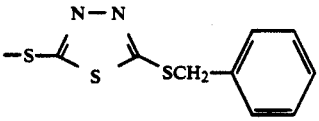
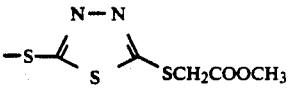
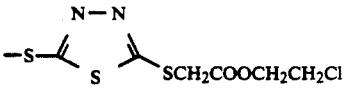
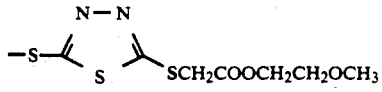
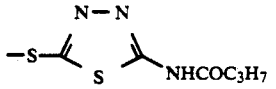
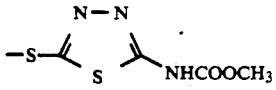
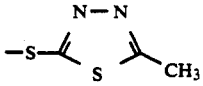
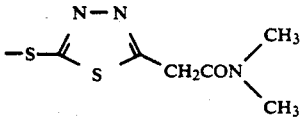
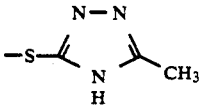
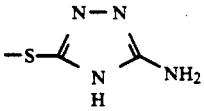
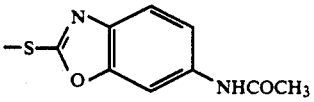
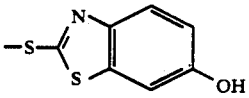
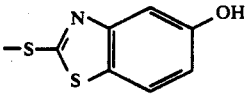
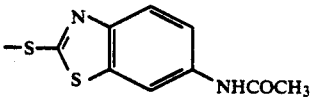
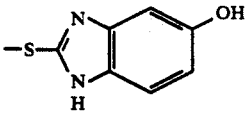
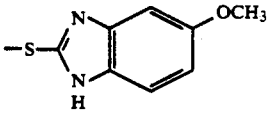

-continued
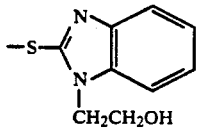
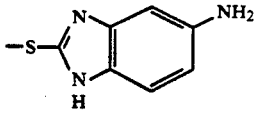
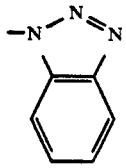
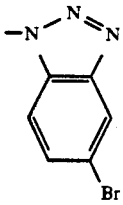
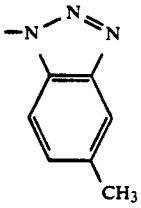
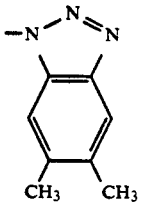
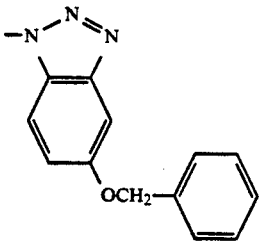
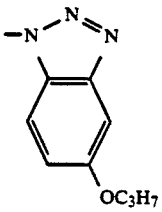
-continued
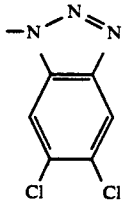
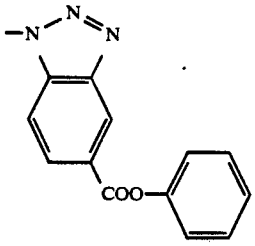
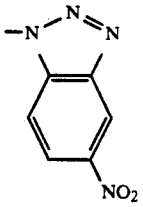
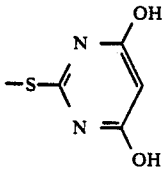
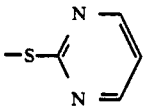
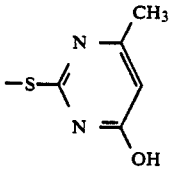
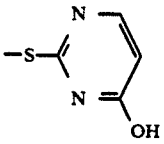
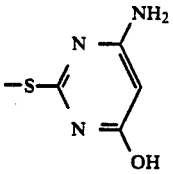
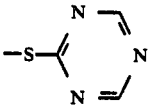

-continued

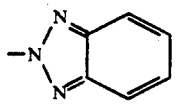

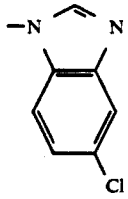

The couplers of the present invention are generally used in a mixture with the principal coupler. With respect to the principal coupler, the couplers of the present invention are added in a proportion of 0.1 mol% to 100 mol%( and preferably 1 mol% to 50 mol%. The amount of the couplers of the present invention utilized with respect to the silver halide is 0.01 mol% to 20 mol%, preferably 0.5 mol% to 10 mol%, with respect to the silver halide present in the same layer or in an adjacent layer.

Furthermore, the effects of the present invention are particularly evident when A in general formula (I) is a coupler radical denoted by the following general formulae (Cp-1), (Cp-2), (Cp-3), (Cp-4), (Cp-5), (Cp-6), (Cp-7), (Cp-8), (Cp-9), (Cp-10), or (Cp-11). These couplers, having a high coupling rate, are preferable.

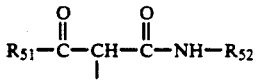

(Cp-1)

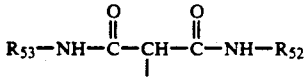

(Cp-2)

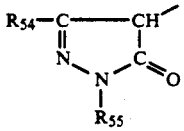

(Cp-3)

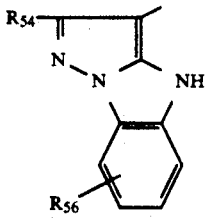

(Cp-4)

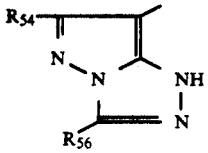

(Cp-5)

-continued

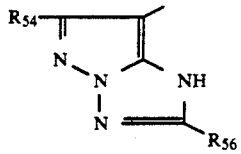

(Cp-6)

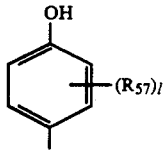

(Cp-7)

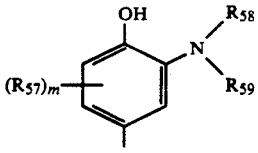

(Cp-8)

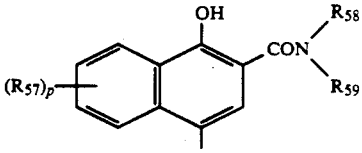

(Cp-9)

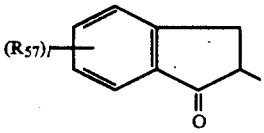

(Cp-10)

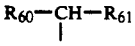

(Cp-11)

In The above formulae, the free bonds derived from the coupling position denote bonding positions of coupling elimination groups. In the above formulae, when $R_{51}$, $R_{52}$, $R_{53}$, $R_{54}$, $R_{55}$, $R_{56}$, $R_{57}$, $R_{58}$, $R_{59}$, $R_{60}$ or $R_{61}$ contain groups which are fast to diffusion, the total number of carbon atoms is selected to be 8 to 32, and preferably 10 to 22; in other cases, the total number of carbon atoms is preferably 15 or less.

Now, $R_{51}$ to $R_{61}$, l, m and p of general formulae (Cp-1) to (Cp-11) will be explained.

In the formula, $R_{51}$ denotes an aliphatic group, an aromatic group, an alkoxy group or a heterocyclic group, and $R_{52}$ and $R_{53}$ denote respectively aromatic groups or heterocyclic groups.

In the formula, the aliphatic groups denoted by $R_{51}$ preferably have 1 to 22 carbon atoms, and may be substituted or unsubstituted, linear or cyclic. The preferred substituent groups for the alkyl group are an alkoxy group, an amino group, an acylamino group, a halogen atom, etc.; and these may themselves have substituents. Specific examples of useful aliphatic groups for $R_{51}$ are as follows: an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

In the case where $R_{51}$, $R_{52}$ or $R_{53}$ represents aromatic groups (particularly phenyl groups), the aromatic group may be substituted. Phenyl and other such aromatic groups may be substituted with an alkenyl group, an alkoxy group, an alkoxycarbonyl group, an alkoxycarbonylamino group, an aliphatic amido group, an alkylsulfamoyl group, an alkylsulfonamido group, an alkylureido group, an alkyl-substituted succinimido group, or other such group having up to 32 carbon atoms; in these cases, the alkyl group may also have a phenylene or similar aromatic group interposed in the chain. The phenyl group may also be substituted with an aryloxy group, an aryloxycarbonyl group, an arylcarbamoyl group, an arylamido group, an arylsulfamoyl group, an arylsulfonamido group, an arylureido group, etc.; the aryl group moiety of these substituent groups may also be substituted with one or more alkyl groups having a total number of 1 to 22 carbon atoms.

The phenyl group denoted by $R_{51}$, $R_{52}$ or $R_{53}$ may also be substituted by a lower alkyl group having 1 to 6 carbon atoms also containing a substituent amino group, hydroxy group, carboxy group, sulfo group, nitro group, cyano group, thiocyano group or halogen atom.

Furthermore, $R_{51}$, $R_{52}$ or $R_{53}$ may denote a phenyl group substituted with another condensed ring, for example, a naphthyl group, a quinolyl group, an isoquinolyl group, a chromanil group, a coumaranyl group, a tetrahydronaphthyl group, etc. These substituent groups may themselves possess substituent groups.

In the case in which $R_{51}$ denotes an alkoxy group, its alkyl moiety may also represent a straight chain or branched chain alkyl group, alkenyl group, cycloalkyl group or cycloalkenyl group with 1 to 32, preferably 1 to 22, carbon atoms, and these may be substituted with a halogen atom, an aryl group, an alkoxy group, etc.

In the cases where $R_{51}$, $R_{52}$ or $R_{53}$ denotes a heterocyclic group, a carbon atom of a carbonyl group of an acyl group in an α-acylacetamido, or a nitrogen atom of an amido group, may be bonded via one of the ring-forming carbon atoms to the respective heterocyclic group. Examples of this kind of heterocyclic group are thiophene, furan, pyran, pyrrole, pyrazole, pyridine, pyrazine, pyrimidine, pyridazine, indolizine, imidazole, thiazole, oxazole, triazine, thiadiazine, oxazine, etc. These may furthermore possess substituent groups.

$R_{55}$ in general formula (Cp-3) denotes a straight chain or branched chain alkyl group with 1 to 32, preferably 1 to 22, carbon atoms (e.g., methyl, isopropyl, tert-butyl, hexyl, dodecyl), an alkenyl group (e.g., allyl), a cycloalkyl group (e.g., cyclopentyl, cyclohexyl, norbornyl), an aralkyl group (e.g., benzyl, β-phenylethyl), a cycloalkenyl group (e.g., cyclopentenyl, cyclohexenyl); these may also be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group, a mercapto group, etc.

Furthermore, $R_{55}$ may also denote an aryl group (e.g., phenyl, α- or β-naphthyl). The aryl group may also possess one or more substituent groups, for example, it may possess an alkyl group, an alkenyl group, a cycloalkyl group, an aralkyl group, a cycloalkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxyl group, etc., as substituent groups.

Furthermore, $R_{55}$ may denote a heterocyclic group (for example, a 5-membered or 6-membered hetero ring containing a nitrogen atom, an oxygen atom, a sulfur atom as the hetero atom, a condensed heterocyclic group, a pyridyl group, a quinolyl group, a furyl group, a benzothiazolyl group, an oxazolyl group, an imidazolyl group, a naphthoxazolyl group), a heterocyclic group substituted by means of the substituent groups enumerated with reference to the above-mentioned aryl groups, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

In the formula, $R_{54}$ denotes any of a hydrogen atom, a straight chain or branched chain alkyl or alkenyl group of 1 to 32, preferably 1 to 22, carbon atoms, a cycloalkyl group, an aralkyl group, a cycloalkenyl group (these groups may possess substituents as enumerated above with reference to $R_{55}$), aryl groups and heterocyclic groups (these groups may possess substituents as enumerated above with reference to $R_{55}$), an alkoxycarbonyl group (e.g., methoxycarbonyl, ethoxycarbonyl, stearyloxycarbonyl), an aryloxycarbonyl group (e.g., phenoxycarbonyl, naphthoxycarbonyl), an aralkyloxycarbonyl group (e.g., benzyloxycarbonyl), an alkoxy group (e.g., methoxy, ethoxy, heptadecyloxy), an aryloxy group (e.g., phenoxy, tolyloxy), an alkylthio group (e.g., ethylthio, dodecylthio), an arylthio group (e.g., phenylthio, α-naphthylthio), a carboxy group, an acylamino group (e.g., acetylamino, 3-[(2,4-di-tertamylphenoxy)acetamido]benzamido), a diacylamino group, an N-alkylacylamino group (e.g., N-methylpropionamido), an N-arylacylamino group (e.g., N-phenylacetamido), a ureido group (e.g., ureido, N-arylureido, N-alkylureido), a urethane group, a thiourethane group, an arylamino group (e.g., phenylamino, N-methylanilino, diphenylamino, N-acetylanilino, 2-chloro-5-tetradecanamidoanilino), an alkylamino group (e.g., n-butylamino, methylamino, cyclohexylamino), a cycloamino group (e.g., piperidino, pyrrolidino), a heterocyclic amino group (e.g., 4-pyridylamino, 2-benzoxazolylamino), an alkylcarbonyl group (e.g., methylcarbonyl), an arylcarbonyl group (e.g., phenylcarbonyl), a sulfonamido group (e.g., alkylsulfonamido, arylsulfonamido), a carbamoyl group (e.g., ethylcarbamoyl, dimethylcarbamoyl, N-methylphenylcarbamoyl, N-phenylcarbamoyl), a sulfamoyl group (e.g., N-alkylsulfamoyl, N,N-dialkylsulfamoyl, N-arylsulfamoyl, N-alkyl-N-arylsulfamoyl, N,N-diarylsulfamoyl), a cyano group, a hydroxyl group, and a sulfo group.

In the formula, $R_{56}$ denotes a straight chain or branched chain alkyl group, an alkenyl group with 1 to 32, preferably 1 to 22, carbon atoms, a cycloalkyl group, an aralkyl group, or a cycloalkenyl group, and these may possess substituents as enumerated above with reference to $R_{55}$.

Furthermore, $R_{56}$ may denote an aryl group or a heterocyclic group, and these may possess substituents as enumerated above with reference to $R_{55}$.

In addition, $R_{56}$ may denote a cyano group, an alkoxy group, an aryloxy group, a halogen atom, a carboxyl group, an alkoxycarbonyl group, an aryloxycarbonyl group, an acyloxy group, a sulfo group, a sulfamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, or a hydroxyl group.

$R_{57}$, $R_{58}$ and $R_{59}$ denote groups used in the usual 4-equivalent form phenol or α-naphthol couplers; more specifically $R_{57}$ includes a hydrogen atom, a halogen atom, an alkoxycarbonylamino group, an aliphatic hydrocarbon radical, an N-arylureido group, an acylamino group, $-O-R_{62}$ or $-S-R_{62}$ (where $R_{62}$ is an aliphatic hydrocarbon radical); where two or more $R_{57}$ exist in the same molecule, two $R_{57}$ may be different groups, and the aliphatic hydrocarbon radical may contain substituents.

Further, in the case in which these substituent groups contain aryl groups, the aryl group may possess the substituents enumerated with reference to $R_{55}$ above.

As $R_{58}$ and $R_{59}$ there can be mentioned groups chosen from aliphatic hydrocarbon radicals, aryl groups and hetero groups, or these may on the other hand be a hydrogen atom, further, some of these groups may possess substituents. Further, $R_{58}$ and $R_{59}$ may be joined forming a nitrogen atom hetero ring nucleus.

Also, the aliphatic hydrocarbon radical may be either saturated or unsaturated, and straight chain, branched chain, or cyclic. Also, it is preferably an alkyl group (e.g., methyl, ethyl, propyl, isopropyl, butyl, t-butyl, isobutyl, dodecyl, octadecyl, cyclobutyl, cyclohexyl), an alkenyl group (e.g., allyl, octenyl). The aryl group is a phenyl group, a naphthyl group, etc., further the respective groups: a pyridinyl group, a quinolyl group, a thienyl group, a piperidyl group, an imidazolyl group, etc., are representative of the hetero radical. As substituents introduced into these aliphatic hydrocarbon radicals, aryl groups and heterocyclic residues, there may be mentioned a halogen atom and the various groups: a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, a ester group, an acyl group, an acyloxy group, a sulfonamido group, a sulfamoyl group, a sulfonyl group, a morpholino group, etc.

l denotes an integer 1 to 4, m an integer 1 to 3, p an integer 1 to 5.

$R_{60}$ denotes an arylcarbonyl group, an alkanoyl group with 2 to 32, preferably 2 to 22, carbon atoms, an arylcarbamoyl group, an alkanecarbamoyl group with 2 to 32, preferably 2 to 22, carbon atoms, an alkoxycarbonyl group with 1 to 32, preferably 1 to 22, carbon atoms, or an aryloxycarbonyl group; these may also possess substituents, and as the substituent groups are: an alkoxy group, an alkoxycarbonyl group, an acylamino group, an alkylsulfamoyl group, an alkylsulfonamido group, an alkylsuccinimido group, a halogen atom, a nitro group, a carboxyl group, a nitrile group, an alkyl group or an aryl group.

$R_{61}$ denotes an arylcarbonyl group, an alkanoyl group with 2 to 32, preferably 2 to 22, carbon atoms, an aryl group, an alkanecarbamoyl group with 2 to 32, preferably 2 to 22, carbon atoms, an alkoxycarbonyl group or an aryloxycarbonyl group with 1 to 32, preferably 1 to 22, carbon atoms, an alkylsulfonyl group with 1 to 32, preferably 1 to 22, carbon atoms, an arylsulfonyl group, an aryl group, a 5-membered or 6-membered heterocyclic group (with the hetero atom chosen from a nitrogen atom, an oxygen atom, a sulfur atom, e.g., a triazolyl group, an imidazolyl group, a phthalimido group, a succinimido group, a furyl group, a pyridyl group or a benzotriazolyl group); these may possess substituents as mentioned for $R_{60}$ above.

Among the above coupler radicals, as the yellow coupler radical, in general formula (Cp-1), the case where $R_{51}$ denotes a t-butyl group or a substituted or unsubstituted aryl group, $R_{52}$ denotes a substituted or unsubstituted aryl group, and in general formula (Cp-2), the case where $R_{52}$ and $R_{53}$ denote a substituted or unsubstituted aryl group, are preferred as the yellow coupler radicals.

As the magenta coupler radical there are preferred, in general formula (Cp-3), the case in which $R_{54}$ denotes an acylamino group, a ureido group and an arylamino group, $R_{55}$ denotes a substituted aryl group, in general formula (Cp-4), the case in which $R_{54}$ denotes an acylamino group, a ureido group and an arylamino group, and $R_{56}$ denotes a hydrogen atom, and, in general formulae (Cp-5) and (Cp-6), also the case in which $R_{54}$ and $R_{56}$ denote straight chain or branched chain alkyl groups, alkenyl groups, cycloalkyl groups, aralkyl groups or cycloalkenyl groups.

As the cyan coupler radical there are preferred the case in which, in general formula (Cp-7), $R_{57}$ denotes a 2-position acylamino group or ureido group, a 5-position acylamino group or alkyl group, and a 6-position hydrogen atom or chlorine atom, and the case in which, in general formula (Cp-9), $R_{57}$ denotes a 5-position hydrogen atom, acylamino group, sulfonamido group, alkoxycarbonyl group, $R_{58}$ denotes a hydrogen atom, and furthermore $R_{59}$ denotes a phenyl group, an alkyl group, an alkenyl group, a cycloalkyl group, an aralkyl group and a cycloalkenyl group.

As the colorless coupler radical there are preferred the cases in which, in general formula (Cp-10), $R_{57}$ denotes an acylamino group, a sulfonamido group, or a sulfamoyl group; and in general formula (Cp-11), $R_{60}$ and $R_{61}$ denote alkoxycarbonyl groups.

Further, in the various moieties of $R_{51}$ to $R_{61}$, dimers and higher polymers may be formed; in the various moieties of these groups, there may also be polymers of monomers which have ethylenically unsaturated groups or polymers with non-color-forming monomers.

When the coupler residual groups of this invention denote polymers, they signify copolymers of one or more types of non-color-forming monomers which include at least one ethylene group which has no ability to couple with the oxidized form of the primary aromatic amine developer or monomers which contain a recurring unit which can be represented by general formula (Cp-13), derived from a monomer coupler which can be represented by general formula (Cp-12) given below. Here the monomeric coupler may be two or more kinds polymerized simultaneously.

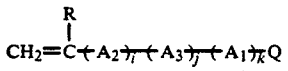

(Cp-12)

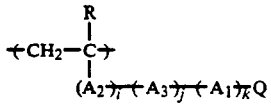

(Cp-13)

In the above formulae, R denotes a hydrogen atom, a lower alkyl group with 1 to 4 carbon atoms, or a chlorine atom; $A_1$ denotes —CONR'—, —NR'CONR'—, —NR'COO—, —COO—, —$SO_2$—, —CO—, —NR-CO—, —$SO_2$NR'—, —NR'$SO_2$—, —OCO—, —O-CONR'—, —NR'— or —O—; $A_2$ denotes —CONR-'—or —COO—; R' denotes a hydrogen atom, an aliphatic group or an aryl group; in the case where there are two or more R in one molecule, they may be the same or different. $A_3$ denotes an unsubstituted or substituted alkylene group (e.g., methylene, ethylmethylene, dimethylmethylene, dimethylene, trimethylene, tetramethylene, pentamethylene, hexamethylene, decylmethylene), an aralkylene group having 1 to 10 carbon atoms (e.g., benzylidene), or an unsubstituted or substituted arylene group (e.g., phenylene, naphthylene), the alkylene group can be straight chain or branched chain.

Q denotes a group which is any of the moieties $R_{51}$ to $R_{61}$ of general formulae (Cp-1) to (Cp-11) and bonded to general formula (Cp-12) or (Cp-13).

i, j and k denote 0 or 1, but i, j and k are not all simultaneously 0.

Substituent groups on the alkylene group, aralkylene group or arylene group: include an aryl group (e.g., phenyl), a nitro group, a hydroxyl group, a cyano group, a sulfo group, an alkoxy group (e.g., methoxy), an aryloxy group (e.g., phenoxy), an acyloxy group (e.g., acetoxy), an acylamino group (e.g., acetylamino), a sulfonamido group (e.g., methanesulfonamido), a sulfamoyl group (e.g., methylsulfamoyl), a halogen atom (e.g., fluorine, chlorine, bromine), a carboxy group, a carbamoyl group (e.g., methylcarbamoyl), an alkoxycarbonyl group (e.g., methoxycarbonyl), and a sulfonyl group (e.g., methylsulfonyl). Where there are two or more of these substituent groups, they may be the same or different.

Next, as the non-color-forming ethylenic monomer which does not couple with the oxidation product of the primary aromatic amine developer, there are an acrylic acid, an α-chloroacrylic acid, an α-alkylacrylic acid, and the esters or amides derived from these acrylic acids, methylenebisacrylamide, vinyl esters, acrylonitrile, aromatic vinyl compounds, maleic acid derivatives, vinylpyridines and such like. Two or more of the non-color-forming ethylenically unsaturated monomers can be utilized at the same time.

The couplers of the present invention are particularly advantageous, in the effect of improving sharpness, when combined with thin layer technology for photographic layers. For example, there may be mentioned, as thin layer technology, reduction of the amount of silver by utilization of 2-equivalent couplers; reduction of the amount of coupler added, by increasing the amount of coupler color formation per unit weight by the utilization of bis form couplers or polymeric couplers; or reduction of the amount of coupler added by utilization of a coupler (a 2-equivalent magenta coupler) which efficiently forms image-forming dyes, with low secondary reactions, etc. These techniques are well known, and are all known as attempts to reduce the film thickness of the emulsion layer with a view to improving sharpness. When using the couplers of the present invention, particularly in combination with the above techniques, the difference in sharpness from that when the known DIR couplers are utilized is marked. The couplers enumerated above are used in the layers containing the couplers of the present invention or upper layers from these (layers on the far side from the support). A particularly preferred mode of embodiment is the case in which, in a color photographic material containing at least one 2-equivalent yellow coupler in the blue-sensitive emulsion layer, and at least one 2-equivalent magenta coupler or polymeric magenta coupler (a 2-equivalent form or a 4-equivalent form) in the green-sensitive emulsion layer, at least one of the green-sensitive emulsion layer and the red-sensitive emulsion layer contains the coupler of the present invention. There are thus cases in which couplers of the present invention are contained in the blue emulsion layer and cases in which they are not.

Specific examples of the couplers of the present invention are mentioned below, but this does not mean that they are limited to these.

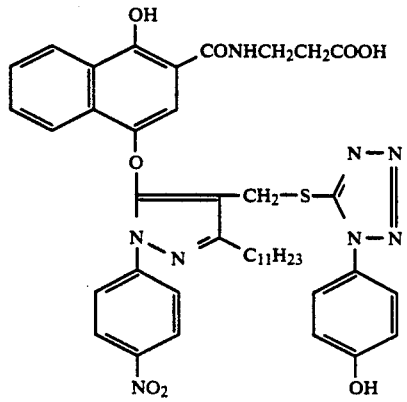

(D-1)

-continued
(D-2)
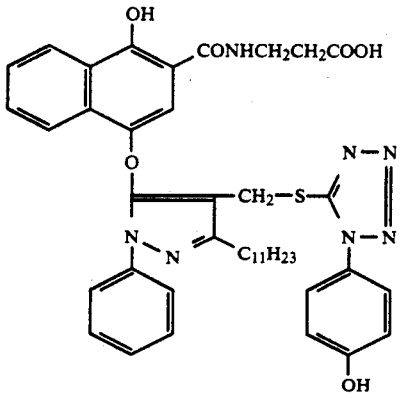
(D-3)
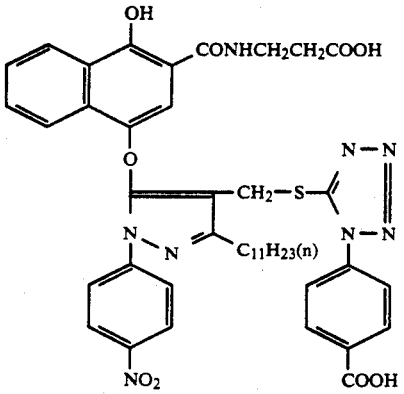
(D-4)
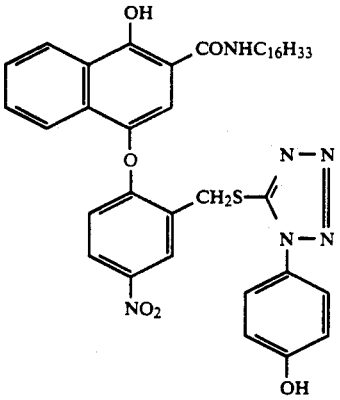
(D-5)
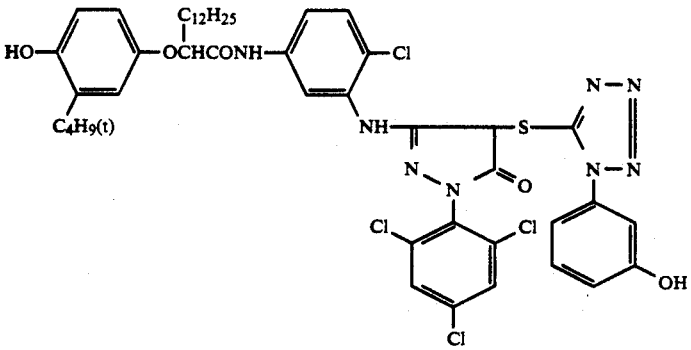

-continued
(D-6)
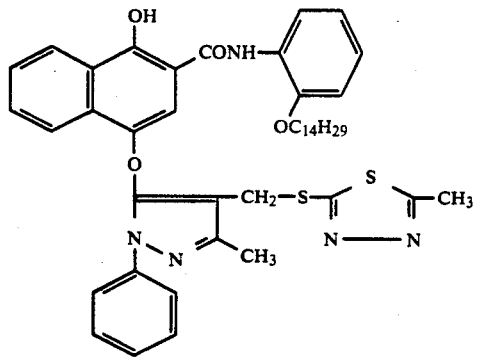
(D-7)
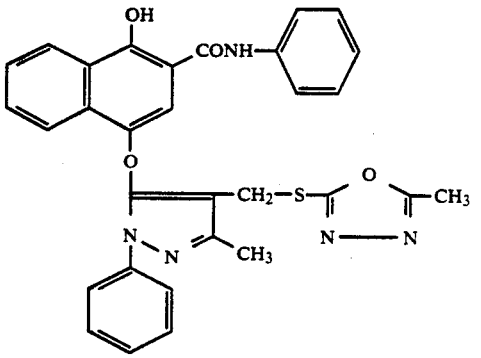
(D-8)
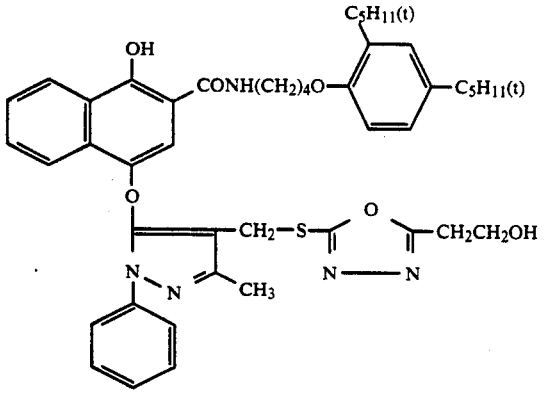
(D-9)
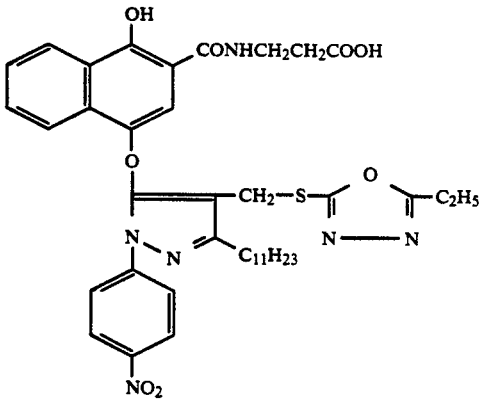

-continued
(D-10)
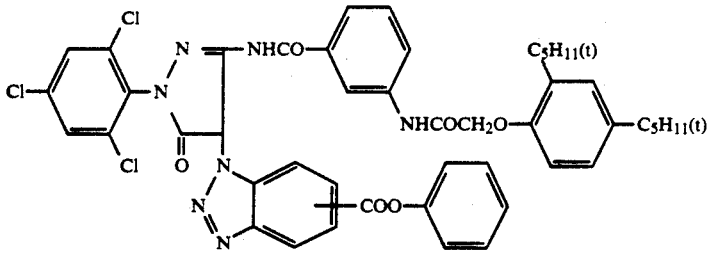
(D-11)
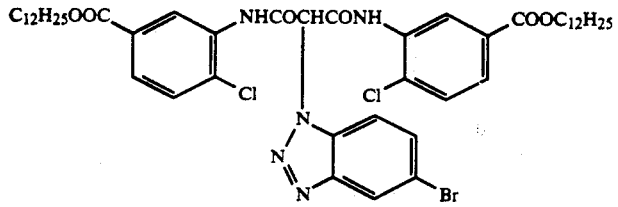
(D-12)
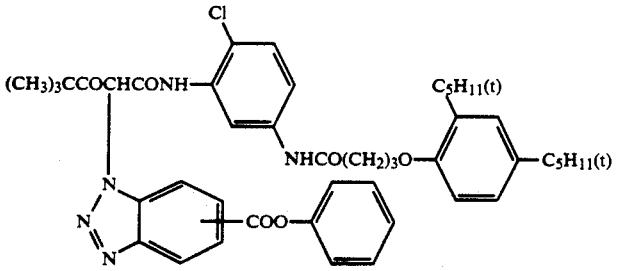
(D-13)
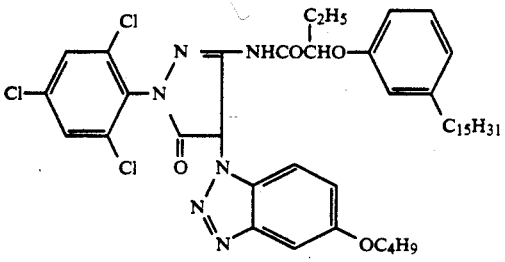
(D-14)
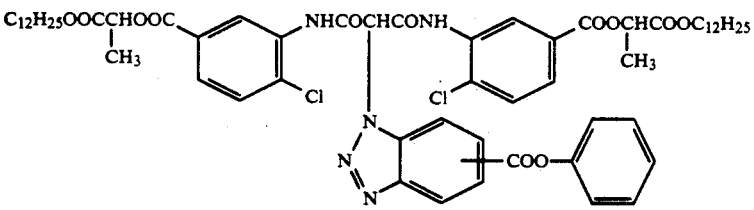
(D-15)
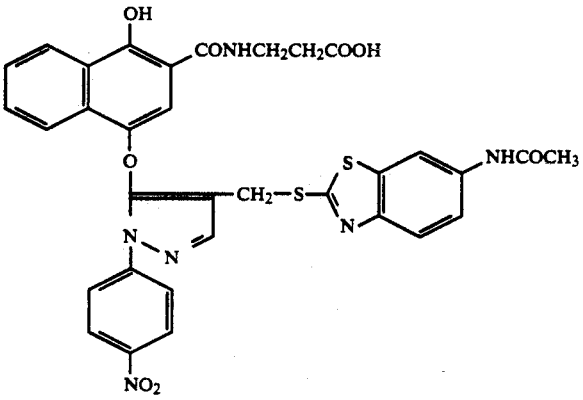

-continued
(D-16)
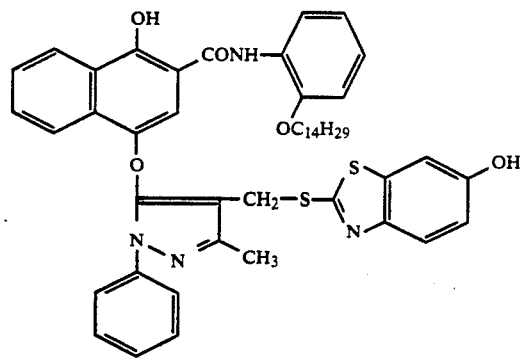
(D-17)
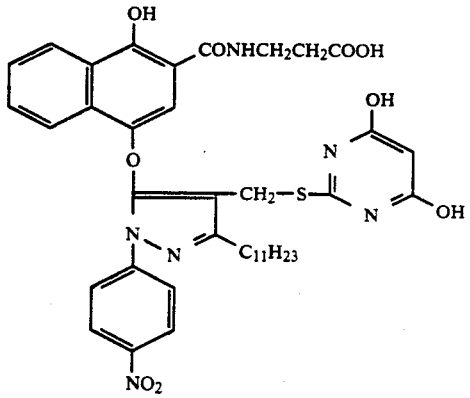
(D-18)
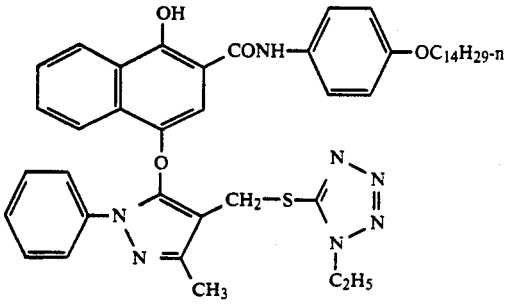
(D-19)
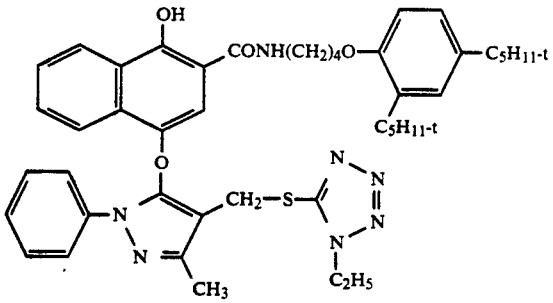
(D-20)
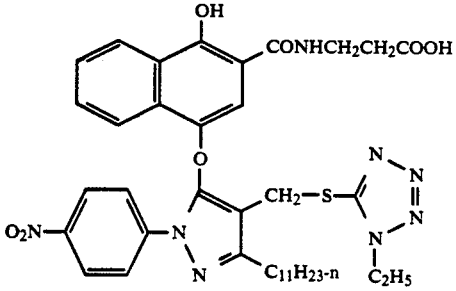

-continued
(D-21)
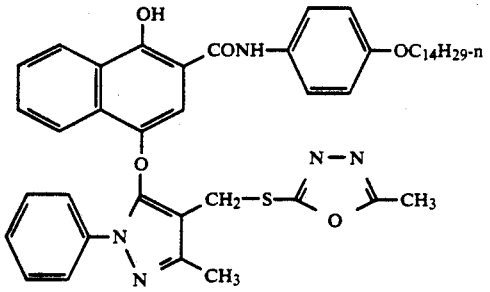
(D-22)
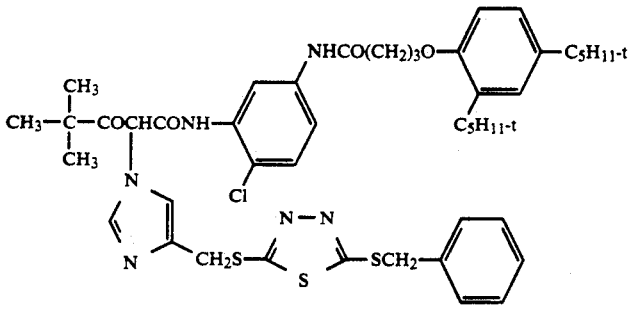
(D-23)
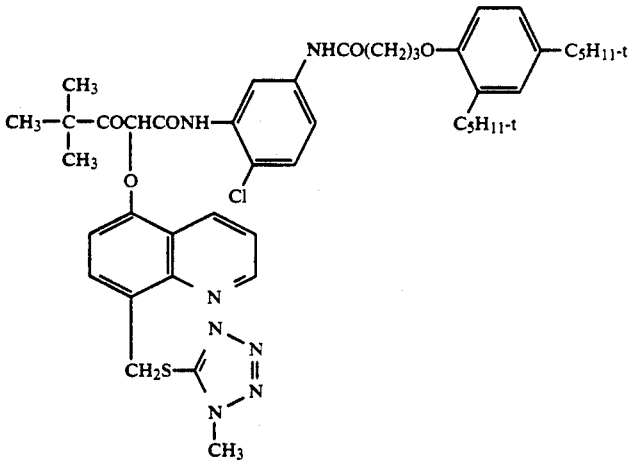
(D-24)
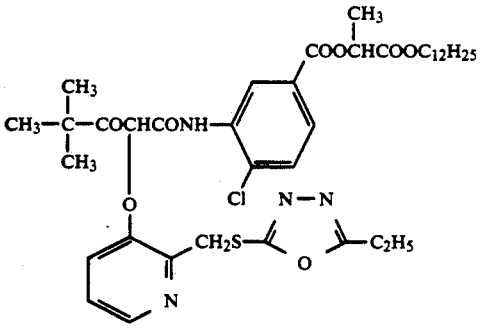

-continued
(D-25)
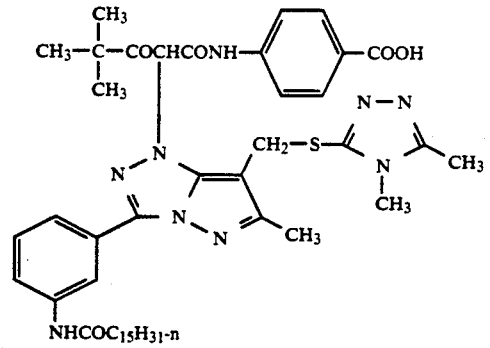
(D-26)
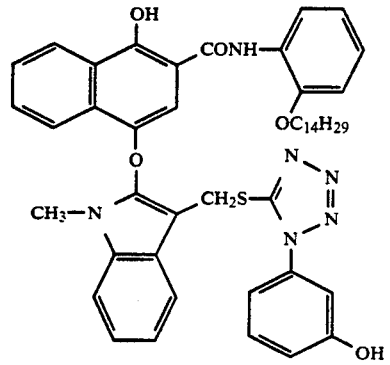
(D-27)
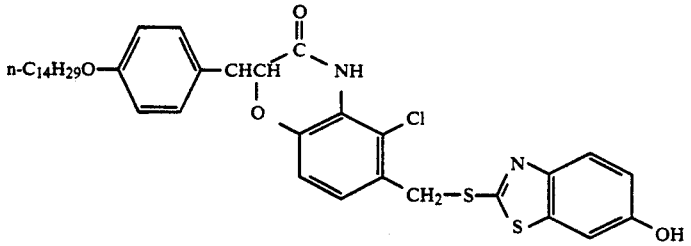
(D-28)
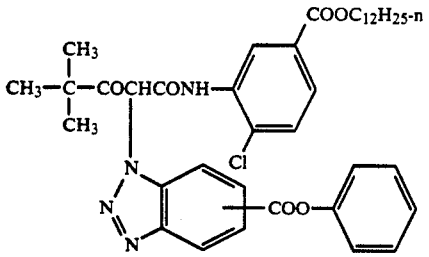
(D-29)
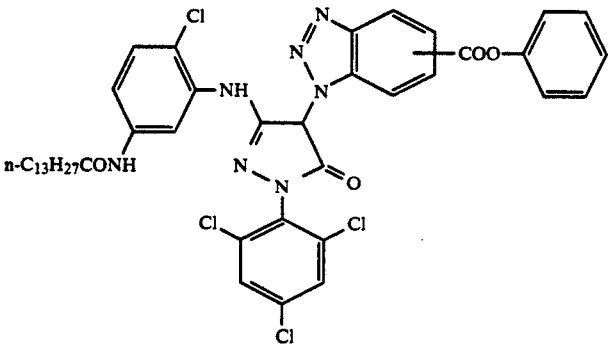

-continued
(D-30)
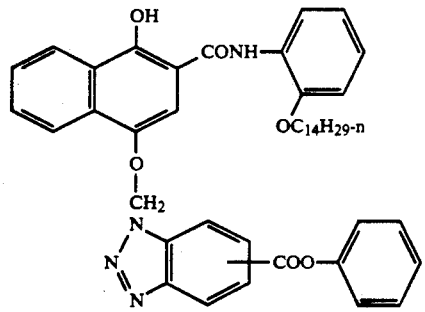
(D-31)
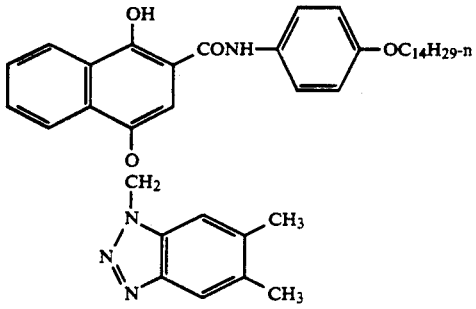
(D-32)
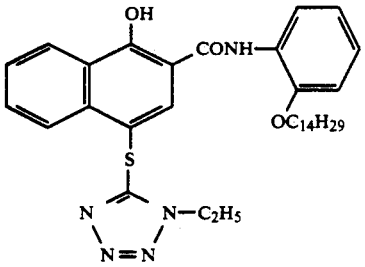
(D-33)
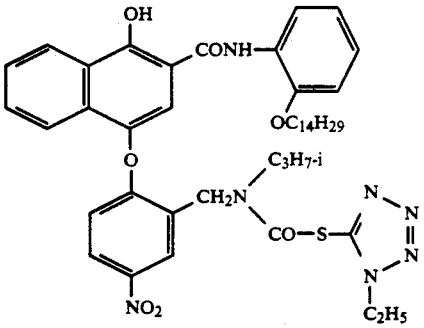
(D-34)
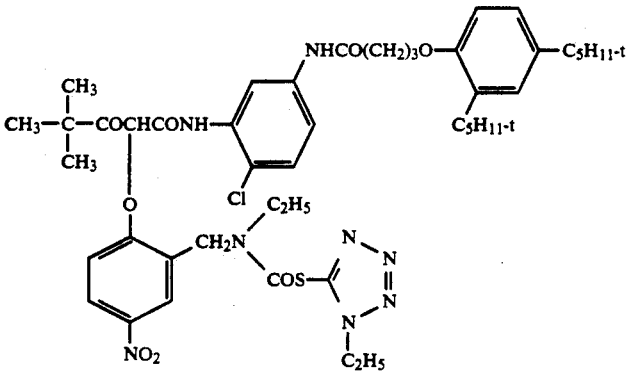

-continued
(D-35)
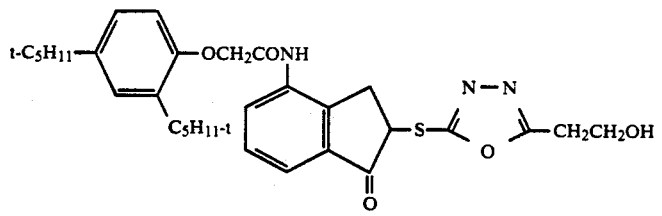
(D-36)
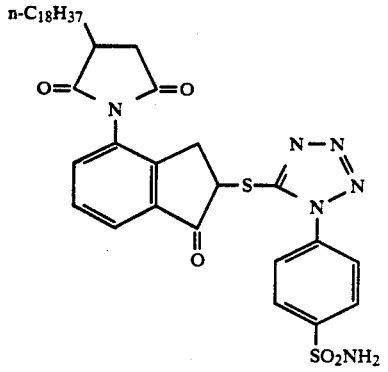
(D-37)
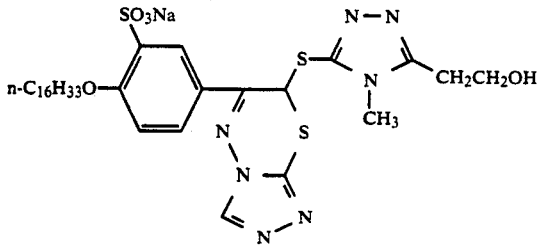
(D-38)
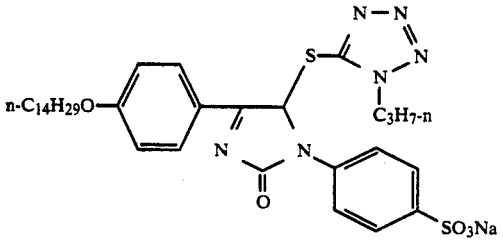
(D-39)
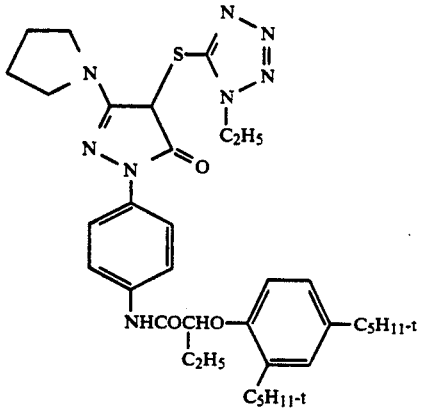

-continued (D-40)

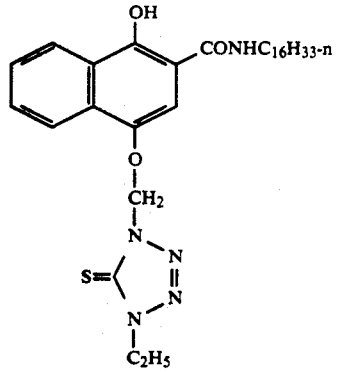

(D-41)

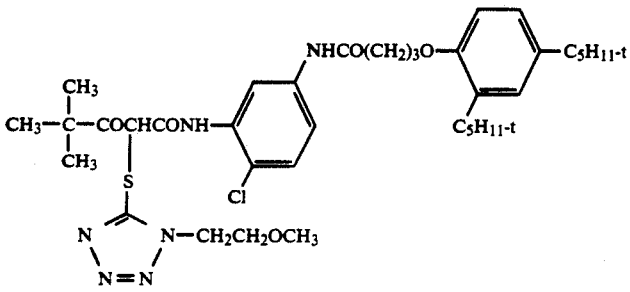

These couplers can be synthesized by the methods disclosed in, for example, U.S. Pat. Nos. 4,174,966, 4,183,752, 4,421,845, 4,477,563, and JP-A-54-145135, 57-151944, 57-154234, 57-188035, 58-98728, 58-162949, 58-209736, 58-209737, 58-209738, and 58-209740.

In the present invention, the interlayer effect is great, and there is the possibility of regulating it by the amounts of DIR compounds added, etc. The following are particularly preferred from the point of view of color reproduction:

$$-0.15 \leqq D_B/D_R \leqq +0.20$$

$$-0.70 \leqq D_G/D_R \leqq 0.00$$

$$-0.50 \leqq D_B/D_G \leqq 0.00$$

$$-1.10 \leqq D_R/D_G \leqq -0.10$$

$$-0.45 \leqq D_G/D_B \leqq -0.05$$

$$-0.05 \leqq D_R/D_B \leqq +0.35$$

(where $D_B/D_R$ blue-sensitive layer from red-sensitive layer, $D_G/D_R$ green-sensitive layer from red-sensitive layer, $D_B/D_G$ blue-sensitive layer from green-sensitive layer, $D_R/D_G$ red-sensitive layer from green-sensitive layer, $D_G/D_B$ green-sensitive layer from blue-sensitive layer, and $D_R/D_B$ red-sensitive layer from blue-sensitive layer, respectively denote the interlayer effects).

Figure 4:
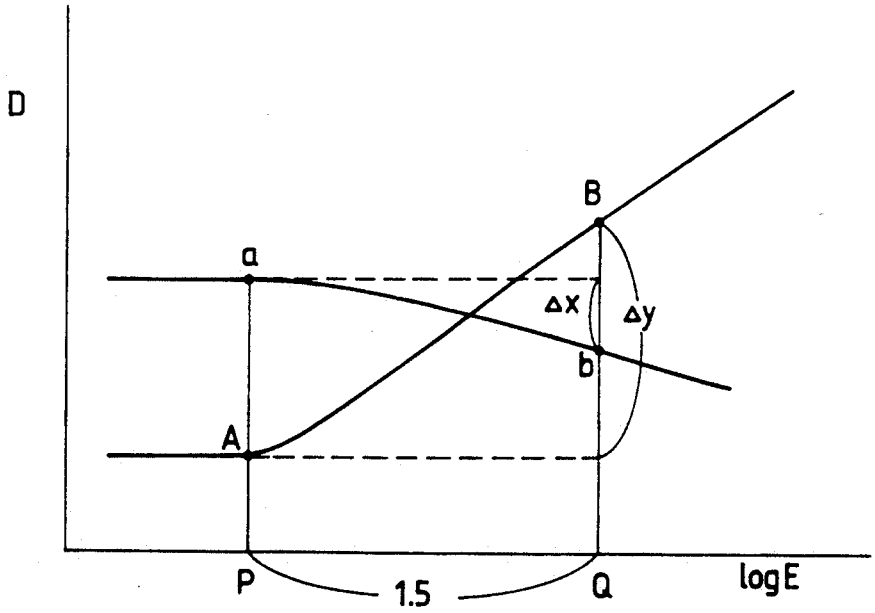
FIG. 4 is a conceptual diagram of the characteristic curves required for the size ($\Delta x/\Delta y$) of the interlayer effect.

The interlayer effect is determined in the present invention as follows. The interlayer effect from the green-sensitive layer to the red-sensitive layer ($D_R/D_G$) first exposure in stages to green light (Fuji filter: BPN-55), then a uniform exposure to red light (Fuji filter: SC-60): the difference in magenta density ($\Delta y$) in the characteristic curve shown in FIG. 4, is obtained, from the exposure P to an exposure Q, 1.5 times as great on a log E scale; the cyan density difference ($\Delta x$) is determined from the cyan density at exposure P to the cyan density at exposure Q; along with the fogging density they provide, and $\Delta x/\Delta y$ then serves, as a measure of the magnitude of the interlayer effect ($D_R/D_G$) from the green-sensitive layer to the red-sensitive layer. The interlayer effect from the blue-sensitive layer to the red-sensitive layer can be determined similarly, using blue light (Fuji filter: BPN 45).

In the case in which $\Delta x$ is a negative value, an interlayer inhibition effect is present, and the interlayer inhibition effect is denoted by the negative value. Further, in the case in which $\Delta x$ has a positive value, no interlayer inhibition effect exists (there is turbidity), and its magnitude is denoted by a positive value.

Incidentally, in recent years, masking materials have been remarkably improved, and the color turbidity due to unnecessary absorption of each color coupler which forms each color is sufficiently corrected for practical use. Accordingly, the size of the interlayer effect, in this specification, is the value after the influences of unnecessary absorption of the color couplers which form in each color have been corrected.

The mechanism by which control of the distribution of iodide ions in the silver halide grains is achieved by the present invention is not clear.

As regards the principles of the XPS method utilized for analysis of the iodide content of the neighborhood of the surface of the silver halide grains, reference can be made to Shunichi Aibara et al., *Electron Spectroscopy*, (Kyoritsu Library 16, Kyoritsu Shuppan, 978).

The standard XPS measurement method utilizes Mg-K$\alpha$ X-rays for excitation and measures the intensity of photoelectrons of iodine (I) and silver (Ag) (usually I-$3d_{5/2}$, Ag-$3d_{5/2}$) radiated from silver halide grains made into an appropriate sample form.

In seeking the iodine content, an analytical curve of photoelectron intensity ratio (intensity (I)/intensity (Ag)) of iodine (I) and silver (Ag) is prepared using standard samples of known iodine content, and the unknown values can be read from this curve. The XPS measurement should be made after decomposition and removal of the gelatin absorbed on the surface of the silver halide grains in the silver halide emulsion by means of proteolytic enzymes and the like.

The silver iodide content of the core part and the shell part can be measured by X-ray diffraction methods. As a reference on X-ray diffraction applied to silver halides, there is mentioned, for example, H. Hirsch, *Journal of Photographic Science*, Vol. 10 (1962), pp. 129 ff. According to the halogen composition, a diffraction peak exists at the diffraction angle given by the Bragg equation ($2d \sin \theta = n\lambda$) and the fixed lattice constant.

Detailed accounts of X-ray diffraction measurement methods are given in *Fundamental Analytical Chemistry Course* 24, "X-Ray Analysis" (Kyoritsu Shuppan) or *Guide to X-Ray Diffraction* (Rigaku Denki K. K.), etc. The standard method is to seek the diffraction curve from the (220) plane of the silver halide, using as radiation source Cu K$\beta$ radiation and a Cu target (tube voltage 40 kv, tube current 60 mA). Because the resolving power of the measuring equipment is high, it is necessary to confirm the measurement accuracy, using standard samples of silicon and the like, and with appropriate choice of width of slits (divergent slit, light-receiving slit, etc.), time constant of the equipment, goniometer scanning speed, recording speed, etc.

When a curve has been obtained for diffraction intensity against diffraction angle from the (220) plane of silver halides, using Cu K$\beta$ radiation, there is the case in which a diffraction peak corresponds to a high iodine layer with 10 to 45 mol% of silver iodide, and a diffraction peak corresponds to a low iodine layer are detected as precisely separated, and the case in which the two peaks are mutually superposed and are not precisely separated.

Means of analyzing a diffraction curve established from two diffraction components are well known; for example, as explained in *Experimental Physics Course* 11 *Lattice Defects* (Kyoritsu Shuppan), etc.

Assuming that the curve is a Gauss function or a Lorenz function, etc., analysis using a curve analyzer made by the Du Pont Company, or the like, is also useful.

The separation of the above-mentioned high iodine layer and low iodine layer of the silver halide grains used in the present invention need not be distinct.

Even in the case of an emulsion in which two kinds of grain with different halogen compositions coexist, but do not possess a mutually distinct layer structure, two peaks are detected by the above-mentioned X-ray diffraction.

In this kind of emulsion, the excellent photographic performance obtained in the present invention cannot be demonstrated.

A determination whether an emulsion is a silver halide emulsion according to the present invention, or whether it is an emulsion in which two kinds of silver halide grains coexist, is possible by using, other than X-ray diffraction, the EPMA method (Electron Probe Micro-Analyzer method).

This method illuminates, with an electron beam, a sample prepared with the emulsion grains well separated and not mutually in contact. By X-ray analysis by means of the electron beam excitation, elemental analysis is performed on ultramicro portions.

Using this method, the characteristic X-ray intensity of silver and iodine from each grain is determined, and the halogen composition of individual grains can be determined.

If the halogen composition of at least 50 grains is determined by the EPMA method, it can be decided whether or not this emulsion is an emulsion according to the present invention.

It is preferable for the emulsion of the present invention to be rather uniform in iodine content between grains.

When the distribution of iodine content between grains is measured by the EPMA method, it is preferred that the relative standard deviation is 50% or below, particularly 35% or below, and more particularly 20% or below.

The preferred halogen composition of the silver halide grains of the present invention is as follows.

The core part is high iodine silver halide; the average iodine content is between from 10 mol% to the solid solution limit of 40 mol%. Preferably, it is 15 to 40 mol%, and is furthermore preferably 20 to 40 mol%. There is a case where, due to the core grain manufacture method, an optimum value of core iodine content between 20 and 40 mol% exists, and a case near the optimum value, between 30 and 40 mol%.

The silver halide other than silver iodide in the core part may be silver chlorobromide or silver bromide, but a high proportion of silver bromide is preferable.

The average iodine content of the shell part is lower than that of the core part, and preferably the silver halide contains 10 mol% or less of silver iodide; more preferably, the silver halide contains 5 mol% or below of silver iodide. The silver iodide distribution of the shell part may be uniform or nonuniform. The average grain surface silver iodide content of the grains of the present invention, as measured by the XPS method, is 5 mol% or above, preferably above 7 mol% and below 15 mol% when the average silver iodide content of the shell is rather high. The distribution of silver iodide near the grain surface may be uniform or nonuniform.

The silver halide in the surface, other than silver iodide, may be silver chloride, silver chlorobromide or silver bromide, but a high proportion of silver bromide is desirable.

With regard to the total silver halide composition, in the case of a silver iodide content of 7 mol% or above, the effect of the present invention is evident.

Furthermore, the total silver iodide content is preferred at 9 mol% or above, and particularly preferred above 12 mol% and below 18 mol%.

The size of the silver halide grains of the present invention is not particularly limited, but 0.4 $\mu$m and above is preferable, and further is preferably 0.6 $\mu$m to 2.5 $\mu$m.

The shape of the silver halide grains of the present invention may be a hexagonal, octagonal, dodecagonal, or 14-sided, regular crystal form (normal crystal grains), or it may be spherical, potato-shaped, tabular, and the like other irregular crystal forms.

The case of normal crystal grains where 50% or more of the grains possess (111) surfaces is particularly preferred. In the case of irregular crystal form, it is also particularly preferred for 50% and above of the grains to have (111) faces. The surface ratio of (111) faces can be assessed by the Kubelka-Munk dye adsorption method. Here either (111) faces or (100) faces preferentially absorb and further, the state of association of dyes on (111) faces and the state of association of dyes on (100) faces select spectrally different dyes. On adding this kind of dye to the emulsion, by investigating the spectrum against the amount added, the surface ratio of the (111) faces can be determined.

In the case of twin crystal grains, tabular grains are preferred. Cases in which grains of thickness 0.5 μm and below, diameter 0.6 μm and above, average aspect ratio 2 or more and preferably 3 to 10 exist in the same layer and occupy at least 50% of the whole projected surface area of the silver halide grains are particularly preferred. The definition and measurement of the average aspect ratio are concretely described in, for example, JP-A-58-113926, 58-113930, and 58-113934.

It is possible for the emulsions of the present invention to have a wide grain size distribution, but a narrower grain size distribution is preferred. In particular, in the case of normal crystal grains, the weight or grain number of the silver halide grains is preferably such that the size of the grains occupying 90% of the whole of each emulsion have an average grain size within ±40%, and furthermore a monodispersed emulsion having an average grain size within ±30% is preferred.

It is possible to manufacture the silver halide grains of the present invention by selecting and combining various methods.

Firstly, in the manufacture of the core grains, an acid method, a neutral method, an ammonia method, etc., further, a one way mixed method comprising the reaction of a soluble silver salt with a soluble halogen salt, a simultaneous mixing method, or a combination of these, can be chosen.

As one form of a simultaneous mixing method, the method in which the pAg is kept constant in the liquid phase of the silver halide being produced, namely, a controlled double jet method, can be used. As another form of the simultaneous mixing method, the triple jet method, in which various different compositions of soluble halogen salts are independently added (for example, soluble silver salt and soluble bromine salt and soluble iodine salt), can also be used. When manufacturing the core, ammonia, thiocyanate salts, thioureas, thioethers, amines and the like silver halide solvents may be used. An emulsion with narrow core grain size distribution is desirable. The above-mentioned monodispersed core emulsions are particularly preferable. Whether the halide composition of the core stage is uniform or not can be determined by the above-mentioned X-ray diffraction means and EPMA method. In the case in which the halide composition of the core grains is rather uniform, the diffraction width of the X-ray diffraction gives a narrow, sharp peak.

A method of manufacture of core grains with halide composition uniform between grains is shown in JP-B-49-21657. First by the double jet method, a solution was made of 5 g of inert gelatin and 0.2 g of potassium bromide dissolved in 700 ml of distilled water, at 50° C. while stirring; 1 l of an aqueous solution in which were dissolved 52.7 g of potassium bromide and 24.5 g of potassium iodide, and 1 l of an aqueous solution in which were dissolved 100 g of silver nitrate, are simultaneously added at an equal fixed rate to the previously mentioned solution which was being stirred for about 80 minutes, while adding distilled water to make a total volume of 3 l; silver iodobromide with a silver iodide content of 25 mol% is obtained. It was found by X-ray diffraction that the silver iodobromide grains had a comparatively sharp iodine distribution. Further, by a separate rush addition method, an aqueous solution of inert bone gelatin 33 g, potassium bromide 5.4 g, and potassium iodide 4.9 g were dissolved in distilled water, and stirred at 70° C. and then 125 ml of an aqueous solution in which 12.5 g of silver nitrate were dissolved was instantaneously added; comparatively uniform silver iodide grains were obtained with a silver iodide content of 40 mol%.

It is disclosed in JP-A-56-16124 that in a silver iodobromide emulsion with a halide composition of 5 to 40 mol% silver iodide, by keeping the pAg of a solution containing protective colloid within the range 1 to 8, a uniform silver iodobromide is obtained.

After making seed crystals of silver iodobromide containing a high concentration of silver iodide, a uniform silver iodobromide is obtained by methods of silver iodobromide grain growth: the method disclosed by Irie and Suzuki in JP-B-48-36890 of faster time and speed of addition, or the method disclosed by Saitoh in U.S. Pat. No. 4,242,445 involving increased addition concentration with time. These methods give particularly preferable results. The method of Irie et al. involves adding inorganic aqueous salt solutions for reaction at more than a fixed rate of addition, adding at a rate Q which is a rate of addition in proportion with the total surface area of the low solubility inorganic salt crystals during growth, i.e., they are added at more than $Q=r$ and less than $Q=\alpha t^2+\beta t+r$, in a process in which photographic low solubility inorganic crystals are prepared using multiple decomposition reactions brought about by the simultaneous addition of the inorganic aqueous salt solutions, in roughly equal quantities, in the presence of a protective colloid.

On the other hand, in the Saitoh method of manufacture of silver halide crystals in the presence of a protective colloid, two or more kinds of inorganic salts are added simultaneously, and the concentration of the aqueous solution of the reacted inorganic salts is caused to increase to the extent that practically no new crystal nuclei are formed during crystal growth.

Apart from these, manufacture is possible by application of the emulsion manufacturing methods published in, for example, JP-A-60-138538, 61-88253, 59-177535, 61-112142, and 60-143331.

Methods of introduction of silver iodide into the shell portion of the silver halide grains of the present invention are numerous. Exudation of the silver iodide from the core part to the shell part may be brought about during the addition by the double jet method of an aqueous solution of a water-soluble bromide with an aqueous solution of a water-soluble silver salt. In this case, the silver iodide amount and distribution in the shell portion can be controlled by regulation of the pAg during the addition or by utilization of a silver halide solvent. Furthermore, an aqueous solution of a mixture of a water-soluble bromide and a water-soluble iodide can be added with an aqueous solution of a water-soluble silver salt by the double jet method; and an aqueous solution of a water-soluble bromide, an aqueous solution of a water-soluble iodide, and an aqueous solution of a water-soluble silver salt may be added by the triple jet method. To introduce silver iodide into the grain surface or into a region 50 to 100 Å from the grain surface, an aqueous solution containing a water-soluble iodide may be added after formation of the grains, adding 0.1 μm and less of silver iodide micrograins or silver halide micrograins of high silver iodide content.

In carrying out the manufacture of the silver halide grains according to the present invention, the shell may be put in place on the core grains straight after formation, but is preferable to put the shell in place after a water wash in order to desalt the core emulsion.

Various methods are known for adding the shell in the field of manufacture of silver halide photographic materials, but the simultaneous mixing method is desirable. The method of Irie et al. and the method of Saitoh mentioned above are preferable as methods for the manufacture of emulsions having a distinct laminar structure. The necessary shell thickness varies according to grain size, but covering of large size grains, above 1.0 μm, with a shell of 0.1 μm and above, and of small size grains, below 1.0 μm, with a shell of 0.05 μm and above is desirable.

The ratio of the amount of silver in the core and shell is preferably in the range 1/5 to 5, more preferably 1/5 to 3, and particularly preferably in the range 1/5 to 2. In the process of silver halide grain formation or physical ripening in the present invention, cadmium salts, zinc salts, lead salts, thallium salts, iridium salts or its complex salts, rhodium salts or its complex salts, iron salts or iron complex salts, etc., may also be present.

The silver halide emulsions of the present invention are chemically sensitized. The methods described in, for example, H. Frieser, *Die Grundlagen der Photographischen Prozesse mit Silberhalogeniden* (Akademische Verlagsgesellschaft, 1968), pages 675 to 734, may be used for chemical sensitization.

Namely, the sulfur sensitization method using sulfur-containing compounds which can react with active gelatin and silver (e.g., thiosulfates, thioureas, mercapto compounds, thiocyanates); reduction sensitization methods using reducing substances (e.g., stannous salts, amines, hydrazine derivatives, formamidine-sulfinic acid, silane compounds); noble metal sensitization methods using noble metal compounds (e.g., apart from gold complex salts, complex salts of Pt, Ir, Pd, and other metals of Group VIII of the Periodic Table) can all be used, either singly or in combination.

Concrete examples of these are described in U.S. Pat. Nos. 1,574,944, 2,410,689, 2,278,947, 2,728,668 and 3,656,955, as regards sulfur sensitization methods; U.S. Pat. Nos. 2,983,609, 2,419,974 and 4,054,458 as regards reduction sensitization methods; U.S. Pat. Nos. 2,399,083, 2,448,060 and British Patent 618,061 as regards noble metal sensitization methods.

As the protective colloid used during the manufacture of the emulsions consisting of silver halide grains of the present invention, and as binders to other hydrophilic colloid layers, use of gelatin is useful, but other hydrophilic colloids can be used.

For example, there can be used gelatin derivatives, graft polymers of gelatin with other macromolecules, albumin, casein and such like proteins; hydroxyethyl cellulose, carboxymethyl cellulose, cellulose derivatives such as cellulose sulfate esters, sodium alginate, starch derivatives and such like sugar derivatives; and various synthetic hydrophilic macromolecular substances such as polyvinyl alcohol, polyvinyl alcohol partial acetals, poly-N-vinylpyrrolidone, polyacrylic acid, polymethacrylic acid, polyacrylamide, polyvinylimidazole, polyvinylpyrazole and such like homo- or copolymers.

As gelatin, apart from lime-treated gelatin, acid-treated gelatin, or enzyme-treated gelatin treated with enzymes as described in *Bull. Soc. Sci. Phot. Japan*, No. 16, p. 30 (1966), may be used. Furthermore, gelatin hydrolysates or enzymatic decomposition products can also be used.

The photographic emulsions used in the present invention may also be spectrally sensitized by means of methine dyes or such like. Included in the dyes used are cyanine dyes, merocyanine dyes, complex cyanine dyes, complex merocyanine dyes, homopolar cyanine dyes, hemicyanine dyes, styryl dyes and hemioxonol dyes. Particularly useful dyes are the dyes classed as cyanine dyes, merocyanine dyes, and complex merocyanine dyes. Among these dyes, any basic heterocyclic nucleus usually utilized in cyanine dyes can also be applied. Namely, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; these nuclei with alicyclic hydrocarbon rings fused to them; and these nuclei with aromatic hydrocarbon rings fused to them, namely, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., can be applied. These nuclei may be substituted on their carbon atoms.

In merocyanine dyes or complex merocyanine dyes, as nuclei possessing a ketomethylene structure, a pyrazoline-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, and the like 5- or 6-membered heterocyclic nuclei can be used.

These sensitizing dyes can be used independently, but their combinations may also be used; a combination of sensitizing dyes is frequently used when a strong color sensitization is the aim. Representative examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281 and 1,507,803, JP-B-43-4936 and 53-12375, JP-A-52-110618 and 52-109925.

Together with the sensitizing dyes, there may also be contained in the emulsion, substances which show strong color sensitization, but which are dyes which themselves possess no spectral sensitizing action or substances which substantially do not absorb visible light.

With the silver halide grains utilized in the present invention, spectral sensitization effected by at least one sensitizing dye selected from the group consisting of the compounds represented by the following general formulae (I') or (II') is particularly preferred. These sensitizing dyes may be used singly, but their combinations may also be used.

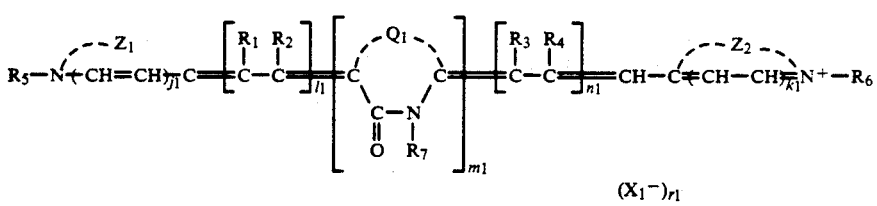

(I')

In the formula, $Z_1$, $Z_2$ may be the same or different, and denote nitrogen-containing groups to form a 5- or 6-membered heterocyclic ring. For example, thiazoline, thiazole, benzothiazole, naphthothiazole, selenazoline, selenazole, benzoselenazole, naphthoselenazol e, oxazole, benzoxazole, naphthoxazole, benzimidazole, naphthoimidazole, pyridine, quinoline, indoline, imidazo[4,5-b]quinoxaline, etc. heterocycles are mentioned, and these heterocyclic nuclei may be substituted. Examples of substituents include a lower alkyl group (preferably 6 carbon atoms or below, and also may be substituted with a hydroxy group, a halogen atom, a phenyl group, a substituted phenyl group, a carboxy group, an alkoxycarbonyl group, an alkoxy group, etc.), a lower alkoxy group (preferably 6 carbon atoms or below), an acylamino group (preferably 8 carbon atoms or below), a monocyclic aryl group, a carboxy group, a lower alkoxycarbonyl group (preferably 6 carbon atoms or below), a hydroxy group, a cyano group or a halogen atom, etc.

$Q_1$ denotes a nitrogen-containing group to form a 5- or 6-membered ketomethylene cyclic ring, for example, thiazolidin-4-one, selenazolidin-4-one, oxazolidine-4-one, imidazolidin-4-one, etc.

$R_1$, $R_2$, $R_3$ and $R_4$ denote a hydrogen atom, a lower alkyl group (preferably 4 carbon atoms or below), a phenyl group which may be substituted, or an aralkyl group, also denote, when $l_1$ denotes 2 or 3, and when n denotes 2 or 3, different $R_1$ and $R_1$, $R_2$ and $R_2$, $R_3$ and $R_3$, or $R_4$ and $R_4$ which are linked to form a 5- or 6-membered ring which may contain an oxygen atom, a sulfur atom, or a nitrogen atom, etc.

$R_5$, $R_6$ denote alkyl groups with 10 or less carbon atoms or alkenyl groups with 10 or less carbon atoms, either of which may contain an oxygen atom, a sulfur atom or a nitrogen atom within the carbon chains, and may be substituted. Examples of substituent groups include a sulfo group, a carboxy group, a hydroxy group, a halogen atom, an alkoxycarbonyl group, a carbamoyl group, a phenyl group, a substituted phenyl group, etc. Furthermore, in the case in which the above-mentioned hetero ring represented by $Z_1$, $Z_2$ contains a nitrogen atom which is further substitutable, such as benzimidazole, naphthoimidazole, imidazo[4,5-b]-quinoxaline, this further nitrogen atom of the hetero ring may be substituted with an alkyl group or an alkenyl group which may be further substituted with, for example, a hydroxy group, an alkoxy group, a halogen atom, a phenyl group or an alkoalkoxy group with up to 6 carbon atoms, etc.

$l_1$ and $n_1$ denote 0 or positive integers up to 3, with $l_1+n_1$ up to 3; when $l_1$ is 1, 2 or 3, $R_5$ and $R_1$ may be linked to form a 5- or 6-membered ring.

$j_1$, $k_1$ and $m_1$ denote 0 or 1. $X_1^{31}$ denotes an acid anion, and $r_1$ denotes 0 or 1.

Among $R_5$, $R_6$ and $R_7$, preferably at least one is a group possessing a sulfo group or a carboxy group.

Among the sensitizing dyes contained in general formula (I'), the preferred ones are as below.

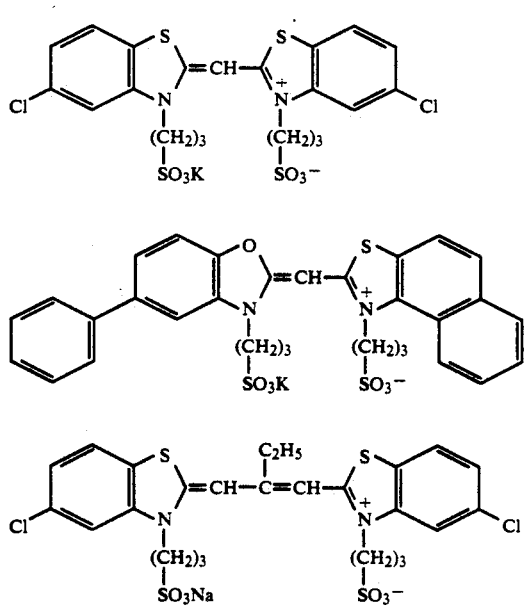

-continued
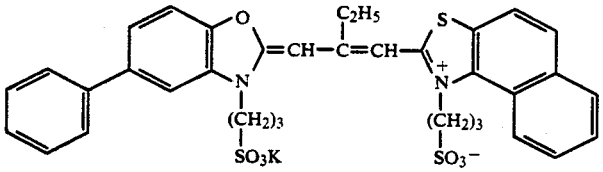
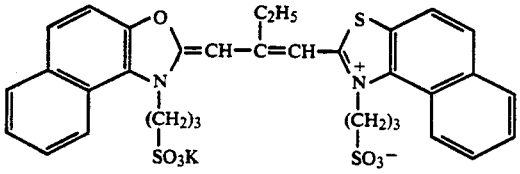
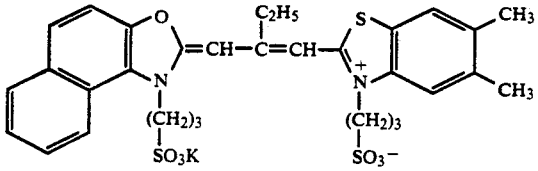
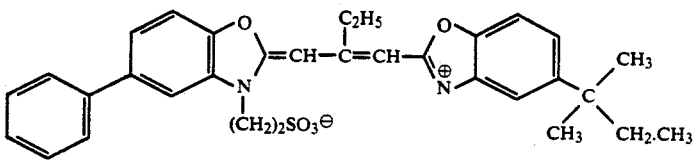
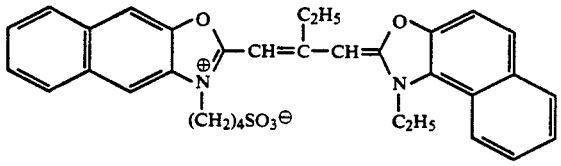
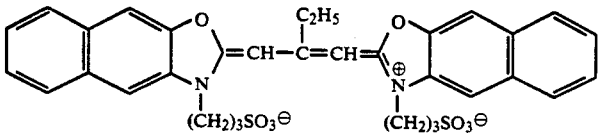
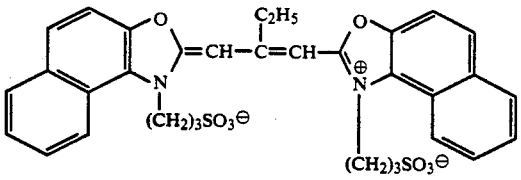
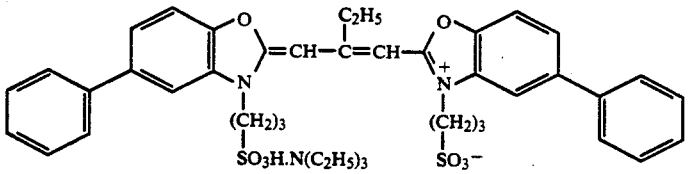
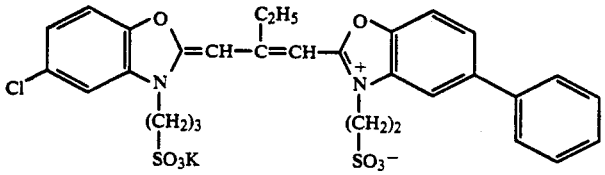

-continued
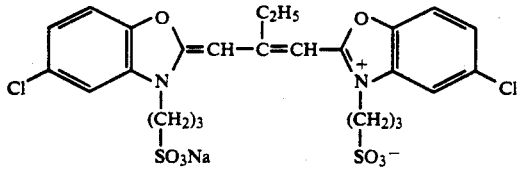
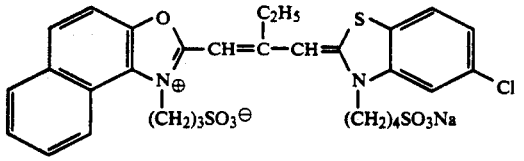
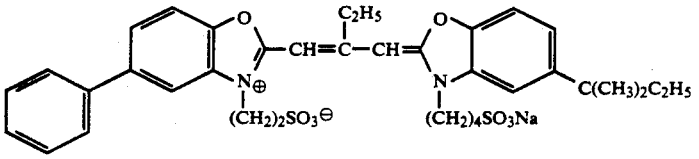
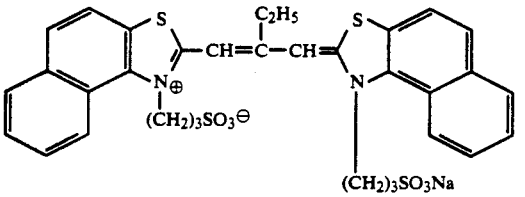
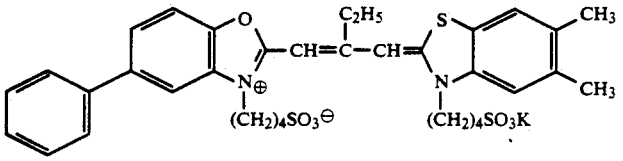
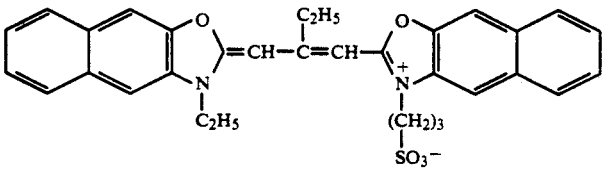
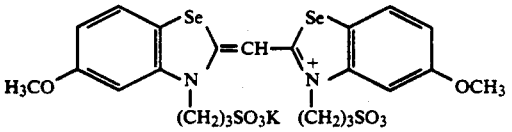
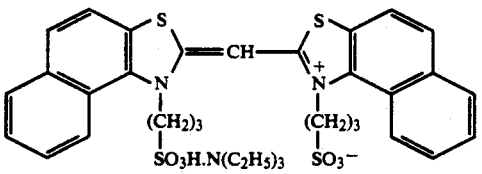
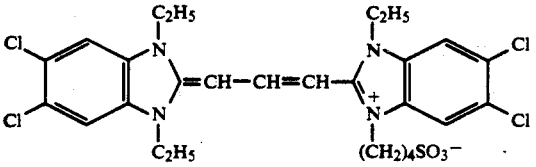

-continued

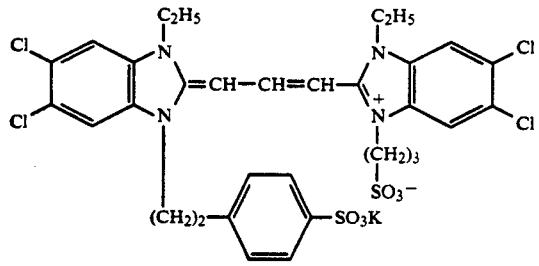

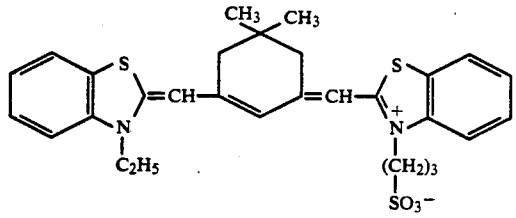

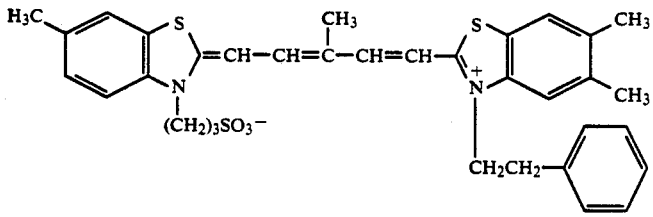

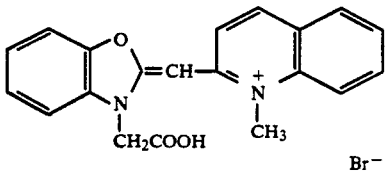

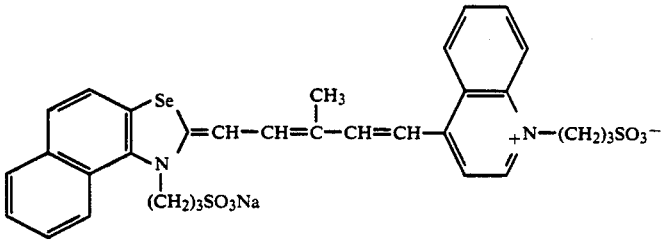

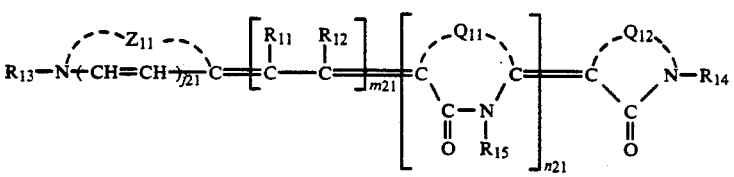

(II')

In the formula, $Z_{11}$ denotes a nitrogen-containing group to form a 5- or 6-membered heterocyclic ring. For example, thiazoline, thiazole, benzothiazole, naphthothiazole, selenazoline, selenazole, benzoselenazole, naphthoselenazole, oxazole, benzoxazole, naphthoxazole, benzimidazole, naphthoimidazole, pyridine, quinoline, pyrrolidine, indolylenine, imidazo[4,5-b]quinoxalinetetrazole, etc., used in the usual cyanine-forming heterocyclic nucleus; these heterocyclic nuclei may be substituted. As examples of substituents are mentioned a lower alkyl group (preferably with a number of carbon atoms 10 or below; may be further substituted with a hydroxy group, a halogen atom, a phenyl group, a substituted phenyl group, a carboxy group, an alkoxycarbonyl group, an alkoxy group, etc.), a lower alkoxy group (preferably 7 carbon atoms or below), an acylamino group (preferably 8 carbon atoms or below), a monocyclic aryl group, a monocyclic aryloxy group, a carboxy group, a lower alkoxycarbonyl group (preferably 7 carbon atoms or below), a hydroxy group, a cyano group, or a halogen atom.

$Q_{11}$ denotes a nitrogen-containing group to form a 5- or 6-membered ketomethylene ring. For example, atom groups which form thiazolidin-4-one, selenazolidine-4-oxazolidin-4-one, imidazolidin-4-one, etc.

$Q_{12}$ denotes a nitrogen-containing group to form a 5- or 6-membered ketomethylene ring. For example, rhodanine, 2-thiohydantoin, 2-selenathiohydantoin, 2-thiaoxazolidine-2,4-dione, 2-selenoxazolidine-2,4-dione, 2-thieselenazolidine-2,4-dione, 2-selenathiazolidin-2,4-dione, 2-selenaselenazolidin-2,4-thione, and other such atomic groups forming the heterocyclic nucleus and able to form a usual merocyanine dye.

In the heterocyclic groups denoted by the above-mentioned $Z_{11}$, $Q_{11}$ and $Q_{12}$, in the case of a heterocyclic group containing 2 or more nitrogen atoms or such as benzimidazole or thiohydantoin, $R_{13}$, $R_{14}$, $R_{15}$ may be substituted on a nitrogen atom with no other links; as substituent groups, an oxygen atom, a sulfur atom or a nitrogen atom may also be substituted for a carbon atom of an alkyl chain, and may possess further substituent groups, an alkyl group of up to 8 carbon atoms, likewise an alkenyl group, or a monocyclic aryl group which may be substituted, etc.

$R_{11}$ denotes a hydrogen atom or an alkyl group with up to 4 carbon atoms; $R_{12}$ denotes a hydrogen atom, a phenyl group, which may be substituted (as examples of substituents are mentioned an alkyl group or an alkenyl group of up to 4 carbon atoms, or a halogen atom, a carboxy group, a hydroxy group, etc.), or an alkyl group, which may be substituted with a hydroxy group, a carboxy group, an alkoxy group, a halogen atom, etc. When $m_{21}$ denotes 2 or 3, the different $R_{11}$ and $R_{12}$ may be linked to form a 5- or 6-membered ring which may contain an oxygen atom, a sulfur atom or a nitrogen atom.

$R_{13}$ denotes an alkyl group with up to 10 carbon atoms or an alkenyl group, with up to 10 carbon atoms, may be substituted, and may contain an oxygen atom, a sulfur atom or a nitrogen atom within the carbon chain. Examples of the substituent groups are a sulfo group, a carboxy group, a hydroxy group, a halogen atom, an alkoxycarbonyl group, a carbamoyl group, a phenyl group, a substituted phenyl group, or a monocyclic saturated heterocyclic group.

$R_{14}$ and $R_{15}$ denote a hydrogen atom, an alkyl group with up to 10 carbon atoms, an alkenyl group with up to 10 carbon atoms, or a monocyclic aryl group, which may be substituted (examples of the substituents are a sulfo group, a carboxy group, a hydroxy group, a halogen atom, or an alkyl, acylamino, or alkoxy group with up to 5 carbon atoms).

$m_{21}$ denotes 0 or a positive integer up to 3, $j_{21}$ denotes 0 or 1, and $n_{21}$ denotes 0 or 1.

When $m_{21}$ denotes a positive integer up to 3, $R_{11}$ and $R_{13}$ may be linked to form a 5- or 6-membered ring.

It is preferable that at least one of $R_{13}$, $R_{14}$ and $R_{15}$ be a group containing a sulfo group or a carboxy group. In a sensitizing dye contained in general formula (II'), the following compounds are particularly preferred.

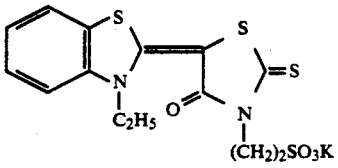

-continued

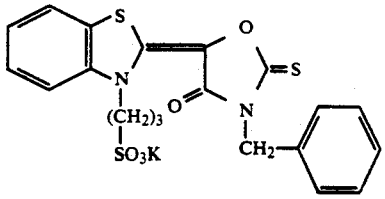

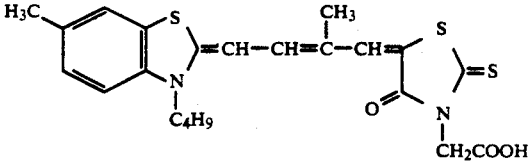

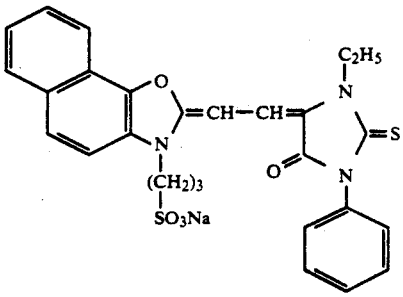

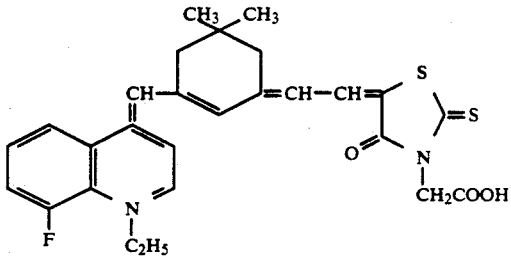

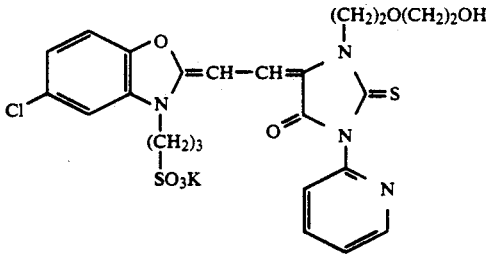

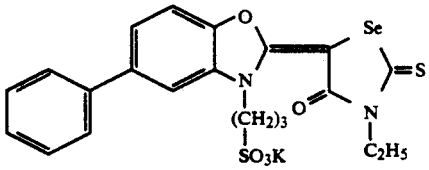

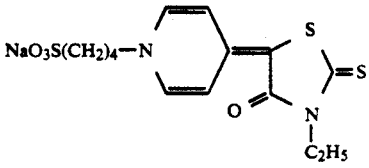

-continued

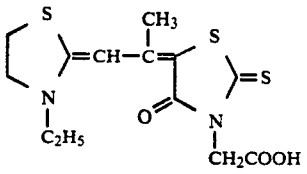

In the present invention, it is particularly preferred to perform strong sensitization by means of the compounds denoted by general formula (III') below as described in JP-A-60-122759.

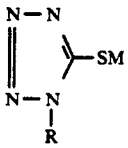

(III')

wherein R denotes an aliphatic group, an aromatic group, or a heterocyclic group substituted with at least one —COOM or —$SO_3M$; M denotes a hydrogen atom, an alkali metal atom, quaternary ammonium or quaternary phosphonium.

Preferred examples of the compounds denoted by general formula (III') and used in the present invention are shown below. (Although there is no limitation to these alone.)

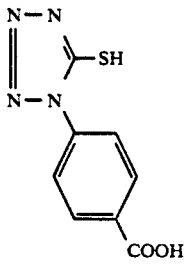

(1)

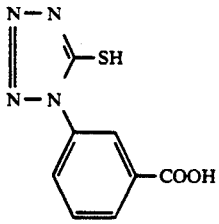

(2)

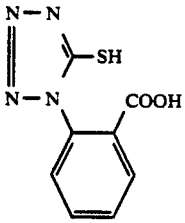

(3)

-continued

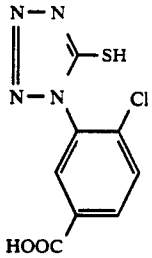

(4)

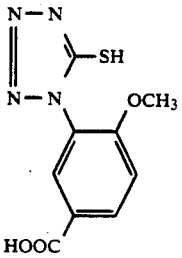

(5)

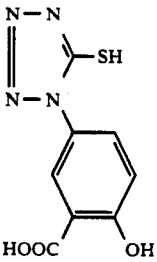

(6)

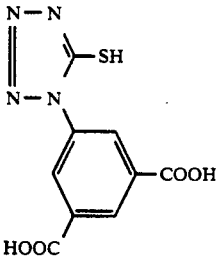

(7)

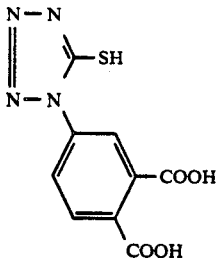

(8)

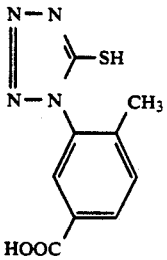

(9)

-continued (10)

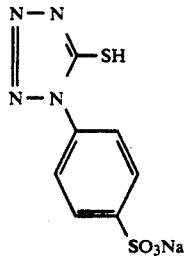

(11)

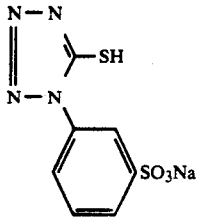

(12)

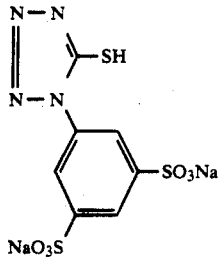

(13)

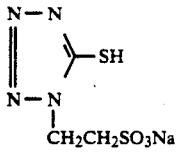

(14)

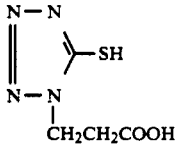

(15)

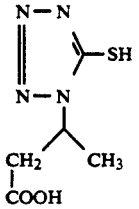

(16)

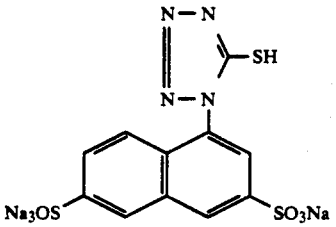

-continued (17)

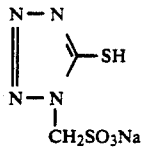

(18)

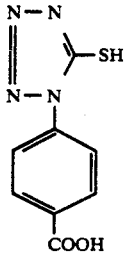

(19)

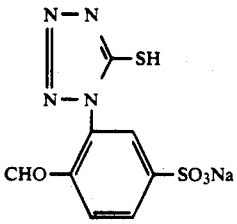

(20)

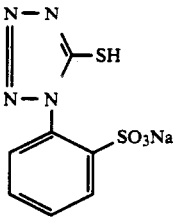

(21)

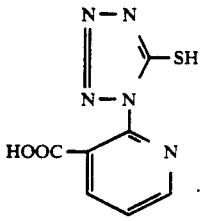

As regards the method of formation of compounds denoted by general formula (I'), they can generally be easily prepared, as is well known, using the reaction of an isothiocyanate and sodium azide. Literature and patent references are given below for these synthetic methods.

U.S. Pat. No. 3,266,897, JP-B-42-21842, JP-A-56-111846, British Patent 1,275,701; B. A. Berges et al., *Journal of Heterocyclic Chemistry*, Vol. 15, page 981 (1978); R. G. Dubenko, V. D. Pachenko et al., *Khimiia Geterotsiklicheskikh Soedinii*, First Edition, (Azole oaer Jhaschie Geterotsikly, 1967, pp. 199-201).

The method of addition of these compounds to the emulsion may follow the usual methods of addition of additives to photographic emulsions. For example, they may be dissolved in methyl alcohol, ethyl alcohol, methyl cellosolve, acetate, water, or mixtures of these solvents, and the solution can be added.

Furthermore, the compounds shown in general formula (IV') can be used in any process of manufacturing photographic emulsions, and can be used at any stage up to directly before coating after manufacture. As examples of the above are the process of formation of the silver halide grains, the process of physical ripening, the process of chemical ripening, etc.

In dispersing the above-mentioned sensitizing dyes in the silver halide emulsion, they may be caused to disperse directly in the emulsion; they may be added to the emulsion as a solution in water, methanol, ethanol, acetone, methyl cellosolve, fluoroalcohols, and the like solvents, either alone or as mixed solvents. In the case of addition into the silver halide emulsion, addition may be in the process of formation of the silver halide grains, or addition may be to the already-manufactured silver halide grains. In the case of addition in the process of formation of the silver halide grains, addition can be made in the process of reaction of the silver and halogen, in the physical ripening process, directly before the chemical ripening (post-ripening) process, during the chemical ripening process, or directly after the chemical ripening process, but addition before the chemical ripening (post-ripening) process is preferred, and addition directly before the chemical ripening (post-ripening) process is particularly preferred.

Further, after these have been dissolved singly or in substantially water-immiscible solvents such as phenoxyethanol, they may be dispersed in water or hydrophilic colloids, directly or using surfactants, and this dispersion may be added to the emulsion.

In the present invention, the spectral sensitivity distribution $S_B(\lambda)$ of the blue-sensitive silver halide emulsion layer is:

(a) $\lambda_B^{max}$, the maximum wavelength of $S_B(\lambda)$ is $$406\ \text{nm} \leqq \lambda_B^{max} \leqq 475\ \text{nm}$$

(b) When $S_B(\lambda)$ is 80% of $S_B(\lambda^{max}{}_B)$ the wavelength $\lambda^{80}{}_B$ is $$395\ \text{nm} \leqq \lambda^{80}{}_B \leqq 485\ \text{nm}$$

(c) When $S_B(\lambda)$ is 60% of $S_B(\lambda^{max}{}_B)$ the wavelength $\lambda^{60}{}_B$ is $$392\ \text{nm} \leqq \lambda^{60}{}_B \leqq 440\ \text{nm}$$

$$451\ \text{nm} \leqq \lambda^{60}{}_B \leqq 495\ \text{nm}$$

(d) When $S_B(\lambda)$ is 40% of $S_B(\lambda^{max}{}_B)$ the wavelength $\lambda^{40}{}_B$ is $$388\ \text{nm} \leqq \lambda^{40}{}_B \leqq 435\ \text{nm}$$

$$466\ \text{nm} \leqq \lambda^{40}{}_B \leqq 500\ \text{nm};$$

the spectral sensitivity distribution of the above green-sensitive silver halide emulsion layer is:

(a) $\lambda_G^{max}$, the maximum wavelength of $S_G(\lambda)$ is $$527\ \text{nm} \leqq \lambda^{max}{}_G \leqq 580\ \text{nm}$$

(b) When $S_G(\lambda)$ is 80% of $S_G(\lambda^{max}{}_G)$ the wavelength $\lambda^{80}{}_G$ is $$515\ \text{nm} \leqq \lambda^{80}{}_G \leqq 545\ \text{nm}$$

$$551\ \text{nm} \leqq \lambda^{80}{}_G \leqq 590\ \text{nm}$$

(c) When $S_G(\lambda)$ is 40% of $S_G(\lambda^{max}{}_G)$ the wavelength $\lambda^{40}{}_G$ is $$488\ \text{nm} \leqq \lambda^{40}{}_G \leqq 532\ \text{nm}$$

$$568\ \text{nm} \leqq \lambda^{40}{}_G \leqq 605\ \text{nm};$$

the spectral sensitivity distribution of the above red-sensitive silver halide emulsion layer is:

(a) $\lambda_R^{max}$, the maximum wavelength of $S_R(\lambda)$ is $$594\ \text{nm} \leqq \lambda^{max}{}_R \leqq 639\ \text{nm}$$

(b) When $S_R(\lambda)$ is 80% of $S_R(\lambda^{max}{}_R)$ the wavelength $\lambda^{80}{}_R$ is $$572\ \text{nm} \leqq \lambda^{80}{}_R \leqq 608\ \text{nm}$$

$$614\ \text{nm} \leqq \lambda^{80}{}_R \leqq 645\ \text{nm}$$

(c) When $S_R(\lambda)$ is 40% of $S_R(\lambda^{max}{}_R)$ the wavelength $\lambda^{40}{}_R$ is $$498\ \text{nm} \leqq \lambda^{40}{}_R \leqq 592\ \text{nm}$$

$$628\ \text{nm} \leqq \lambda^{40}{}_R \leqq 668\ \text{nm},$$

are particularly preferred.

The silver halide grains used in the present invention preferably contain sulfur-containing silver halide solvents. The sulfur-containing silver halide solvents used in the present invention may be added in any process from emulsion grain formation to coating. The amount added of the sulfur-containing silver halide solvents used in the present invention is $5.0\times10^{-4}$ mol to $5.0\times10^{-2}$ mol per mol of silver when the grain size of the silver halide grains is 0.5 μm, $2.5\times10^{-4}$ mol to $2.5\times10^{-2}$ mol per mol of silver when the grain size is 1.0 μm, and $1.25\times10^{-4}$ mol to $1.25\times10^{-3}$ mol per mol of silver when the grain size is 2.0 μm.

The sulfur-containing silver halide solvents of the present invention are silver halide solvents which can coordinate to silver ions by the sulfur atom.

More concretely, the silver halide solvents are substances which are able to dissolve an amount more than twice the amount of silver salt which can be dissolved by a 0.02 mol concentration of silver halide solvent in water or a mixed solvent of water/organic solvent (e.g., water/methanol=1/1) at 60° C.

Concretely, thiocyanates (potassium thiocyanate, ammonium thiocyanate, etc.), organic thioether compounds (e.g., compounds described in U.S. Pat. Nos. 3,574,628, 3,021,215, 3,057,724, 3,038,805, 4,276,374, 4,297,439, 3,704,130, JP-A-57-104926, etc.), thione compounds (e.g., the 4-substituted thioureas described in JP-A-53-82408 and 55-77737, U.S. Pat. No. 4,221,863, etc., or compounds described in JP-A-53-144319), or the mercapto compounds which can promote the growth of silver halide grains, as described in JP-A-57-202531, may be mentioned, and thiocyanates and organic thioether compounds are particularly preferable.

More concretely, as the organic thioether, the compounds denoted by general formula (IV') are preferable.

$$R_{16}\text{-}(S\text{-}R_{18})_m\text{-}S\text{-}R_{17} \qquad \text{(IV')}$$

wherein m denotes 0 or an integer of 1 to 4.

$R_{16}$ and R17 may be the same or different, and denote lower alkyl groups (number of carbon atoms 1 to 5) or substituted alkyl groups (total number of carbon atoms 1 to 30).

Here as the substituent groups there can be mentioned, for example, —OH, —COOM, —$SO_3M$, —$NHR_{19}$, —$NR_{19}R_{19}$ (wherein $R_{19}$ may be the same or different), —$OR_{19}$, —$CONHR_{19}$, —$COOR_{19}$, a hetero ring, etc.

$R_{19}$ may be a hydrogen atom, a lower alkyl group or further, a substituted alkyl group substituted with the above substituent groups.

Furthermore, the substituent groups may be two or more substituents, and these may be the same or different.

$R_{18}$ denotes an alkylene group (preferably with 1 to 12 carbon atoms).

When m is 2 or more, the m $R_{18}$s may be the same or different.

Furthermore, within an alkylene chain, one or more —O—, —CONH—, —$SO_2NH$—, etc. groups may be introduced. In addition, the substituents mentioned in $R_{16}$, $R_{17}$ may be substituted.

Furthermore, $R_{16}$ and $R_{17}$ may be linked to form a cyclic thioether.

As thione compounds, compounds denoted by general formula (V') are preferable.

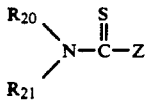

(V')

In the formula, Z denotes

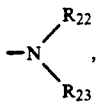

—$OR_{24}$ or —$SR_{25}$.

$R_{20}$, $R_{21}$, $R_{22}$, $R_{23}$, $R_{24}$ and $R_{25}$ may be the same or different, and denote alkyl groups, alkenyl groups, aralkyl groups, aryl groups or heterocyclic groups; these may be substituted (preferably, the total number of carbon atoms is 30 or less).

Furthermore, $R_{20}$ and $R_{21}$, $R_{22}$ and $R_{23}$, or $R_{20}$ and $R_{22}$, $R_{20}$ and $R_{24}$, $R_{20}$ and $R_{25}$ may be linked and form a 5- or 6-membered hetero ring; these may have substituent groups.

As mercapto compounds, the compounds denoted by general formula (VI') are preferable.

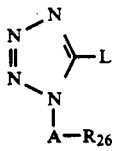

(VI')

In the formula, A denotes an alkylene group, $R_{26}$ denotes —$NH_2$, —$NHR_{27}$,

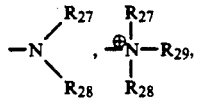

—$CONHR_{30}$, —$OR_{30}$, —COOM, —$COOR_{27}$, —$SO_2NHR_{30}$, —$NHCOR_{27}$ or $SO_3M$ (preferably the total number of carbon atoms is 30 or less); when $R_{26}$ is

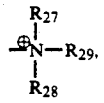

L denotes —S⊖, and when it is other than this, —SM.

Here, $R_{27}$, $R_{28}$ and $R_{29}$ respectively denote alkyl groups.

$R_{30}$ denotes a hydrogen atom or alkyl group.

M denotes a hydrogen atom or a positive ion (e.g., an alkali metal ion or an ammonium ion).

The synthesis of these compounds can be carried out by the methods in the above-mentioned patent specifications, literature, etc. Furthermore, some of the compounds are available commercially.

Examples of the sulfur-containing silver halide solvents used in the present invention are enumerated below.

KSCN — SSS-(1)

$NH_4SCN$ — SSS-(2)

$HO(CH_2)_2S(CH_2)_2OH$ — SSS-(3)

$HO(CH_2)_6S(CH_2)_5S(CH_2)_6OH$ — SSS-(4)

$HO(CH_2)_2—S—(CH_2)_2—S—(CH_2)_2—OH$ — SSS-(5)

$HO—(CH_2)_3—S—(CH_2)_2—S—(CH_2)_3—OH$ — SSS-(6)

$HO(CH_2)_6—S—(CH_2)_2—S—(CH_2)_6—OH$ — SSS-(7)

$HO(CH_2)_2S(CH_2)_2S(CH_2)_2S(CH_2)_2OH$ — SSS-(8)

$HO(CH_2)_2S(CH_2)_2O(CH_2)_2O(CH_2)_2S(CH_2)_2OH$ — SSS-(9)

$HOOCCH_2S(CH_2)_2SCH_2COOH$ — SSS-(10)

$H_2NCO(CH_2)_2S(CH_2)_2S(CH_2)_2CONH_2$ — SSS-(11)

$NaO_3S(CH_2)_3S(CH_2)_2S(CH_2)_3SO_3Na$ — SSS-(12)

$HO(CH_2)_2S(CH_2)_2CONHCH_2NHCO(CH_2)_2S(CH_2)_2OH$ — SSS-(13)

SSS-(14)

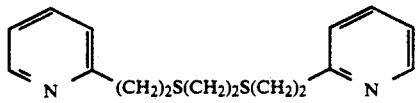

$HOCH_2CH(OH)CH_2S(CH_2)_2SCH_2CH(OH)CH_2OH$ — SSS-(15)

$HOCH_2CH(OH)CH_2S(CH_2)_2S(CH_2)_2SCH_2CH(OH)CH_2OH$ — SSS-(16)

$HOOCCH(NH_2)CH_2S(CH_2)_2SCH_2CH(NH_2)COOH$ — SSS-(17)

SSS-(18)

$HOCH_2CH(OH)CH_2S(CH_2)_2CONHCH_2NHCO(CH_2)_2SCH_2CH(OH)CH_2OH$

SSS-(19)

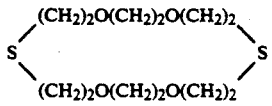

SSS-(20)

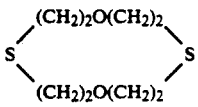

-continued
$CH_3SCH_2CH(NH_2)COOH$ SSS-(21)
$C_2H_5S(CH_2)_2S(CH_2)_2NHCO(CH_2)_2COOH$ SSS-(22)
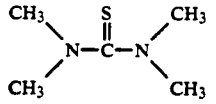
SSS-(23)
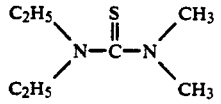
SSS-(24)
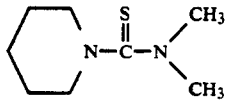
SSS-(25)
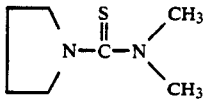
SSS-(26)
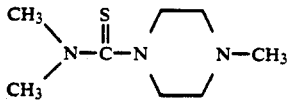
SSS-(27)
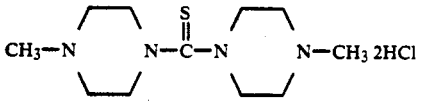
SSS-(28)
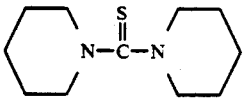
SSS-(29)
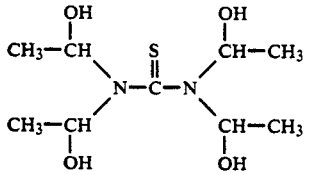
SSS-(30)
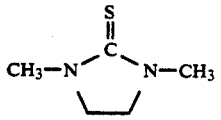
SSS-(31)
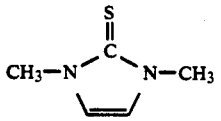
SSS-(32)
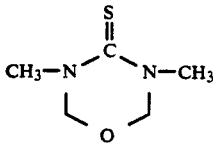
SSS-(33)
-continued
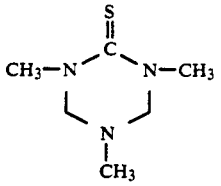
SSS-(34)
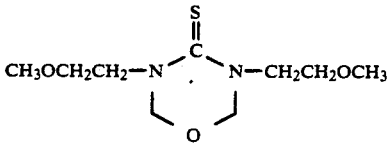
SSS-(35)
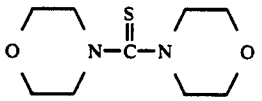
SSS-(36)
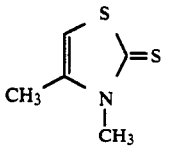
SSS-(37)
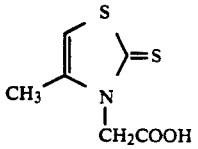
SSS-(38)
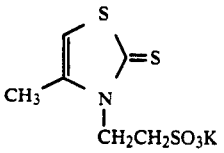
SSS-(39)
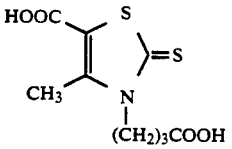
SSS-(40)
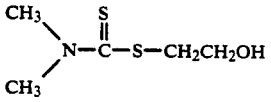
SSS-(41)
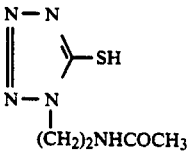
SSS-(42)
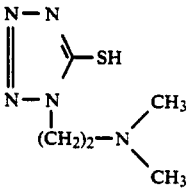
SSS-(43)

-continued

SSS-(44)

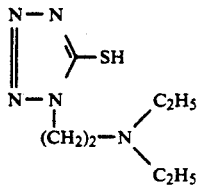

SSS-(45)

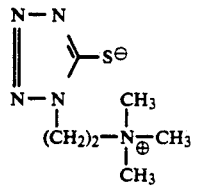

SSS-(46)

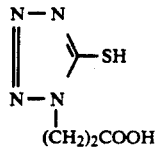

In the photographic emulsions used in the present invention, with the object of preventing fog during the processes of manufacture, storage or photographic processing of the photosensitive materials, various compounds may be included. Namely, many compounds known as fog preventing agents or stabilizing agents such as: azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; thioketo compounds such as oxazolinethione; azaindenes, e.g., triazaindene, tetraazaindenes (particularly 4-hydroxy substituted (1,3,3a,7)tetraazaindenes), and pentaazaindenes; benzenethiosulfonic acid, benzenesulfinic acid, benzenesulfonic acid amides, etc., can be added. For example, those described in U.S. Pat. Nos. 3,954,474 and 3,982,947, and in JP-B-52-28660 can be used.

The photographic emulsion layer of the photographic materials of the present invention, in order to increase sensitivity, to increase contrast, or to promote development, may contain, for example, polyalkylene oxides or their ether, ester, amine and such like derivatives, thioether compounds, thiomorpholine compounds, quaternary ammonium salt compounds, urethane derivatives, urea derivatives, imidazole derivatives, 3-pyrazolidones, etc. For example, those described in U.S. Pat. Nos. 2,400,532, 2,423,549, 2,716,062, 3,617,280, 3,772,021, 3,808,003, and British Patent 1,488,991, may be used.

The prepared photosensitive materials used in the present invention may contain, in the hydrophilic colloid layer, water-soluble dye as the filter dyes of the hydrophilic colloid layer for irradiation prevention or various other objects. In such dyes are included oxonol dyes, hemioxonol dyes, styryl dyes, merocyanine dyes, cyanine dyes, and azo dyes. Among others, oxonol dyes, hemioxonol dyes and merocyanine dyes are utilized.

The prepared photosensitive materials used in the present invention may contain, in a hydrophilic colloid layer apart from the photographic emulsion layer, stilbene-based, triazine-based, oxazole-based, or coumarin-based, and other such whitening agents. These may be water-soluble, or may be used as a dispersion of water-insoluble whitening agents.

When putting the present invention into practice, the known anti-color-fading agents mentioned below can also be used in combination, or the color image stabilizers used in the present invention can be used singly or in a combination of two or more. Known anti-fading agents are, for example, the hydroquinone derivatives described in U.S. Pat. Nos. 2,360,290, 2,418613, 2,675,314, 2,701,197, 2,704,713, 2,728,659, 2,732,300, 2,735,765, 2,710,801, 2,816,028, British Patent 1,363,921, etc., the gallic acid derivatives described in U.S. Pat. Nos. 3,457,079 and 3,069,262, the p-alkoxyphenols described in U.S. Pat. Nos. 2,735,765 and 3,698,909, and JP-B-49-20977 and 52-6623, the p-oxyphenyl derivatives described in U.S. Pat. Nos. 3,432,300, 3,573050, 3,574,627, 3,764,337, JP-A-52-35633, 52-147434, 52-152225, and the bisphenols described in U.S. Pat. No. 3,700,455.

The prepared light-sensitive materials used in the present invention may contain, as color fog preventing agents, hydroquinone derivatives, aminophenol derivatives, gallic acid derivatives, ascorbic acid derivatives, etc.

As the photographic light-sensitive materials of the present invention, any black-and-white photosensitive materials, multilayer multicolor photosensitive materials are also mentioned, and in particular, color light-sensitive materials used as high sensitivity photographic materials are preferably used.

Multilayer natural color photographic materials usually possess at least one of a red-sensitive emulsion layer, a green-sensitive emulsion layer and a blue-sensitive emulsion layer, on a support. The sequence of these layers is optionally chosen as required. It is usual for the red-sensitive emulsion layer to contain a cyan-forming coupler, the green-sensitive emulsion to contain a magenta-forming coupler, and the blue-sensitive emulsion to contain a yellow-forming coupler, respectively, but according to circumstances a different combination can also be taken.

The well known open-chain ketomethylene based-couplers can be used as the yellow color forming coupler. Among these, the benzoylacetanilide-based and pivaloylacetanilide-based compounds are utilized. Concrete examples of yellow color-forming couplers which can be used are those described in, for example, U.S. Pat. Nos. 2,875,057, 3,265,506, 3,408,194, 3,551,155, 3,582,322, 3,725,072, 3,891,445, West German Patent 1,547,868, DE-A-2,219,917, 2,261,361, 2,414,006, British Patent 1,425,020, JP-A-51-10783, JP-B-47-26133, 48-73147, 51-102636, 50-6341, 50-123342, 50-130442, 51-21827, 50-87650, 52-82424, 52-115219.

As magenta color couplers, there are utilized pyrazolone-based compounds, indazolone-based compounds, cyanoacetyl compounds, etc., and pyrazolone based compounds are particularly beneficial. Concrete examples of magenta color-forming couplers which can be used are those described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Patent 1,810,464, DE-A-2,408,665, 2,417,945, 2,418,959, 2,424,467, JP-B-40-6031, JP-A-51-20826, 52-58922, 49-129538, 49-74027, 50-159332, 52-42121, 49-74028, 50-60233, 51-26541, 53-55122.

As cyan color couplers there can be utilized phenol-based compounds, naphthol based compounds, etc. Concrete examples of these are those mentioned in, for example, U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, and 4,004,929, DE-A-2,414,830 and 2,454,329, JP-A-48-59838, 51-26034, 48-5055, 51-146828, 52-69624 and 52-90932.

As cyan color couplers there can preferably be used the couplers possessing a ureido group described in, for example, JP-A-57-204545, 56-65134, 58-33252, 58-33249.

The couplers may be either 4-equivalent or 2-equivalent to silver ions, but because the content of silver in the photosensitive materials is small, use of the 2-equivalent couplers, which have a higher silver utilization efficiency, is preferable. From the point of view of photographic performance, the more efficient use of the oxidized form of the developer using a 2-equivalent coupler is particularly advantageous in a silver halide emulsion with a silver iodide content of 7 mol% or above.

The following general formulae (Cp-L-1) to (Cp-L-9) represents 2-equivalent couplers which can be used in the present invention.

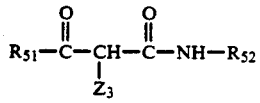
(CpL-1)

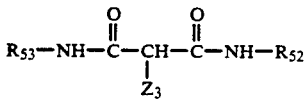
(CpL-2)

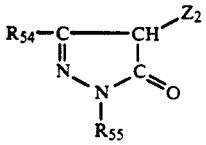
(CpL-3)

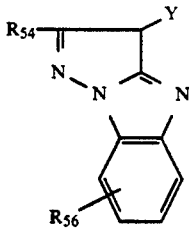
(CpL-4)

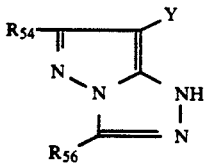
(CpL-5)

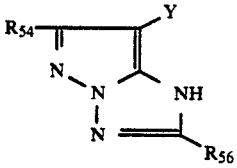
(CpL-6)

-continued

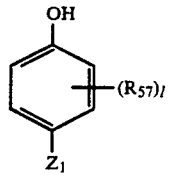
(CpL-7)

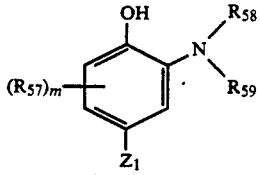
(CpL-8)

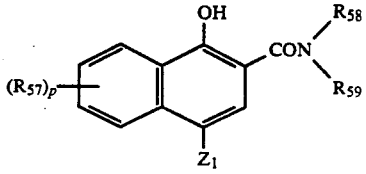
(CpL-9)

$R_{51}$ to $R_{59}$, l, m and p of the above general formulae (CpL-1) to (CpL-9) will next be explained.

In the formulae, $R_{51}$ is an aliphatic group, an aromatic group, an alkoxy group or a heterocyclic group; $R_{52}$ and $R_{53}$ respectively denote aromatic groups or polycyclic groups.

In the formulae, the aliphatic groups denoted by $R_{51}$ have 1 to 22 carbon atoms and are substituted or unsubstituted, chains or rings. The preferred substituents of alkyl groups are an alkoxy group, an aryloxy group, an amino group, an acylamino group, a halogen atom, etc., and these may themselves possess substituent groups. Concrete examples of aliphatic groups useful as $R_{51}$ are as follows: an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, and an α-(benzenesulfonamido)isopropyl group.

In the case in which $R_{51}$, $R_{52}$ or $R_{53}$ denotes an aromatic group (e.g., a phenyl group), the aromatic group may be substituted. A phenyl group or the like aromatic group may be substituted with an alkyl group, an alkenyl group, an alkoxy group, an alkoxycarbonyl group, an alkoxycarbonamido group, an aliphatic amido group, an alkylsulfamoyl group, an alkylsulfonamido group, an alkylureido group, an alkyl-substituted succinimido group, and the like substituents having 32 or fewer carbon atoms; in this case, the alkyl group chain may have a phenyl or such like aromatic group interposed in the chain. The phenyl group may also be substituted by an aryloxy group, an aryloxycarbonyl group, an arylcarbamoyl group, an arylamido group, an arylsulfamoyl group, an arylsulfonamido group, an arylureido group, etc.; the aryl group part of these substituent groups may further be substituted with one or more alkyl groups having a total of 1 to 22 carbon atoms.

A phenyl group denoted by $R_{51}$, $R_{52}$ or $R_{53}$ may furthermore be substituted with a lower alkyl group having 1 to 6 carbon atoms, which can also be substituted with an amino group, a hydroxy group, a carboxy group, a sulfo group, a nitro group, a cyano group, a thiocyano group, or a halogen atom.

Furthermore, $R_{51}$, $R_{52}$ or $R_{53}$ may also denote a phenyl group with another ring fused substituent group, for example, a naphthyl group, a quinoline group, an isoquinoline group, a chromanyl group, a coumaranyl group, a tetrahydronaphthyl group, etc. These substituent groups may themselves possess substituent groups.

In the case in which $R_{51}$ denotes an alkoxy group, its alkyl moiety may be a 1 to 32 carbon atom, preferably 1 to 22, straight chain or branched chain alkyl group, alkenyl group, cycloalkyl group or cycloalkenyl group; these may also be substituted with a halogen atom, an aryl group, an alkoxy group, etc.

In the case in which $R_{51}$, $R_{52}$ or $R_{53}$ denotes a heterocyclic group, the respective heterocyclic group is bonded via one of the carbon atoms forming the ring to a carbon atom of the carbonyl group of the acyl group, or to the nitrogen atom of the amido group, in α-acylacetamido. Examples of this kind of heterocyclic are thiophene, furan, pyran, pyrrole, pyrazole, pyridine, pyrazine, pyrimidine, pyridazine, indolidine, imidazole, thiazole, oxazole, triazine, thiadiazine, and oxazine. These may possess further substituents on the ring.

In general formula (CpL-3), $R_{55}$ denotes a 1 to 32 carbon atom, preferably 1 to 22, straight chain or branched chain alkyl group (e.g., methyl, isopropyl, tert-butyl, hexyl, dodecyl), alkenyl group (e.g., allyl), cycloalkyl group (e.g., cyclopentyl, cyclohexyl, norbornyl), aralkyl group (e.g., benzyl, β-phenylethyl), cycloalkenyl group (e.g., cyclopentenyl, cyclohexenyl); these may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group, a mercapto group, etc.

Furthermore, $R_{55}$ may denote an aryl group (e.g., phenyl, α- or β-naphthyl). The aryl group may possess 1 or more substituent groups; as a substituent group, for example, it may possess an alkyl group, an alkenyl group, a cycloalkyl group, an aralkyl group, a cycloalkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, and a hydroxyl group.

Furthermore, $R_{55}$ may denote a heterocyclic group (for example, 5-membered or 6-membered heterocyclic or condensed heterocyclic with a nitrogen atom, an oxygen atom or a sulfur atom as the hetero atom, pyridyl, quinoline, furyl, benzothiazolyl oxazolyl, imidazolyl, and naphthoxazolyl), and may denote a heterocyclic group substituted by the substituent groups enumerated for the above-mentioned aryl groups, an aliphatic or aromatic acyl group, an alkylsulfonyl group, an arylsulfonyl group, an alkylcarbamoyl group, an arylcarbamoyl group, an alkylthiocarbamoyl group, or an arylthiocarbamoyl group.

Furthermore, $R_{54}$ may denote any of a 1 to 32 carbon atom, preferably 1 to 22 carbon atoms, straight chain or branched chain alkyl, alkenyl, cycloalkyl, aralkyl, or cycloalkenyl group (these groups may possess the substituent groups enumerated for the above-mentioned $R_{55}$), an aryl group and a heterocyclic group (these may possess the substituent groups enumerated for the above-mentioned $R_{55}$), an alkoxycarbonyl group (e.g., methoxycarbonyl, ethoxycarbonyl, stearyloxycarbonyl), an aryloxycarbonyl group (e.g., phenoxycarbonyl, naphthoxycarbonyl), an aralkyloxycarbonyl group (e.g., benzyloxycarbonyl), an alkoxy group (e.g., methoxy, ethoxy, heptadecyloxy), an aryloxy group (e.g., phenoxy, tolyloxy), an alkylthio group (e.g., ethylthio, dodecylthio), an arylthio group (e.g., phenylthio, α-naphthylthio), a carboxy group, an acylamino group (e.g., acetylamino, 3-[(2,4-di-tert-amylphenoxy)acetamido]benzamido), a diacylamino group, an N-alkylacylamino group (e.g., N-methylpropanamido), an N-arylacylamino group (e.g., N-phenylacetamido), a ureido group (e.g., ureido, N-arylureido, N-alkylureido), a urethane group, a thiourethane group, an arylamino group (e.g., phenylamino, N-methylanilino, diphenylamino, N-acetylanilino, 2-chloro-5-tetradecanamido-anilino), an alkylamino group (e.g., n-butylamino, methylamino, cyclohexylamino), a cycloamino group (e.g., piperidino, pyrrolidino), a heterocyclic amino group (e.g., 4-pyridylamino, 2-benzoxazolylamino), an alkylcarbonyl group (e.g., methylcarbonyl), an arylcarbonyl group (e.g., phenylcarbonyl), a sulfonamido group (e.g., alkylsulfonamido, arylsulfonamido), a carbamoyl group (e.g., ethylcarbamoyl, dimethylcarbamoyl, N-methylphenylcarbamoyl, N-phenylcarbamoyl), a sulfamoyl group (e.g., N-alkylsulfamoyl, N,N-dialkylsulfamoyl, N-arylsulfamoyl, N-alkyl-N-aryl-sulfamoyl, N,N-diarylsulfamoyl), a cyano group, a hydroxy group, and a sulfo group.

In the formula, $R_{56}$ denotes a hydrogen atom, or a 1 to 32, preferably 1 to 22, carbon atom straight chain or branched chain alkyl group, alkenyl group, cycloalkyl group, aralkyl group or cycloalkenyl group; these may possess substituents as enumerated for $R_{55}$.

Further, $R_{56}$ may denote an aryl group or a heterocyclic group; these may possess substituents as enumerated for $R_{55}$.

Further, $R_{56}$ may also denote a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, or a hydroxyl group.

$R_{57}$, $R_{58}$ and $R_{59}$ denote groups used in the usual 4-equivalent phenol or α-naphthol couplers; concretely, as $R_{57}$ may be mentioned a hydrogen atom, a halogen atom, an alkoxycarbonylamino group, an aliphatic hydrocarbon radical, an N-arylureido group, an acylamino group, —O—$R_{62}$ or —S—$R_{62}$ (wherein $R_{62}$ is an aliphatic hydrocarbon radical); in the case in which 2 or more $R_{57}$ exist in the molecule, 2 or more $R_{57}$ may be different, and include those aliphatic hydrocarbon radicals possessing substituents.

Further, in the case where these substituents possess aryl groups, the aryl group may possess substituents as enumerated for $R_{57}$.

Groups chosen from an aliphatic hydrocarbon radical, an aryl group and heterocyclic radicals may be given for $R_{58}$ and $R_{59}$, or one of them may be a hydrogen atom, and groups which have a substituent group are included amongst these groups. Further, $R_{58}$ and $R_{59}$ may interact to form a nitrogen-containing heterocyclic nucleus.

Also, included as the hydrocarbon radical may be any saturated or unsaturated one, furthermore, any straight chain one, branched chain one, or cyclic one. Also, it is preferably an alkyl group (e.g., methyl, ethyl, propyl, isopropyl, butyl, t-butyl, isobutyl, dodecyl, octadecyl, cyclobutyl, cyclohexyl) or an alkenyl group (e.g., aryl, octenyl). Representative of the aryl group are a phenyl group, a naphthyl group, etc. Representative of the heterocyclic group are a pyridyl group, a quinolyl group, a piperidyl group, an imidazolyl group, etc. As substituents introduced into these aliphatic hydrocarbon radicals, aryl groups and heterocyclic radicals, there may be mentioned a halogen atom, a nitro group, a hydroxy group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, a morpholino group, etc.

l denotes an integer 1 to 4, m an integer 1 to 3, p an integer 1 to 5.

Among the above-mentioned coupler radicals, as the yellow coupler radical, there are preferred, in general equation (CpL-1), the case where $R_{51}$ denotes a t-butyl group or a substituted or unsubstituted aryl group, $R_{52}$ denotes a substituted or unsubstituted aryl group, and the case in which, in general formula (CpL-2), $R_{52}$ and $R_{53}$ denote substituted or unsubstituted aryl groups.

As the magenta coupler radicals, there are preferred, in general formula (CpL-3), the case in which $R_{54}$ denotes an acylamino group, a ureido group and an arylamino group, $R_{55}$ denotes a substituted aryl group, the case in which, in general formula (CpL-4), $R_{54}$ denotes an acylamino group, a ureido group and an arylamino group, $R_{56}$ denotes a hydrogen atom, and also, in general formulae (CpL-5) and (CpL-6), $R_{54}$ and $R_{56}$ denote straight chain or branched chain alkyl groups, alkenyl groups, cycloalkyl groups, aralkyl groups, or cycloalkenyl groups.

As the cyan coupler radical there are preferred, in general formula (CpL-7), the case in which $R_{57}$ denotes a 2-position acylamino group or ureido group, a 5-position acylamino group or alkyl group, and a 6-position hydrogen atom or chlorine atom; and the case in which, in general formula (CpL-9), $R_{57}$ denotes a 5-position hydrogen atom, acylamino group, sulfonamido group, alkoxycarbonyl group, and $R_{58}$ is a hydrogen atom and $R_{59}$ is a phenyl group, an alkyl group, an alkenyl group, a cycloalkyl group, an aralkyl group, and a cyclic alkenyl group.

$Z_1$ denotes a halogen atom, a sulfo group, an acyloxy group, an alkoxy group, an aryloxy group, a heterocyclic oxy group, an alkylthio group, an arylthio group, or a heterocyclic thio group; these groups may be further substituted with substituents such as an aryl group (e.g., phenyl), a nitro group, a hydroxy group, a cyano group, a sulfo group, an alkoxy group (e.g., methoxy), an aryloxy group (e.g., phenoxy), an acyloxy group (e.g., acetoxy), an acylamino group (e.g., acetylamino), a sulfonamido group (e.g., methanesulfonamido), a sulfamoyl group (e.g., methylsulfamoyl), a halogen atom (e.g., fluorine, chlorine, bromine), a carboxy group, a carbamoyl group (e.g., methylcarbamoyl), an alkoxycarbonyl group (e.g., methoxycarbonyl), a sulfonyl group (e.g., methylsulfonyl), etc.

$Z_2$ and Y denote a leaving group bonded to the coupling position by an oxygen atom, a nitrogen atom or a sulfur atom; in the case in which $Z_2$ and Y are bonded to the coupling position by an oxygen atom, a nitrogen atom or a sulfur atom, these atoms are bonded with an alkyl group, an aryl group, an alkylsulfonyl group, an arylsulfonyl group, an alkylcarbonyl group, an arylcarbonyl group, or a heterocyclic group; furthermore, in the case of a nitrogen atom, a 5- or 6-membered ring containing that nitrogen atom and able to be eliminated is meant (e.g., an imidazolyl group, a pyrazolyl group, a triazolyl group, a tetrazolyl group).

The above alkyl group, aryl group, heterocyclic group may possess substituents; concretely, an alkyl group (e.g., methyl, ethyl), an alkoxy group (e.g., methoxy, ethoxy), an aryloxy group (e.g., phenoxy), an alkoxycarbonyl group (e.g., methoxycarbonyl), an acylamino group (e.g., acetylamino), a carbamoyl group, an alkylcarbamoyl group (e.g., methylcarbamoyl, ethylcarbamoyl), a dialkylcarbamoyl group (e.g., dimethylcarbamoyl), an arylcarbamoyl group (e.g., phenylcarbamoyl), an alkylsulfonyl group (e.g., methylsulfonyl), an arylsulfonyl group (e.g., phenylsulfonyl), an alkylsulfonamido group (e.g., methanesulfonamido), an arylsulfonamido group (e.g., phenylsulfonamido), a sulfamoyl group, an alkylsulfamoyl group (e.g., ethylsulfamoyl), a dialkylsulfamoyl group (e.g., dimethylsulfamoyl), an alkylthio group (e.g., methylthio), an arylthio group (e.g., phenylthio), a cyano group, a nitro group, a halogen atom (e.g., fluorine, chlorine, bromine), may be mentioned; when there are 2 or more of these substituents, they may be the same or different.

Particularly preferred substituent groups include a halogen atom, an alkyl group, an alkoxy group, an alkoxycarbonyl group, a cyano group.

As the preferred $Z_2$ group, a group bonded to the coupling position by a nitrogen atom or a sulfur atom may be mentioned; as the preferred Y group, a chlorine atom or a group bonded to the coupling position by an oxygen atom, a nitrogen atom or a sulfur atom.

$Z_3$ denotes a hydrogen atom or as denoted in the formulae (R-I), (R-II), (R-III) or (R-IV) mentioned below.

$$-\underset{\underset{OR_{63}}{|}}{} \qquad \text{(R-I)}$$

$R_{63}$ denotes an aryl group or a heterocyclic group, which may be substituted.

(R-II)

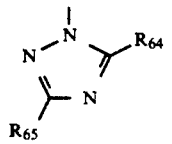

(R-III)

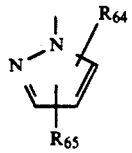

$R_{64}$, $R_{65}$ respectively denote a hydrogen atom, a halogen atom, a carbonic acid ester group, an amino group, an alkyl group, an alkylthio group, an alkoxy group, an alkylsulfonyl group, an alkylsulfinyl group, a carbonic acid group, a sulfonic acid group, an unsubstituted or substituted phenyl group or a heterocyclic group; these may be the same or different.

(R-IV)

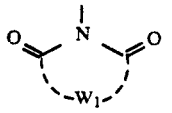

$W_1$ denotes a nonmetal atom required to form a 4-membered ring, a 5-membered ring or a 6-membered ring with the

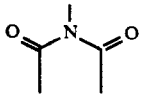

of the formula.

Within the scope of general formula (R-IV) are mentioned as preferable (R-V) to (R-VI).

(R-V)

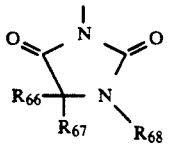

(R-VI)

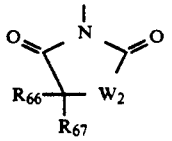

(R-VII)

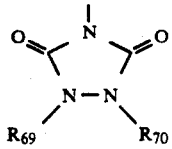

In the formulae, $R_{66}$, $R_{67}$ respectively denote a hydrogen atom, an alkyl group, an aryl group, an alkoxy group, an aryloxy group or a hydroxy group; $R_{68}$, $R_{69}$ and $R_{70}$ respectively denote a hydrogen atom, an alkyl group, an aryl group, an aralkyl group, or an acyl group; $W_2$ denotes an oxygen atom or a sulfur atom.

The coupler used in the present invention may be derived from the coupler monomer denoted by the following general formula (C-I), and may be a polymer possessing the repeating unit denoted by general formula (C-II) or a copolymer with one or more kinds of non-color-forming monomers containing at least one ethylene group and not having the ability to couple oxidatively with a primary aromatic amine developer. Two or more coupler monomers may be polymerized simultaneously.

(C-I)

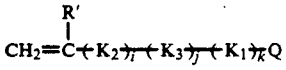

(C-II)

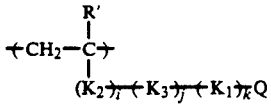

In the formulae, R′ denotes a hydrogen atom, a lower alkyl group with 1 to 4 carbon atoms, or a chlorine atom; $K_1$ denotes —CONR″—, —NR″CONR″—, —NR″COO—, —COO—, —$SO_2$—, cCO—, NR″CO—, $SO_2$NR″—, —NR″$SO_2$—, —OCO—, —OCONR″—, —NR″—, —S—or —O—; $K_2$ denotes —CONR″—or —COO—; R″ denotes a hydrogen atom, an aliphatic group or an aryl group, and in the case in which there are two or more R″ in one molecule, they may be the same or different.

$K_3$ denotes a 1 to 10 carbon atom, unsubstituted or substituted, alkylene group (e.g., methylene, methylmethylene, dimethylmethylehe, dimethylene, trimethylene, tetramethylene, pentamethylene, hexamethylene, decylmethylene), aralkylene group (e.g., benzylidene) or unsubstituted or substituted arylene group (e.g., phenylene, naphthylene), the alkylene group may be straight chain or branched chain.

There are mentioned here, as substituents of the alkylene group, aralkylene group or arylene group denoted by $K_3$,an aryl group (e.g., phenyl), a nitro group, a hydroxy group, a cyano group, a sulfo group, an alkoxy group (e.g., methoxy), an aryloxy group (e.g., phenoxy), an acyloxy group (e.g., acetoxy), an acylamino group (e.g., acetylamino), a sulfonamido group (e.g., methanesulfonamido), a sulfamoyl group (e.g., methylsulfamoyl), a halogen atom (e.g., fluorine, chlorine, bromine), a carboxyl group, a carbamoyl group (e.g., methylcarbamoyl), an alkoxycarbonyl group (e.g., methoxycarbonyl), a sulfonyl group (e.g., methylsulfonyl). When there are two or more of these substituents, they may be the same or different.

i, j and k denote 0 or 1.

Q is a coupler residual group which is any of the moieties $R_{51}$ to $R_{59}$, $Z_1$ to $Z_3$ or Y of the above-mentioned general formulae (CpL-1) to (ClL-9) and bonded to a moiety of general formula (C-I) or (C-II) other than Q.

As the non-color-forming ethylenic monomers which do not couple to the oxidation products of a primary aromatic amine developer, there are an acrylic acid, an α-chloroacrylic acid, an α-alkylacrylic acid (e.g., an acrylic acid, a methacrylic acid), and the acrylic acid esters or amides derived therefrom (e.g., acrylamide, methacrylamide, t-butylacrylamide, methyl acrylate, methyl methacrylate, ethyl acrylate, n-propyl acrylate, isopropyl acrylate, n-butyl acrylate, t-butyl acrylate, n-butyl methacrylate, 2-ethylhexyl acrylate, n-hexyl acrylate, n-octyl acrylate, lauryl acrylate, methylenebisacrylate), vinyl esters (e.g., vinyl acetate, vinyl propionate, vinyl laurate), acrylonitrile, methacrylonitrile, aromatic vinyl compounds (e.g., styrene and its derivatives, vinyltoluene, vinylbenzene, vinylacetophenone), vinylidene chloride, vinyl alkyl ethers (e.g., vinyl ethyl ether), maleic acid esters, N-vinyl-2-pyrrolidone, N-vinylpyridine, and 2- and 4-vinylpyridine, etc. In particular, acrylic acid esters, methacrylic acid esters and maleic acid esters are preferred.

Two or more kinds of the non-color-forming ethylenically unsaturated monomers can be utilized together. For example, n-butyl acrylate and vinylbenzene, styrene and methacrylic acid, n-butyl acrylate and methacrylic acid, etc., can be utilized.

The polymeric couplers used in this invention may be water-soluble or water-insoluble ones, but among them, polymer coupler latices are preferred in particular.

With regard to coupler polymer latices: after the hydrophilic polymeric coupler prepared by polymerization of the coupler monomer has once been isolated and again dissolved in organic solvent, it may be dispersed to form a latex; the solution of the hydrophilic polymeric coupler obtained by polymerization may be directly dispersed to form a latex; or the polymeric coupler latex may be prepared by emulsion polymerization methods or a layer structure polymer coupler latex may then be directly added to the gelatin-silver halide emulsion.

In the silver halide photographic materials of the present invention, among these 2-equivalent couplers, are preferably a 2-equivalent magenta coupler or a 2-equivalent cyan coupler, more preferably a 2-equivalent magenta coupler.

2-Equivalent Yellow Couplers

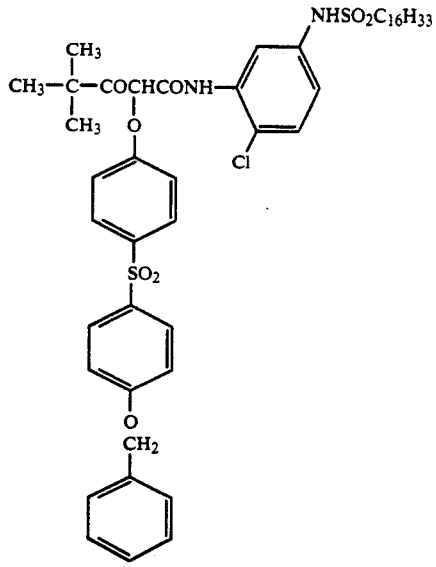

Y-1

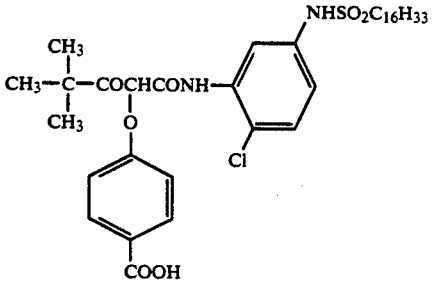

Y-2

-continued
Y-3
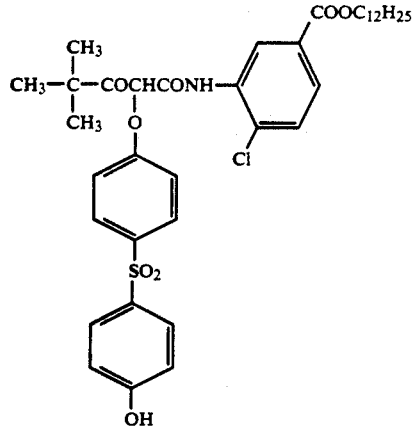
Y-4
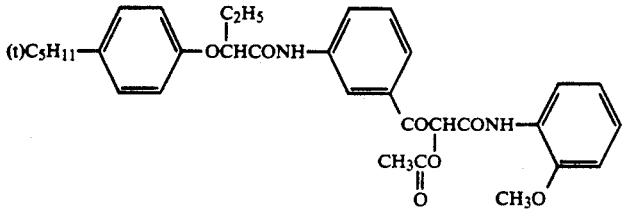
Y-5
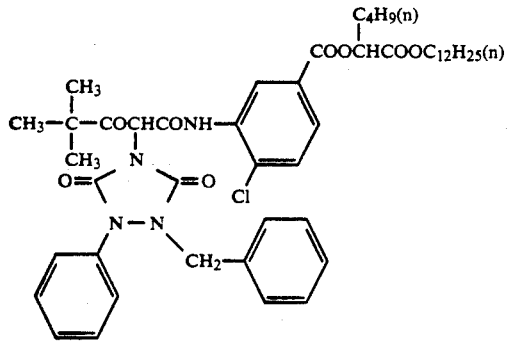
Y-6
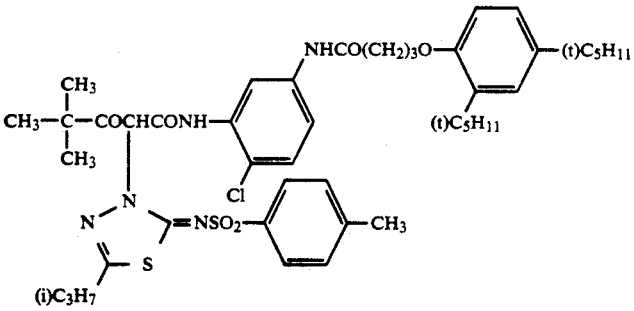
Y-7
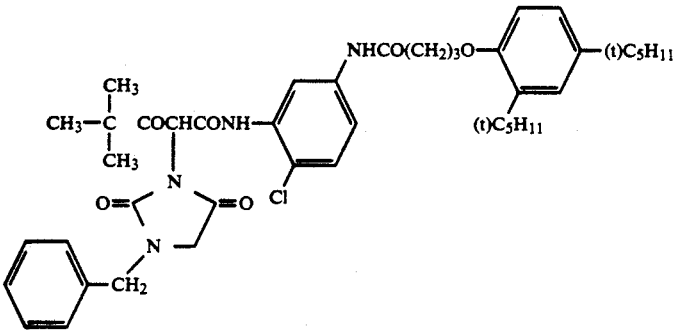

-continued
Y-8
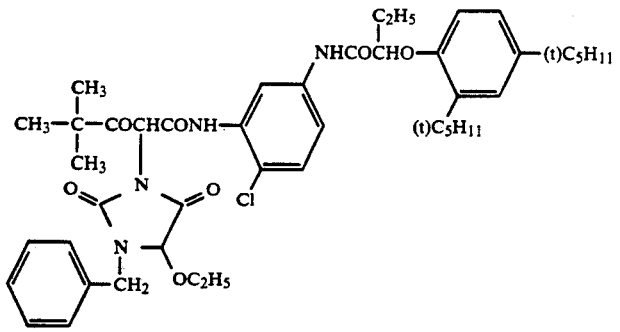
Y-9
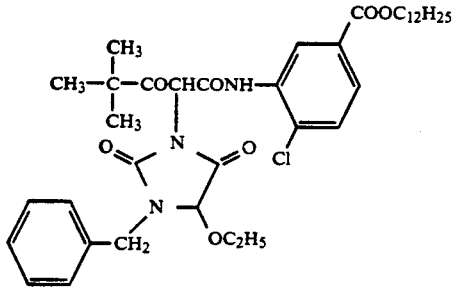
Y-10
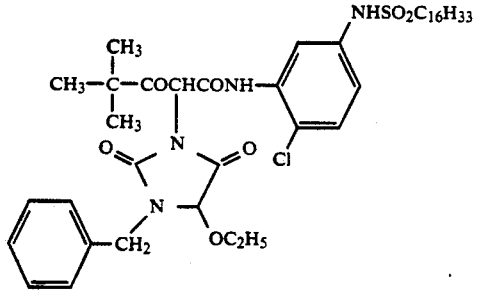
Y-11
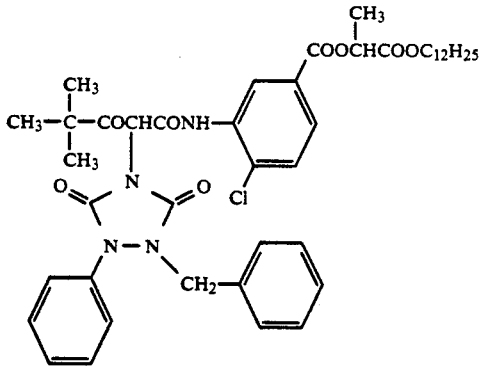
Y-12
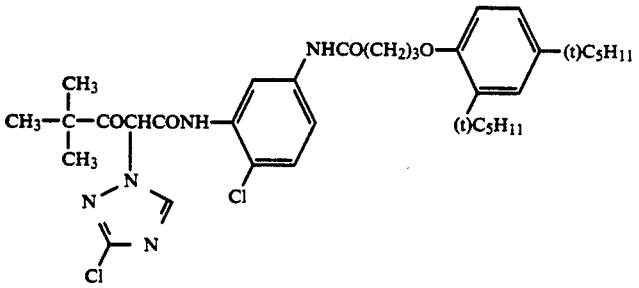

-continued
Y-13
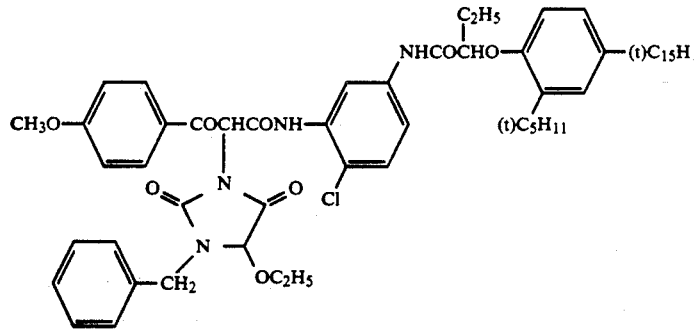
Y-14
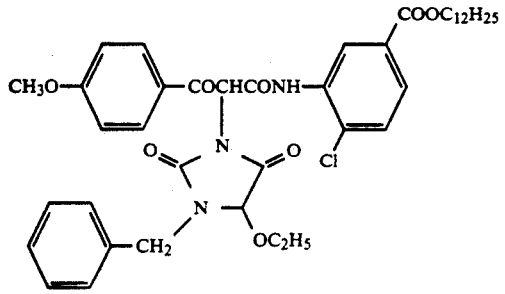
Y-15
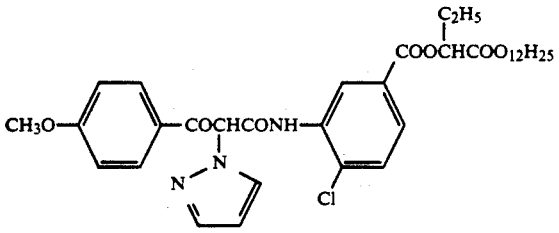
Y-16
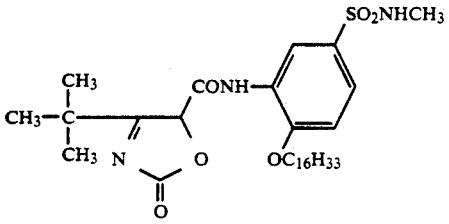
Y-17
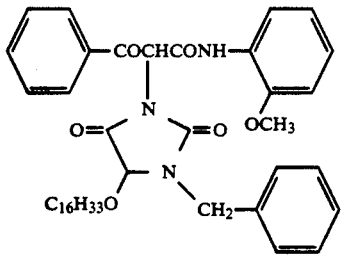
Y-18
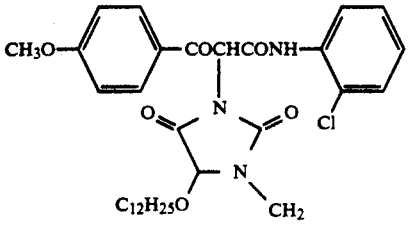

-continued
Y-19
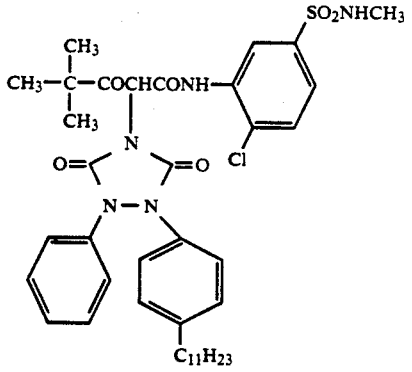
Y-20
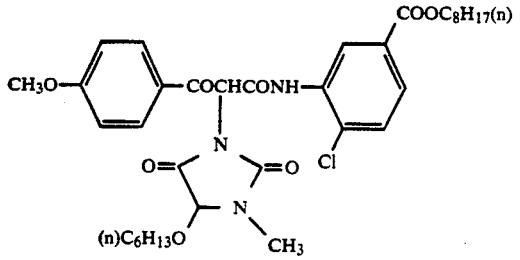
Y-21
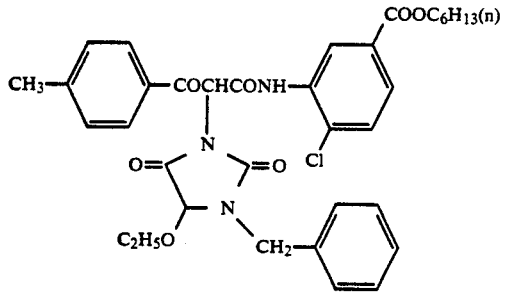
Y-22
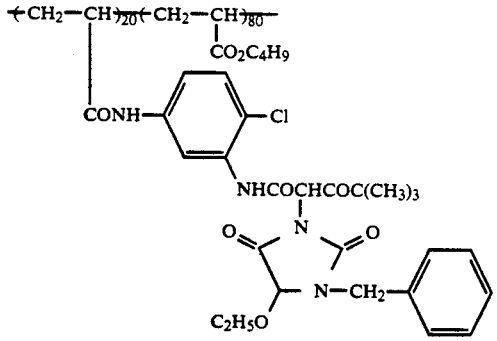
Y-23
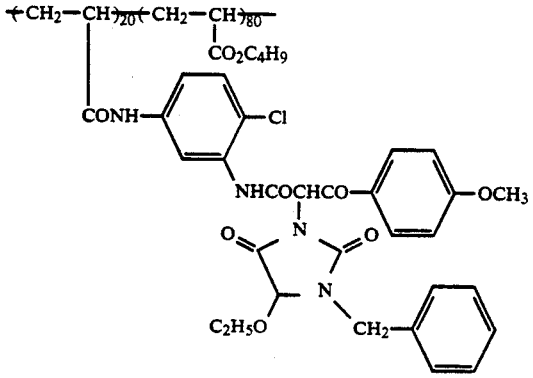

-continued
2-Equivalent Magenta Couplers
M-1
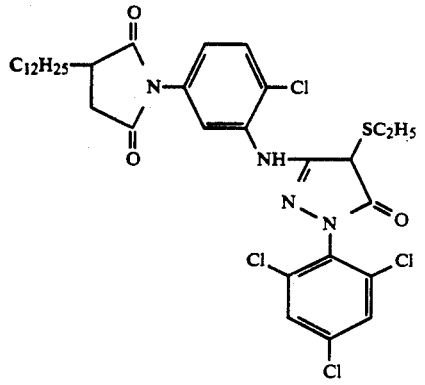
M-2
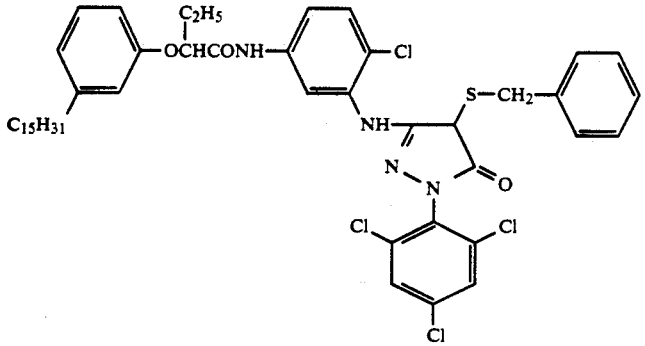
M-3
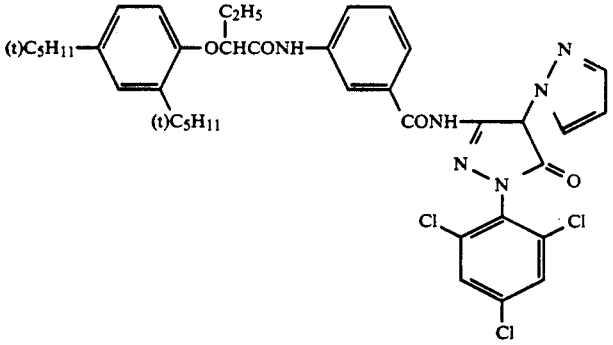
M-4
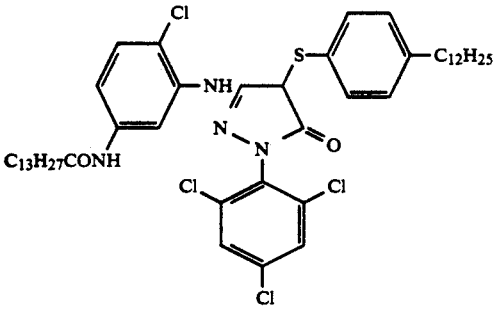

-continued
M-5
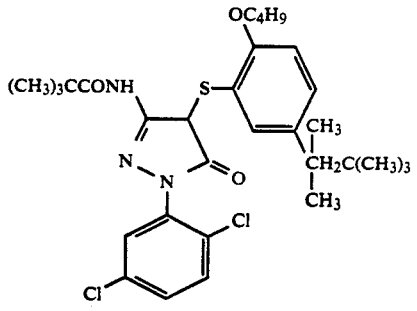
M-6
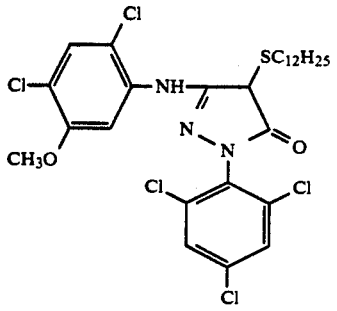
M-7
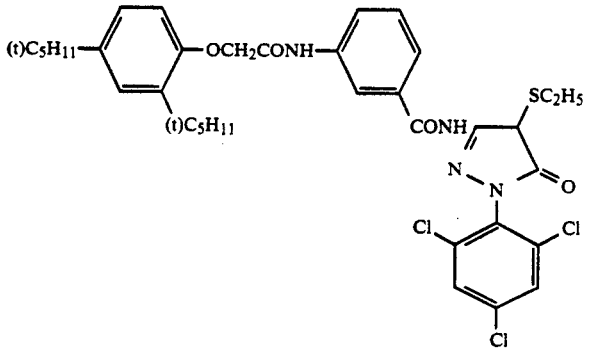
M-8
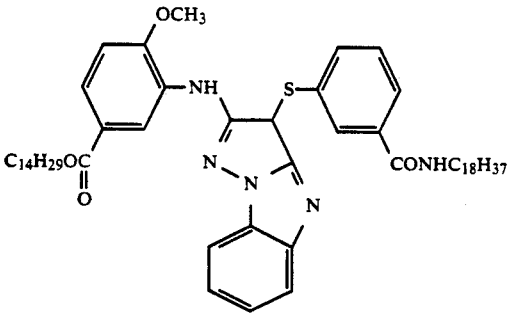
M-9
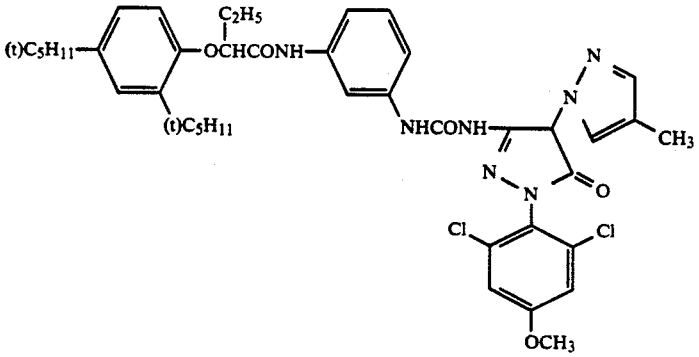

-continued
M-10
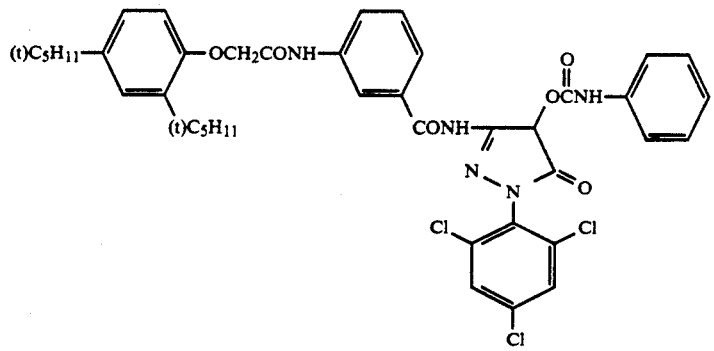
M-11
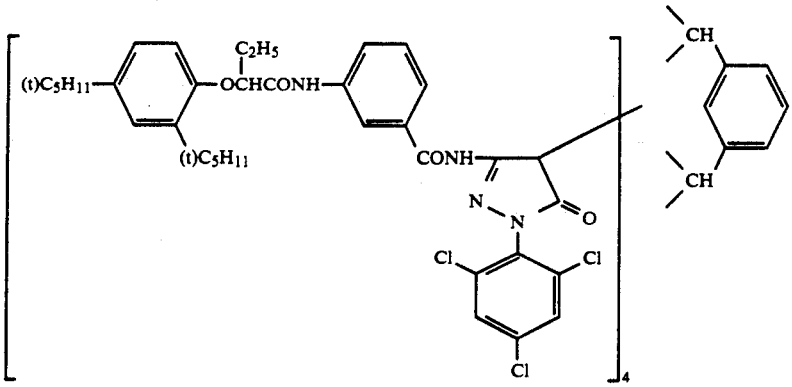
M-12
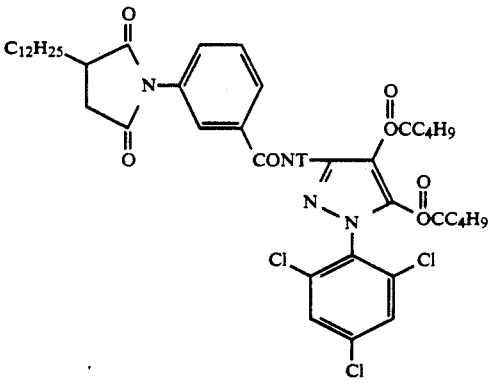
M-13
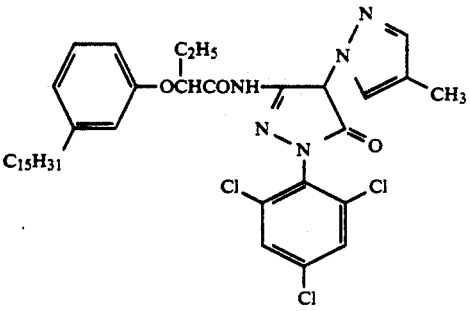

-continued
M-14
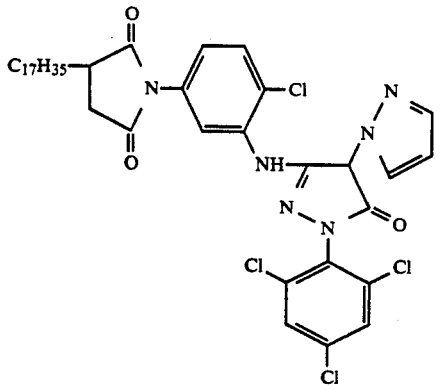
M-15
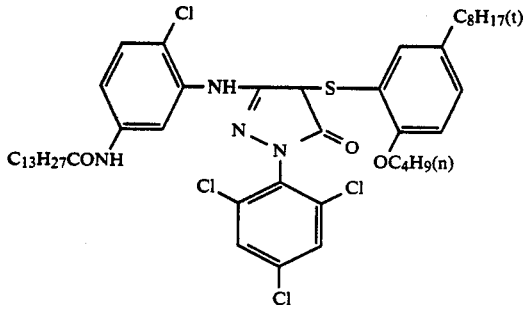
M-16
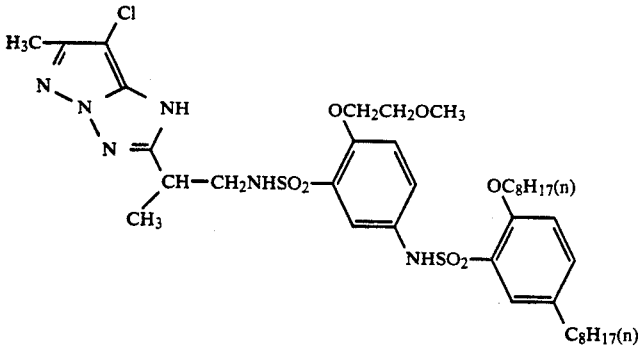
M-17
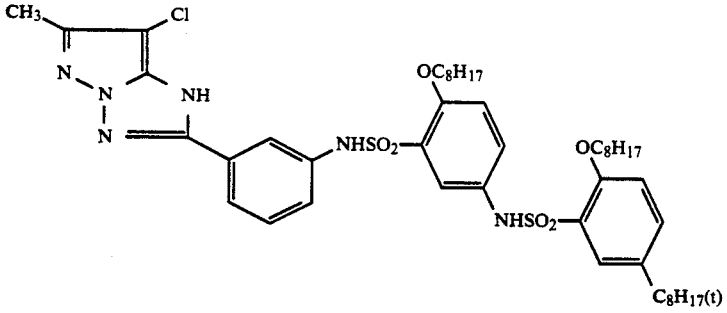
M-18
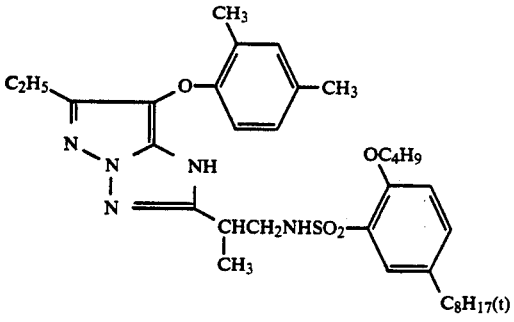

-continued
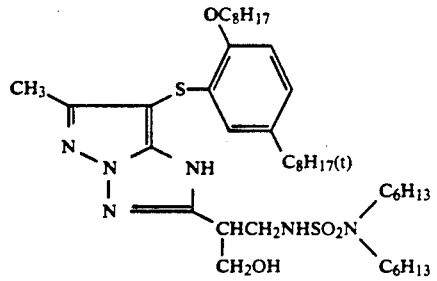
M-19
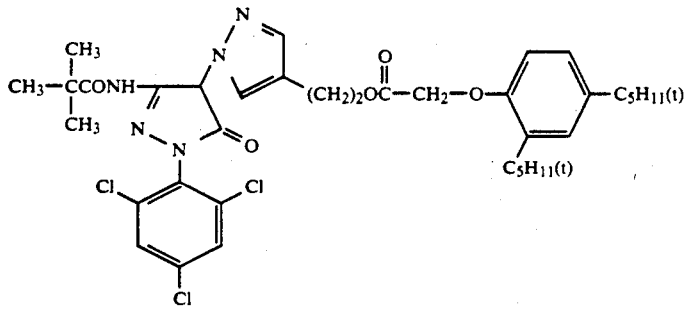
M-20
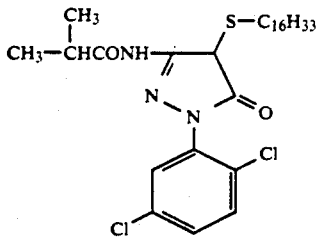
M-21
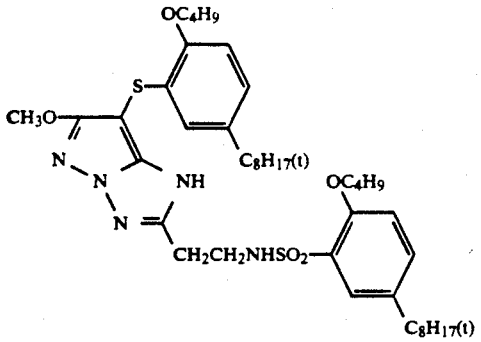
M-22

-continued
M-23
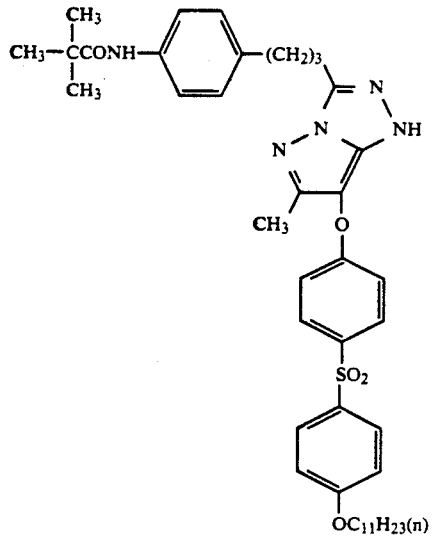
M-24
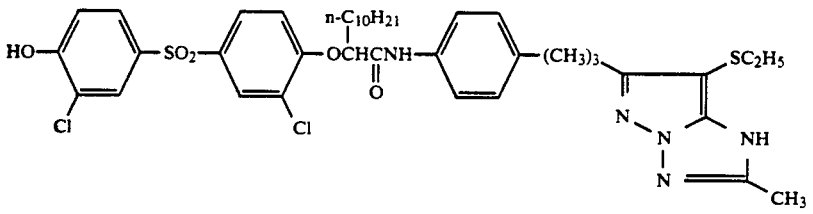
M-25
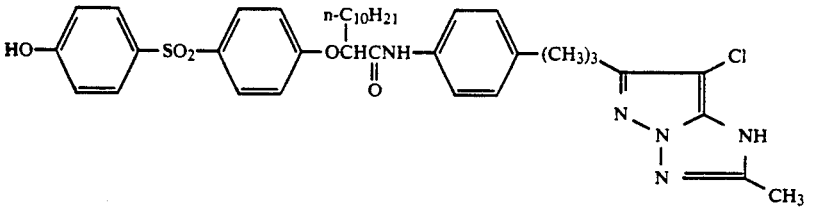
M-26
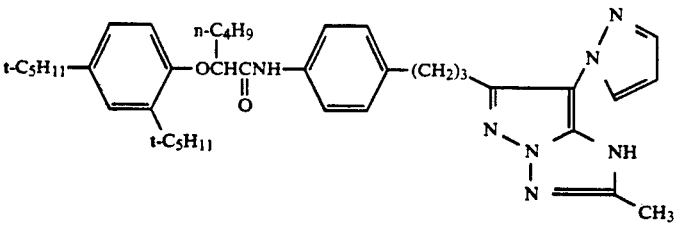
M-27
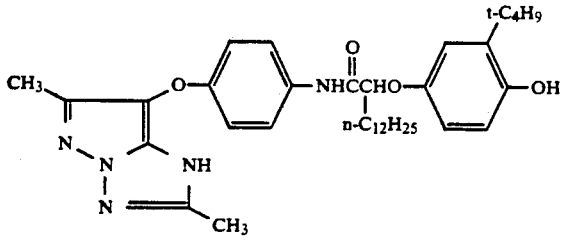

-continued
M-28
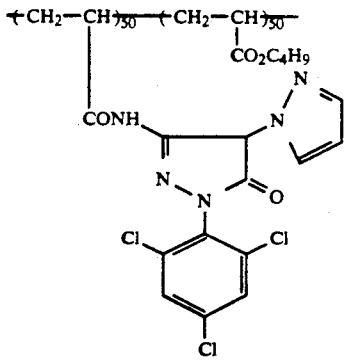
M-29
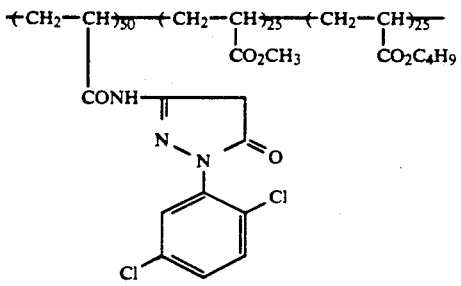
M-30
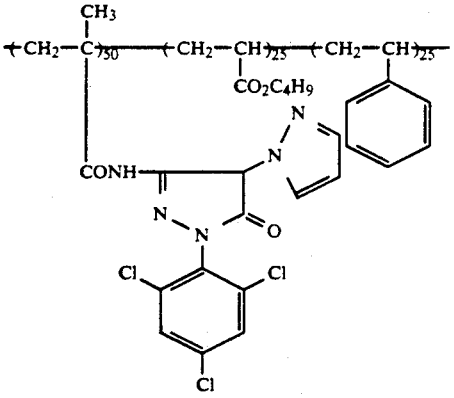
Cyan Couplers
C-1
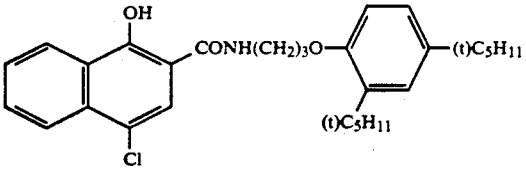
C-2
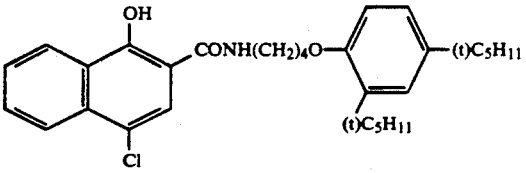
C-3
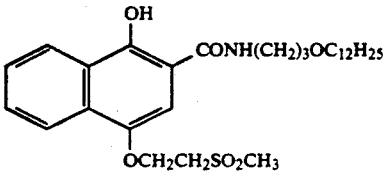

-continued
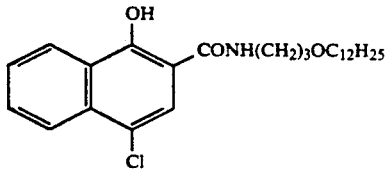
C-4
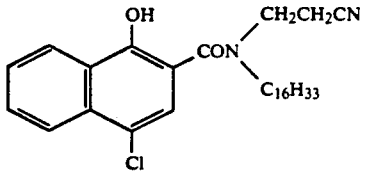
C-5
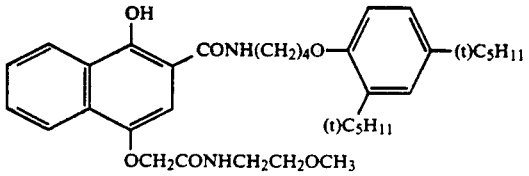
C-6
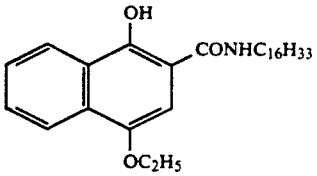
C-7
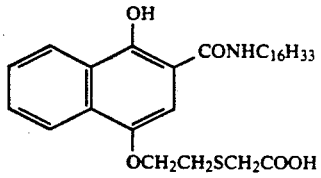
C-8
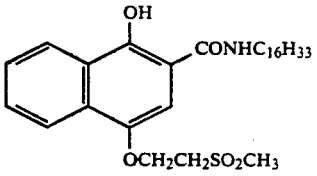
C-9
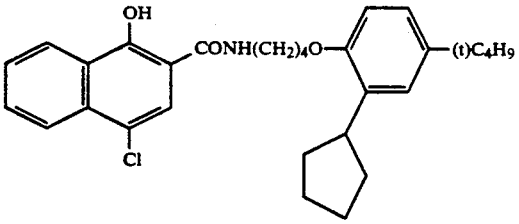
C-10
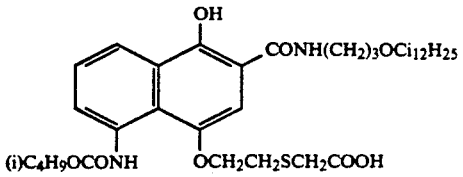
C-11

-continued
C-12
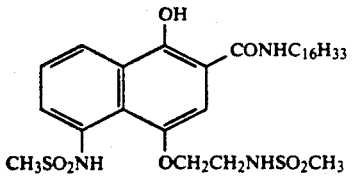
C-13
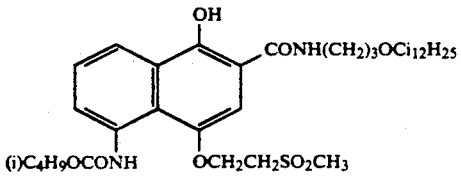
C-14
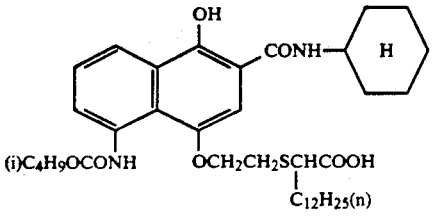
C-15
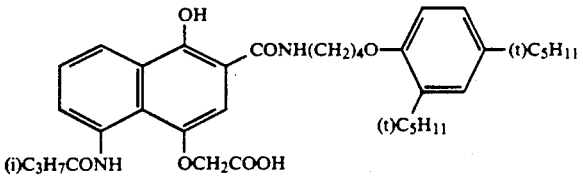
C-16
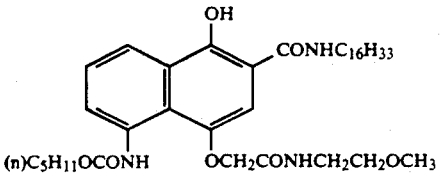
C-17
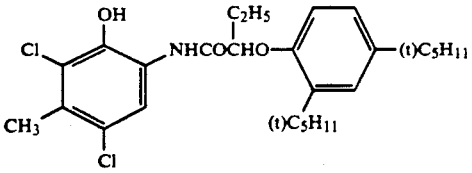
C-18
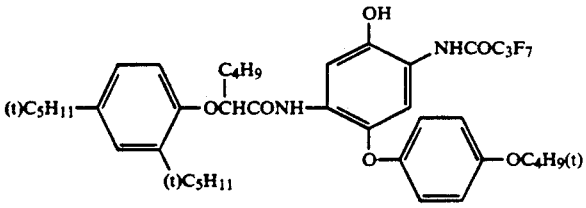
C-19
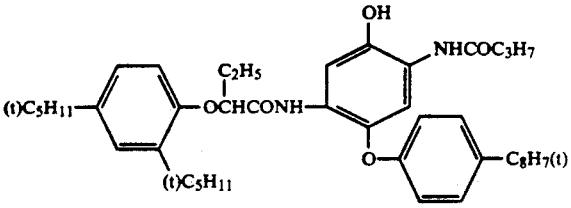

-continued
C-20
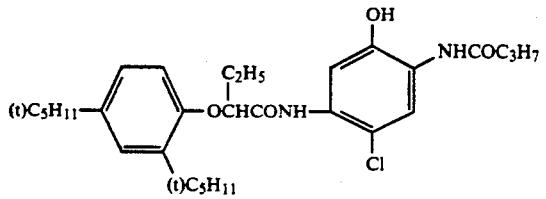
C-21
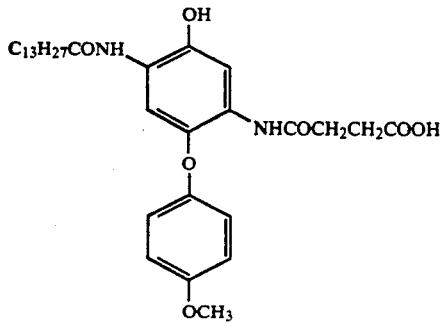
C-22
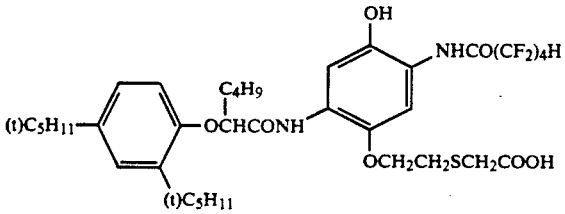
C-23
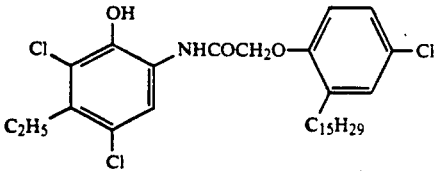
C-24
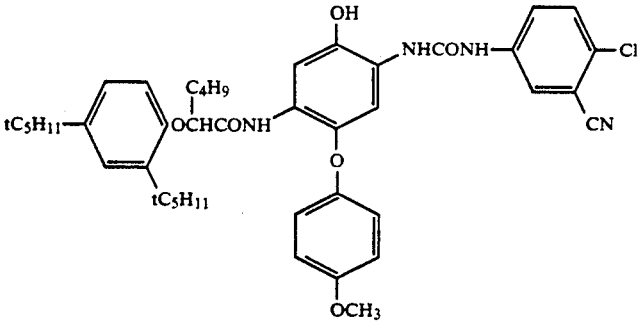
C-25
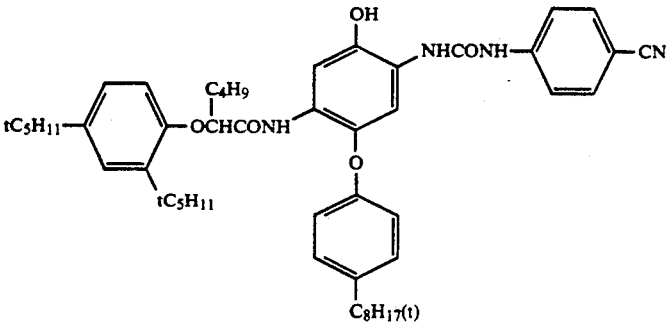

-continued
C-26
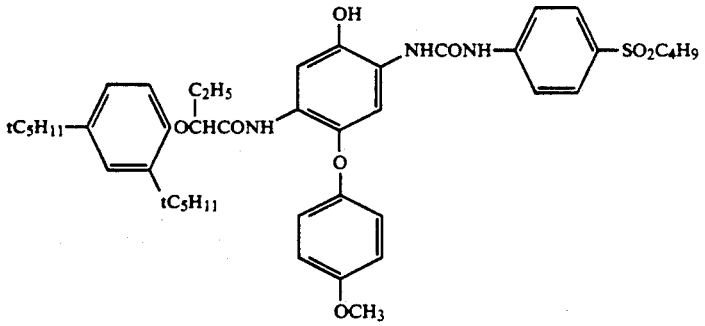
C-27
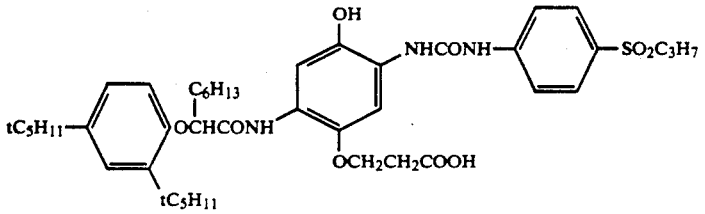
C-28
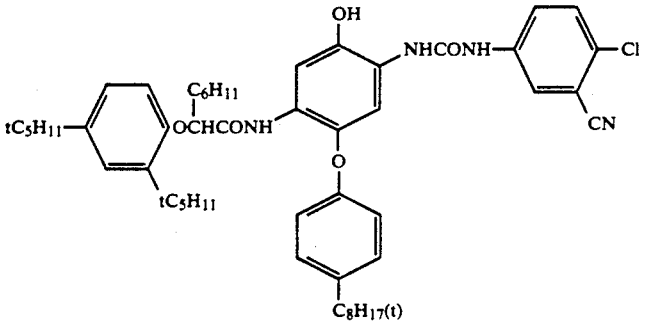
C-29
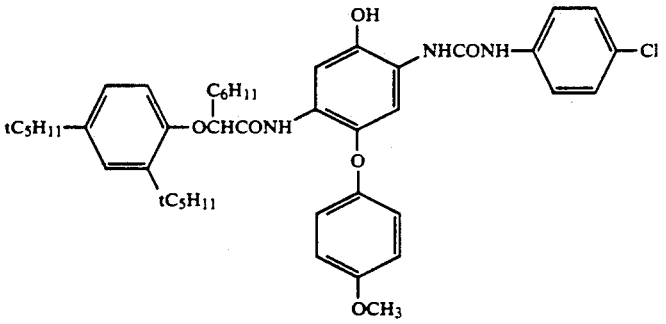
C-30
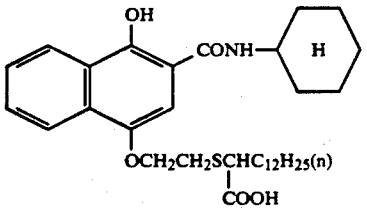
C-31
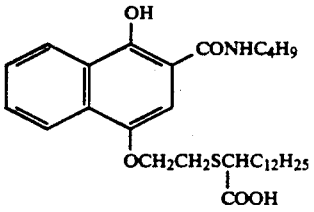

-continued

C-32

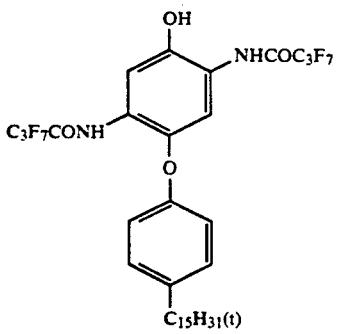

C-33

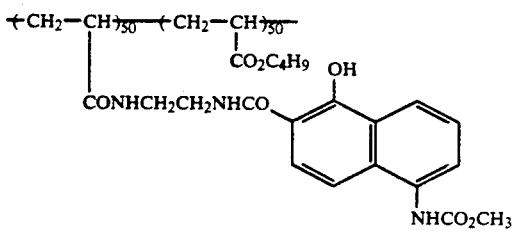

C-34

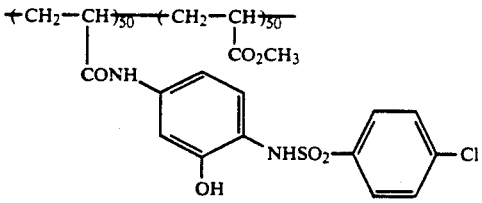

As color couplers, there can be utilized those described in, for example, U.S. Pat. Nos. 3,476,560, 2,521,908, 3,034,892, JP-B-44-2016, 38-22335, 42-11304, 44-32461, JP-A-51-26034, 52-42121, and DE-A-2,418,959.

As DIR couplers, the compounds shown by the above-mentioned general formula (I) can be utilized, as described in, for example, U.S. Pat. Nos. 3,227,554, 3,617,291, 3,701,783, 3,790,384, 3,632,345, DE-A-2,414,006, 2,454,301, 2,454,329, British Patent 953,454, JP-A-52-69624, 49-122335, JP-B-51-16141.

Apart from DIR couplers, compounds which, during development, release development inhibitors may be contained in the photosensitive materials; for example, those described in U.S. Pat. Nos. 3,297,445, 3,379,529, DE-A-2,417,914, JP-A-52-15271, 53-9116 can be utilized.

Furthermore, as described in JP-A-57-150845, a coupler which, accompanying development, emits a development promoter or antifoggant can particularly preferably be used.

Furthermore, as described in British Patent 2,083,640, a nondispersive coupler which forms narrowly dispersive dyes can also preferably be used.

The couplers are generally added to the emulsion layer in a proportion, per mol of silver, of $2\times10^{-3}$ mol to $5\times10^{-1}$ mol, preferably $1\times10^{-2}$ mol to $5\times10^{-1}$ mol.

In the manufactured photosensitive materials used in the present invention, the hydrophilic colloid layer may contain ultraviolet absorbers. For example, aryl-substituted benzotriazole compounds (e.g., those described in U.S. Pat. No. 3,533,794), 4-thiazolidone compounds (e.g., those described in U.S. Pat. Nos. 3,314,794, 3,352,681), benzophenone compounds (e.g., those described in JP-A-46-2784), cinnamic acid ester compounds (e.g., those described in U.S. Pat. Nos. 3,705,805, 3,707,375), butadiene compounds (e.g., those described in U.S. Pat. No. 4,045,229), or benzoxazole compounds (e.g., as described in U.S. Pat. No. 3,700,455) can be used. Further, those described in U.S. Pat. No. 3,499,762 and in JP-A-54-48535 can also be used. Ultraviolet absorbing couplers (e.g., α-naphthol-based cyan dye formation couplers) or ultraviolet absorbing polymers, etc., can be used. These ultraviolet absorbers may also be mordanted in a special layer.

In the case of applying the present invention to color photosensitive materials, there is no particular limitation on the location of use of the emulsion with which the present invention is concerned.

In the photographic processing of the photosensitive materials of the present invention, any of the well known methods can be used, and well known processing solutions can be used. Further, the processing temperature is usually chosen between 18° C. and 50° C., but the temperature may be below 18° C. or exceed 50° C. According to the object, development processing to form a silver image (black-and-white photographic processing), or any color photographic processing consisting of development treatment which should form a color image, can be applied.

In particular, in the color development of the photosensitive materials of the present invention, extremely desirable results are obtained, with regard to sensitivity and graininess, by representative so-called parallel development.

Color development solutions generally consist of alkaline aqueous solutions containing color-forming developers. As the color-forming developers, there can be used the well known primary aromatic amine developers, for example, phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

The color development solutions used in the development processing of the photosensitive materials of the present invention preferably are alkaline aqueous solutions of a primary aromatic amine based color developer as the main component. As this color developer, aminophenol-based compounds are also useful, but p-phenylenediamine-based compounds are preferably utilized; as representatives of these are mentioned 3-methyl-4-amino-N,N-diethylaniline, 3-methyl-4-amino-N-ethyl-N-β-hydroxyethylaniline, 3-methyl-4-amino-ethyl-N-β-methanesulfonamidoethylaniline, 3-methyl-4-amino-N-ethyl-N-β-methoxyethylaniline and their sulfates, chlorides, phosphates or p-toluenesulfonates, tetraphenylborates, p-(t-octyl)benzenesulfonates, etc.

Apart from these, there may be used those described in L. F. A. Mason et al., *Photographic Processing Chemistry*, Focal Press (1966), pages 226–229, U.S. Pat. Nos. 2,193,015, 2,592,364, Japanese Laid-Open Patent Showa 48-64933, etc. According to requirements, 2 or more color developers can be used in combination.

The color development solution may contain pH buffers such as alkali metal carbonates, borates, or phosphates; development inhibitors or antifoggants such as bromides, iodides, benzimidazoles, benzothiazoles or mercapto compounds; preservatives such as hydroxylamine, diethylhydroxylamine, triethanolamine, compounds described in DE-A-2,622,950, sulfites or bisulfites; and chelating agents such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, and the compounds described in JP-A-58-195845, as representatives of aminopolycarboxylic acids, 1-hydroxyethylidene-1,1'-diphosphonic acid, organic phosphonic acids as described in *Research Disclosure*, No. 18170 (May, 1979), aminotris(methylenephosphonic acid), ethylenediamine-N,N,N',N'-tetramethylenephosphonic acid and the like aminophosphonic acids, phosphonocarboxylic acids as described in *Research Disclosure*, No. 18170 (May, 1979).

The color developer is generally utilized in a concentration of about 1 g to 20 g per liter of color development solution, furthermore preferably in a concentration of about 2 g to 10 g per liter of color development solution. Further, the pH of the color development solution used is usually above 8, most generally about 9 to 12. Further, the amount of replenishment solution can be reduced to 9 ml and below per 100 $cm^2$ of photosensitive material by using a replenishment solution with regulated concentrations of halides, color developers, etc., in the color development solution.

The color photographic materials of the present invention manifest excellent performance, even in this kind of low replenishment processing.

The processing temperature of the color development solution of the present invention is preferably 20° C. to 50° C., more preferably 30° C. to 40° C. The treatment time is 20 seconds to 10 minutes, preferably 30 seconds to 5 minutes.

Bleaching Solution, Bleach Fixing Solution, Fixing Solution

The color photographic materials of the present invention, following the color development, are treated to remove silver by bleaching, bleach fixing and fixing. In the bleaching agent in this bleaching solution or bleach fixing solution, the ferrous ion complex agent is a complex of ferrous ions and an aminocarboxylic acid or its salt, etc., as a chelating agent.

As representatives of these aminocarboxylic acids, there can be mentioned:

Ethylenediaminetetraacetic acid
Diethylenetriaminepentaacetic acid
1,2-Diaminopropanetetraacetic acid
1,3-Diaminopropanetetraacetic acid
Nitrilotriacetic acid
Cyclohexanediaminetetraacetic acid
Iminodiacetic acid
Ethyletherdiaminetetraacetic acid
Glycoletherdiaminetetraacetic acid
Phenylenediaminetetraacetic acid, etc.; of course, there is no limitation to these illustrative compounds.

Further, a bleach promoting agent can be used, according to the requirements, in the bleach solution or bleach fixing solution. As concrete examples of useful bleach promoting agents, there can be mentioned the compounds possessing a mercapto group or a disulfide group, as described in, for example, U.S. Pat. No. 3,893,858, West German Patents 1,290,812, 2,059,988, JP-A-53-32736, 53-57831, 53-37418, 53-65732, 53-72623, 53-95630, 53-95631, 53-104232, 53-124424, 53-141623, 53-284426, and *Research Disclosure*, No. 17729 (July, 1978).

Other than these, there can be contained in the bleach solution or bleach fixing solution, bromides (e.g., potassium bromide, sodium bromide, ammonium bromide) or chlorides (e.g., potassium chloride, sodium chloride, ammonium chloride) or iodides (e.g., ammonium iodide) rehalogenation agents. According to the requirements, one or more kinds of inorganic acid or organic acid and their alkali metal or ammonium salts, possessing a pH buffering power, may be added, such as boric acid, sodium tetraborate decahydrate, sodium metaborate, acetic acid, sodium acetate, sodium carbonate, potassium carbonate, phosphorous acid, phosphoric acid, sodium phosphate, citric acid, sodium citrate, tartaric acid, etc., or ammonium nitrate, guanidine, and the like anticorrosion agents can be added.

The fixing agents utilized in the bleach fixing solution or fixing solution are well known fixing agents, namely, sodium thiosulfate, ammonium thiosulfate and such like thiosulfates; sodium thiocyanate, ammonium thiocyanate and the like thiocyanates; ethylenebisthioglycolic acid, 3,6-dithio-1,8-octanediol and the like thioether compounds and thioureas and the like water-soluble silver halide solvents; these can be used alone or as a mixture of two or more.

Water Wash, Stabilizing Solution

The silver halide color photographic materials of the present invention, after the desilverizing process of fixing or bleach fixing, are generally given a water wash and/or stabilization treatment.

The amount of water wash in the water wash process can depend on the characteristics of the photosensitive material (e.g., coupler and other materials utilized), application, wash water temperature, number of wash tanks (number of stages), countercurrent flow or cocurrent flow replenishment system, and various other conditions. Among these, the method described in *Journal of the Society of Motion Picture and Television Engineers*, Vol. 64, pp. 248-253 (May, 1955), on the relationship between the amount of water and the number of wash tanks in a multistage countercurrent flow method can be employed. The number of stages in a conventional multistage countercurrent flow system is preferably 2 to 6, and 2 to 4 is particularly preferred.

By means of a multistage countercurrent flow system, the amount of wash water can be greatly reduced, for example, 0.5 liter to 1 liter and below per $m^2$ of photosensitive material, but due to an increase in the residence time of the water in the tanks, bacteria propagate, suspended matter which is produced adheres to the photosensitive material, and other like problems exist. In the processing of the color photosensitive materials of the present invention, as a scheme for solving this kind of problem, the method of reducing calcium and magnesium described in Japanese patent Application No. 61-131632 can be used very effectively. Further, microbicides can be used, such as the isothiazolone compounds and saiabendazoles described in JP-A-57-8542, chlorinated thiocyanuric acid and other such chlorine-based microbicides described in JP-A-61-120145, benzotriazoles described in JP-A-61-267761, and also the microbicides described in Yoshi Horiguchi, *Chemistry of Antibacterials and Antimicrobials*; Hygiene Technology Association ed., *Sterilization, Disinfection, Antimicrobial Techniques for Microorganisms*; Japanese Antibacterial Antimicrobial Science Association ed., *Antibacterial and Antimicrobial Agents Encyclopedia.*

Furthermore, surfactants as wetting agents, or chelating agents, represented by EDTA, as water softening agents, can be used in the wash water.

The pH of the wash water, in the processing of the photosensitive materials of the present invention, is 4 to 9, preferably 5 to 8. Wash water temperature and also washing time can be established by the various characteristics and application to the photosensitive materials, but generally are chosen in the ranges 20 seconds to 10 minutes at 15° to 45° C., preferably 30 seconds to 5 minutes at 25° to 40° C.

Following on the water wash process, or not following on the water wash process but directly, processing with a stabilization solution can be performed. To the stabilization solution are added compounds which possess an image stabilization function, for example, aldehyde compounds represented by formaldehyde, buffers in order to regulate film pH suitably for color stabilization, or ammonium compounds, may be mentioned. Further, in order to prevent propagation of bacteria, or to render the photosensitive material antimicrobial after treatment, each kind of the above-mentioned antibacterial or antimicrobial agents can be used.

Furthermore, surfactants, fluorescent whitening agents, and film hardeners can also be added. In the processing of the photosensitive materials of the present invention, in the case in which stabilization is direct and not following on the water wash process, the methods known from JP-A-57-8543, 58-14834, 59-184343, 60-220345, 60-238832, 60-239784, 60-239749, 61-4054, 61-118749 can all be used.

Apart from those, use of 1-hydroxyethylidene-1,1-diphosphonic acid, ethylenediaminetetramethylenephosphonic acid and the like chelating agents, bismuth compounds, is also a preferred mode.

The solution used in the water wash and/or stabilization processes can also be used in the former processes. As an example, it may be mentioned that the overflow of the wash water, reduced by means of the multistage countercurrent flow process, is caused to flow into a previous bath, the bleach fixing bath, on replenishing concentrated solution in the bleach fixing tank, to reduce the amount of waste solutions.

The present invention is explained further by means of the following examples, but the invention is not limited to these.

EXAMPLE 1

Silver iodobromide plates A to G were prepared by the method of Japanese patent Application Showa 61-21685.

After addition to an aqueous solution of inactive gelatin 30 g, potassium bromide 6 g, dissolved in 1 liter of distilled water, while stirring at 60° C., of 35 cc of an aqueous solution of 5.0 g of silver nitrate, and 35 cc of an aqueous solution of 3.2 g of potassium bromide and 0.98 g of potassium iodide, respectively, at 70 cc/min flow rate during 30 seconds, the pAg was raised to 10 and ripening was for 30 minutes, and each emulsion was prepared.

Continuing from this, 483 cc of 145 g of silver nitrate in 1 liter of an aqueous solution and an aqueous solution of potassium bromide and potassium iodide in equimolar amounts was added at 60° C. and pAg=9.5 at an addition rate near the critical growth rate, and the plate core emulsion was prepared. Furthermore, following this, the remainder of the silver nitrate solution and a mixture of potassium bromide and potassium iodide solutions different from the combination used while preparing the core emulsion was added in an equimolar amount at a rate of addition close to the critical growth rate, covering the core, and core/shell form silver iodobromide plates A to G were prepared.

The aspect ratio of emulsions A to G was changed by adjustment of the pAg.

The grain size of all of A to G was regulated to be an equivalent spherical diameter of 0.75 μm. The grain size distribution between emulsions A to G, close to a relative standard deviation of 30%, is considered to be about the same.

Table 1 shows the size and iodine content proportions compositions of emulsions A to G.

TABLE 1

| Emulsion Name | Aspect Ratio | Grain Size (equivalent sphere diameter) (μm) | Core/Shell Ratio (volume ratio) | Iodine Content Core/Shell | Average Iodine Content (%) | Surface Iodine Content (XPS) (%) |
|---|---|---|---|---|---|---|
| A (1)** | 6.5 | 0.75 | 1/1 | 14/0 | 7.0 | 2.1 |
| B (2) | 6.7 | 0.76 | 1/1 | 12/3 | 7.5 | 5.2 |
| C (2) | 6.5 | 0.75 | 1/1 | 14/0* | 7.1 | 10.7 |
| D (1) | 6.3 | 0.76 | 1/1 | 7/7 | 7.0 | 7.0 |
| E (1) | 6.4 | 0.75 | 1/1 | 0/7 | 3.5 | 7.0 |

TABLE 1-continued

| Emulsion Name | Aspect Ratio | Grain Size (equivalent sphere diameter) (μm) | Core/Shell Ratio (volume ratio) | Iodine Content Core/Shell | Average Iodine Content (%) | Surface Iodine Content (XPS) (%) |
|---|---|---|---|---|---|---|
| F (1) | 12.5 | 0.77 | 1/1 | 14/0 | 7.0 | 2.7 |
| G (2) | 12.5 | 0.77 | 1/1 | 12/3 | 7.5 | 6.1 |

**(1) = Comparison example; (2) = Present Invention
*Emulsion C, after preparing in the same manner as Emulsion A, was prepared by addition of 1% aqueous solution of potassium iodide at the time when addition of silver nitrate was concluded.

The XPS measurement was carried out using a Shimazu Seisaku made ESCA-75. As excitation X-rays, Mg-Kα (accelerating voltage 8 kv, current 30 mA) were utilized, the peak areas equivalent to I-3d 5/2 and Ag-3d 5/2 were sought, and from the intensity ratio of these, the average iodine content of the surface portion of the silver halide grains was sought.

The silver iodobromide plate emulsions A to G were each chemically sensitized so as to show optimum sensitivity at 1/100" exposure. Table 2 shows the amount of chemical sensitizer added per mol of silver.

TABLE 2

| Chemical Sensitizer Emulsion Name | Emulsion Name before Chemical Sensitization | Sodium Thio-sulfate (mg) | Potassium Chloro-aurate (mg) | Sulfur-Containing Silver Halide Solvent Kind* | Amount (mg) |
|---|---|---|---|---|---|
| A-1 | A | 7 | 3 | — | — |
| B-1 | B | " | " | — | — |
| B-2 | " | " | " | SSS-1 | 30 |
| B-3 | " | " | " | SSS-5 | " |
| C-1 | C | " | " | — | — |
| C-2 | " | " | " | SSS-1 | 30 |
| C-3 | " | " | " | SSS-5 | " |
| D-1 | D | " | " | — | — |
| D-2 | " | " | " | SSS-1 | 30 |
| E-1 | E | " | " | — | — |
| E-2 | " | " | " | SSS-1 | 30 |
| F-1 | F | 8 | 3.5 | — | — |
| G-1 | G | " | " | — | — |
| G-2 | " | " | " | SSS-1 | 30 |

*Structural formulae are given hereinbefore.

Samples 101 to 114

Samples 101 to 114 were prepared by substitution as shown in Table 3 below, showing the silver iodobromide content of layer Nos. 4, 7 and 12 of multilayer coating compositions.

TABLE 3

| Sample No. | Layer 4 Silver Iodobromide Emulsion | Layer 7 Silver Iodobromide Emulsion | Layer 12 Silver Iodobromide Emulsion |
|---|---|---|---|
| 101 | A-1 | A-1 | A-1 |
| 102 | B-1 | B-1 | B-1 |
| 103 | B-2 | B-2 | B-2 |
| 104 | B-3 | B-3 | B-3 |
| 105 | C-1 | C-1 | C-1 |
| 106 | C-2 | C-2 | C-2 |
| 107 | C-3 | C-3 | C-3 |
| 108 | D-1 | D-1 | D-1 |
| 109 | D-2 | D-2 | D-2 |
| 110 | E-1 | E-1 | E-1 |
| 111 | E-2 | E-2 | E-2 |
| 112 | F-1 | F-1 | F-1 |
| 113 | G-1 | G-1 | G-1 |
| 114 | G-2 | G-2 | G-2 |

The amount of silver is shown in g/m² units for the applied amount of silver halide and silver colloid, furthermore, the amounts are shown in g/m² units for coupler, additives and gelatin, furthermore, the number of mols per mol of silver halide in the same layer is shown for the sensitizing dyes.

| Layer 1: Antihalation Layer | |
|---|---|
| Black silver colloid | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |

Layer 2: Intermediate Layer

Gelatin

Layer 3: Low Sensitivity Red-Sensitive Emulsion Layer

Silver iodobromide (AgI 4 mol%, uniform AgI form, spherical equivalent diameter 0.5 μm, coefficient of variation of equivalent spherical diameter 20%, plate form grains, diameter/thickness ratio 3.0)

Amount of silver applied 1.2

Silver iodobromide (AgI 3 mol%, uniform AgI form, spherical equivalent diameter 0.3 μm, coefficient of variation of equivalent spherical diameter 15%, spherical grains, diameter/thickness ratio 1.0)

| | |
|---|---|
| Amount of silver applied | 0.6 |
| Gelatin | 1.0 |
| ExS-1 | $4 \times 10^{-4}$ |
| ExS-2 | $5 \times 10^{-5}$ |
| ExS-3 | $1 \times 10^{-6}$ |
| ExC-1 | 0.05 |
| ExC-2 | 0.50 |
| ExC-3 | 0.03 |
| ExC-4 | 0.12 |
| ExC-5 | 0.01 |
| Layer 4: High Sensitivity Red-Sensitive Emulsion Layer | |
| Silver iodobromide emulsion | |
| Amount of silver applied | 0.7 |
| Gelatin | 1.0 |
| ExS-1 | $3 \times 10^{-4}$ |
| ExS-2 | $2.3 \times 10^{-5}$ |
| ExS-3 | $0.5 \times 10^{-6}$ |
| ExS-11 | $3.0 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Layer 5: Intermediate Layer | |
| Gelatin | 0.5 |
| Cpd-1 | 0.1 |
| Solv-1 | 0.05 |

Layer 6: Low Sensitivity Green-Sensitive Emulsion Layer

Silver iodobromide emulsion (AgI 4 mol%, surface high AgI form, spherical equivalent diameter 0.5 μm, coefficient of variation of spherical equivalent diameter 15%, plate form grains, diameter/thickness ratio 4.0)

Amount of silver applied 3.5

Silver iodobromide emulsion (AgI 3 mol%, uniform AgI type, spherical equivalent diameter 0.3 μm, coefficient of variation of spherical equivalent diameter 25%, spherical grains, diameter/thickness ratio 1.0)

| | |
|---|---|
| Amount of silver applied | 0.20 |
| Gelatin | 1.0 |
| ExS-4 | $2 \times 10^{-4}$ |
| ExS-5 | $5 \times 10^{-4}$ |
| ExS-6 | $1 \times 10^{-4}$ |
| ExS-7 | $3 \times 10^{-5}$ |
| ExS-8 | $3 \times 10^{-5}$ |
| ExS-9 | $4 \times 10^{-5}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Layer 7: High Sensitivity Green-Sensitive Emulsion Layer | |
| Silver iodobromide emulsion | |
| Amount of silver applied | 0.8 |
| ExS-4 | $2 \times 10^{-4}$ |
| ExS-5 | $5 \times 10^{-4}$ |
| ExS-6 | $1 \times 10^{-4}$ |
| ExS-7 | $3 \times 10^{-5}$ |
| ExS-8 | $3 \times 10^{-5}$ |
| ExS-9 | $4 \times 10^{-5}$ |
| ExM-8 | 0.1 |
| ExM-34 | 0.01 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Layer 8: Intermediate Layer | |
| Gelatin | 0.5 |
| Cpd-1 | 0.05 |
| Solv-1 | 0.02 |

Layer 9: Donor Layer for Multilayer Effect

Silver iodobromide emulsion (AgI 2 mol%, internal part high AgI form, spherical equivalent diameter 1.0 μm, coefficient of variation of spherical equivalent diameter 15%, plate shaped grains, diameter/thickness ratio 6.0)

Amount of silver applied 0.35

Silver iodobromide emulsion (AgI 2 mol%, internal part high AgI form, spherical equivalent diameter 0.4 μm, coefficient of variation of spherical equivalent diameter 20%, plate shaped grains, diameter/thickness ratio 6.0)

| | |
|---|---|
| Amount of silver applied | 0.20 |

-continued

| | |
|---|---|
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Layer 10: Yellow Filter Layer | |
| Yellow color silver colloid | 0.05 |
| Gelatin | 0.5 |
| Cpd-2 | 0.13 |
| Cpd-1 | 0.10 |

Layer 11: Low Sensitivity Blue-Sensitive Emulsion Layer

Silver iodobromide (AgI 4.5 mol%, uniform AgI form, spherical equivalent diameter 0.7 μm, coefficient of variation of spherical equivalent diameter 15%, plate shaped grains, diameter/thickness ratio 7.0)

Amount of silver applied 0.3

Silver iodobromide (AgI 3 mol%, uniform AgI form, spherical equivalent diameter 0.3 μm, coefficient of variation of spherical equivalent diameter 25%, plate shaped grains, diameter/thickness ratio 7.0)

| | |
|---|---|
| Amount of silver applied | 0.15 |
| Gelatin | 1.6 |
| ExS-10 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExY-17 | 1.0 |
| Solv-1 | 0.20 |
| Layer 12: High Sensitivity Blue-Sensitive Emulsion Layer | |
| Silver iodobromide emulsion | |
| Amount of silver applied | 0.5 |
| Gelatin | 0.5 |
| ExS-10 | $1 \times 10^{-4}$ |
| ExY-15 | 0.20 |
| ExY-13 | 0.01 |
| Solv-1 | 0.10 |
| Layer 13: First Protection layer | |
| Gelatin | 0.8 |
| UV-4 | 0.1 |
| UV-5 | 0.15 |
| Solv-1 | |
| Solv-2 | |
| Layer 14: Second Protective Layer | |
| Fine grain silver bromide emulsion (I 2 mol %, s/r = 0.2, 0.07 μm) | 0.5 |
| Gelatin | 0.45 |
| Polymethyl methacrylate grains (diameter 1.5 μm) | 0.2 |
| H-1 | 0.4 |
| Cpd-3 | 0.5 |
| Cpd-4 | 0.5 |

In each layer, other than the above-mentioned compositions, emulsion stabilizer Cpd-3 (0.07 g/m$^2$), surfactant Cpd-4 (0.03 g/m$^2$) were added as coating aids.

Also, Cpd-5 (0.10 g/m$^2$) and Cpd-6 (0.002 g/m$^2$) below were added.

-continued
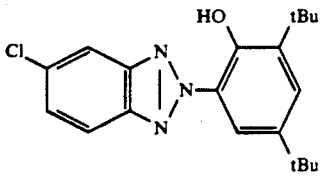
UV-2
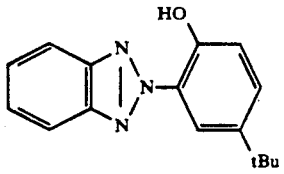
UV-3
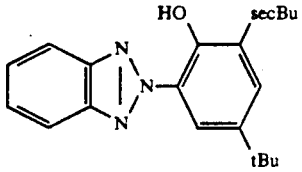
UV-4
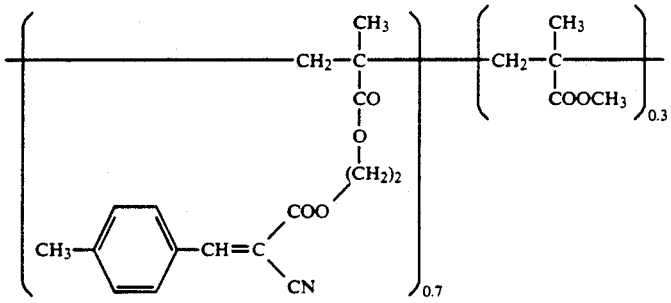
UV-5
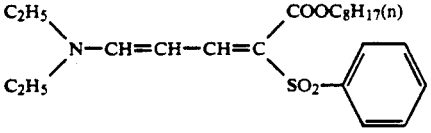
Solv-1:
Tricresyl phosphate
Solv-2:
Dibutyl phthalate
Solv-3:
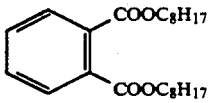
Solv-4:
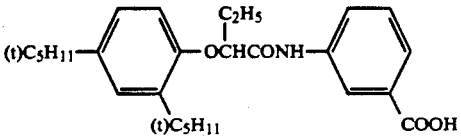
Cpd-1

-continued
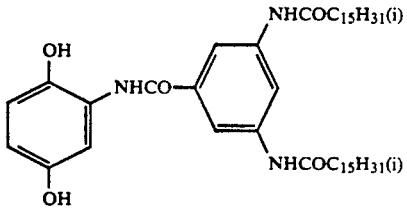
Cpd-2
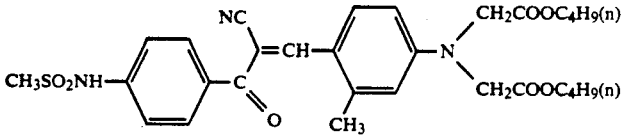
Cpd-3
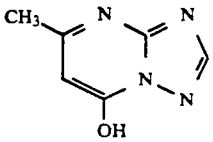
Cpd-4
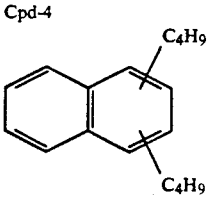
Cpd-5
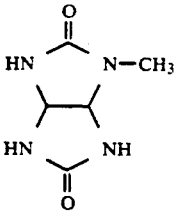
Cpd-6
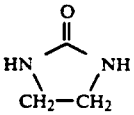
ExC-1
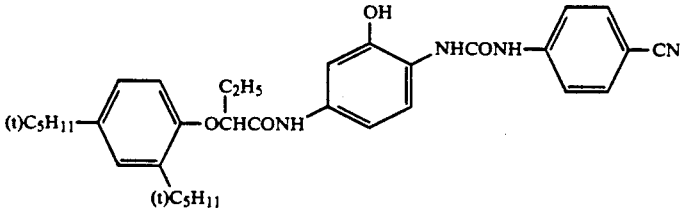
ExC-2
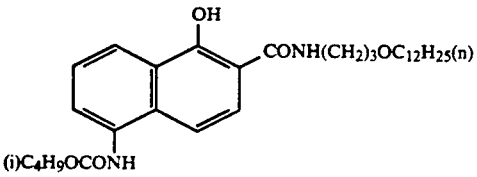
ExC-3

-continued
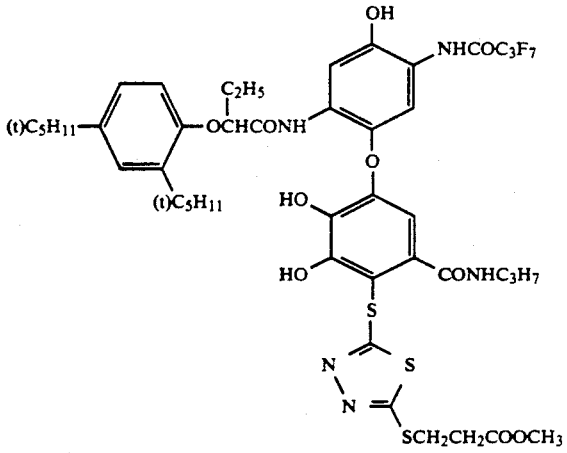
ExC-4
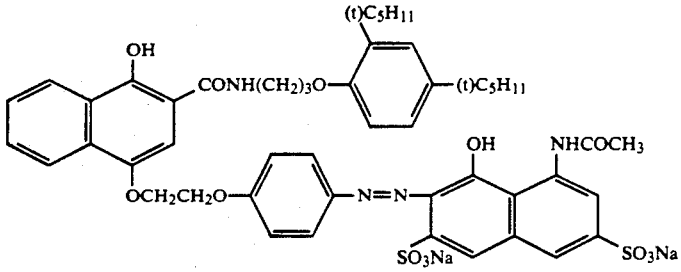
ExC-5
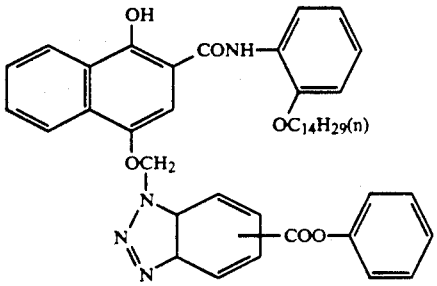
ExC-6
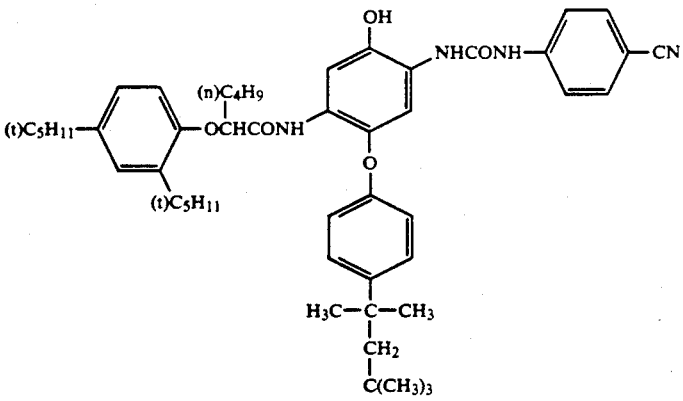
ExC-7
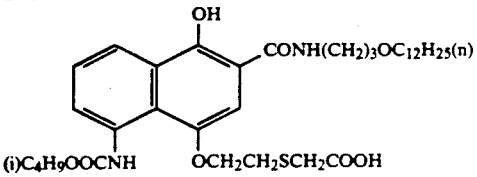

-continued
ExM-8
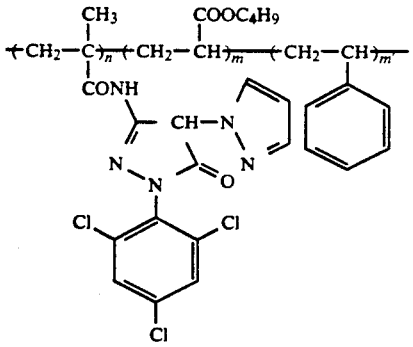
n = 50, m = 25, m' = 25
molecular weight: about 20,000
ExM-9
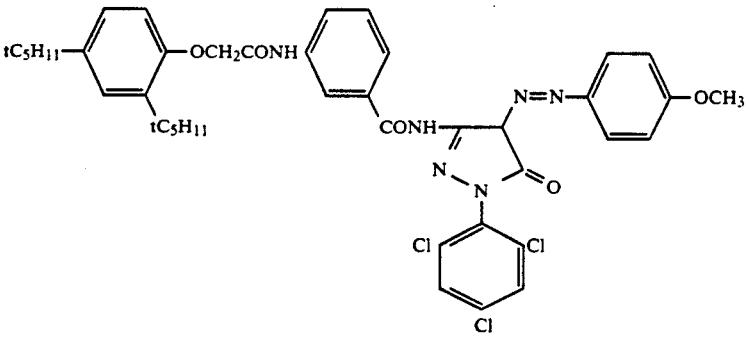
ExM-10
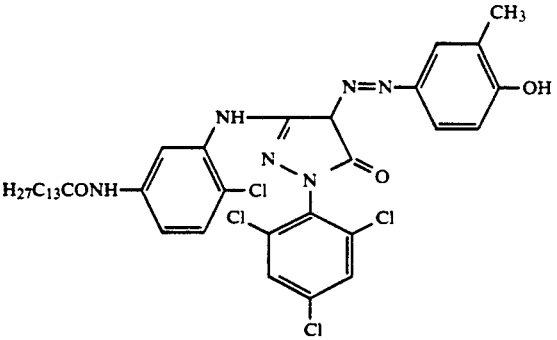
ExY-11
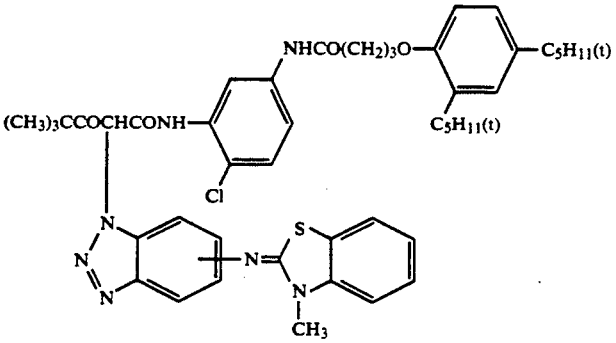
ExM-12

-continued
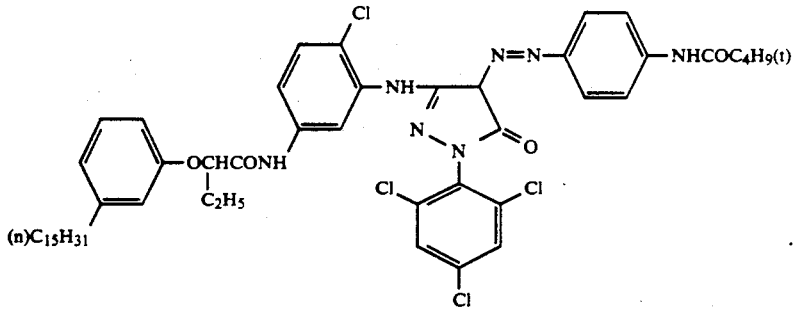
ExY-13
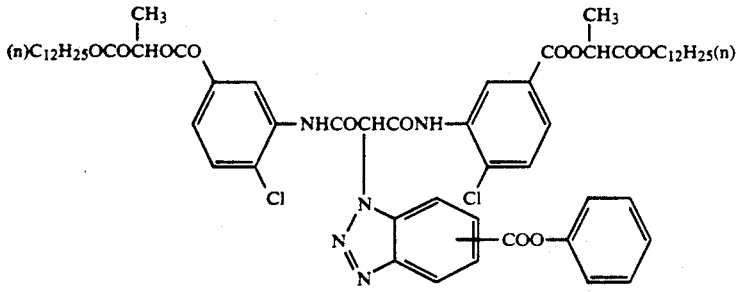
ExM-14
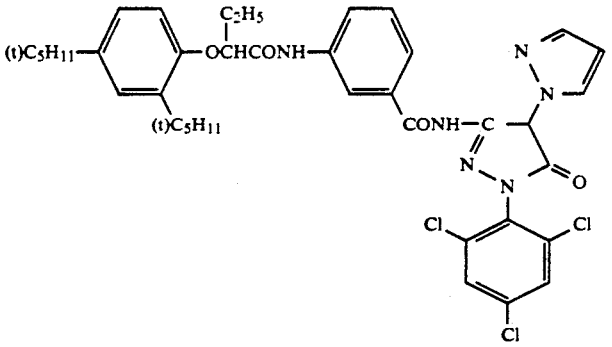
ExY-15
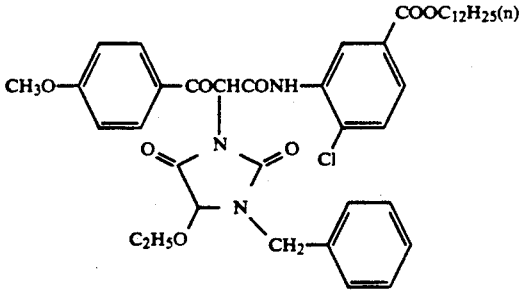
ExC-16

-continued
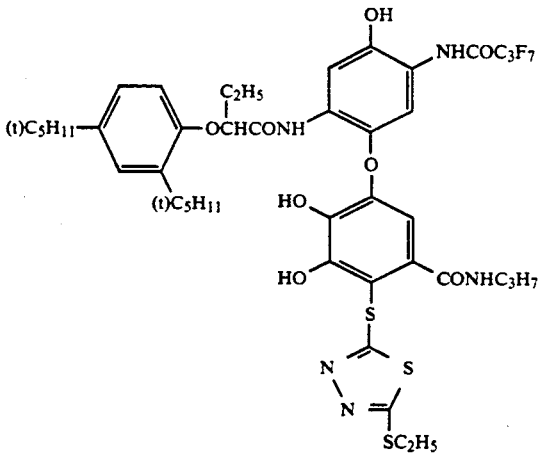
ExY-17
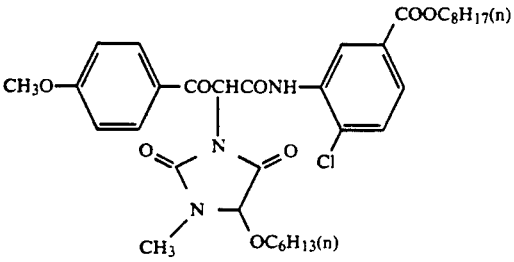
ExC-18
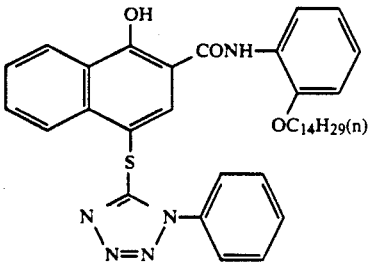
ExY-19
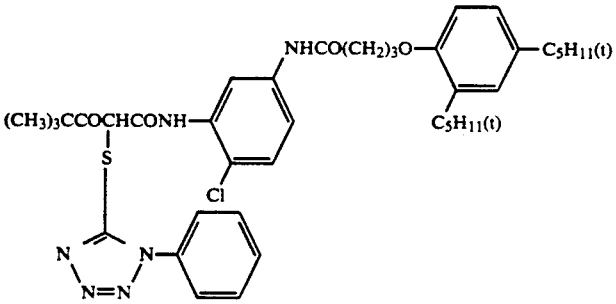
ExM-34

-continued
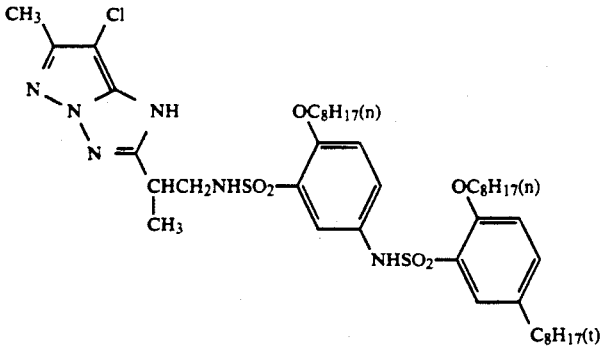
ExS-1
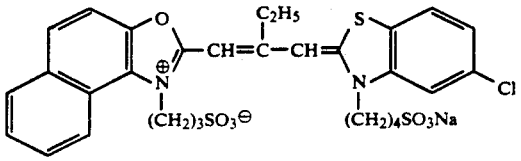
ExS-2
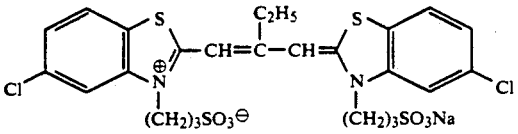
ExS-3
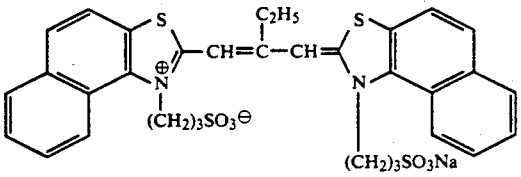
ExS-4
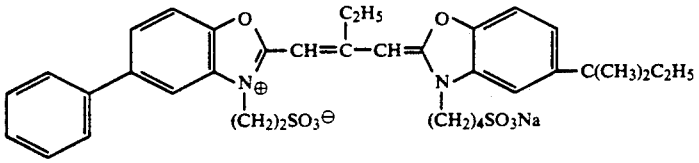
ExS-5
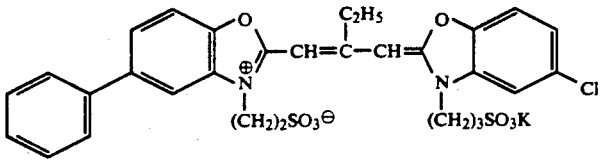
ExS-6
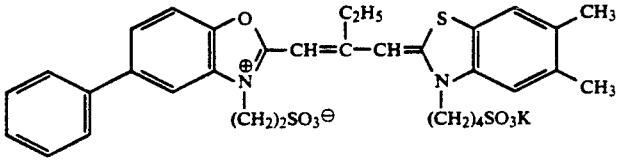
ExS-7

-continued

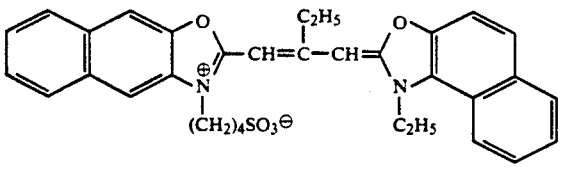

ExS-8

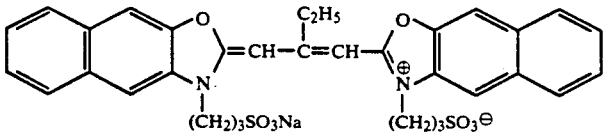

ExS-9

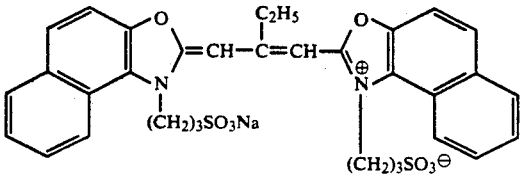

ExS-10

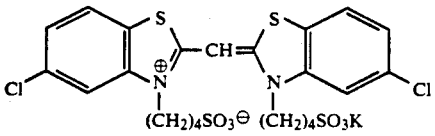

H-1

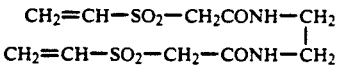

ExS-11

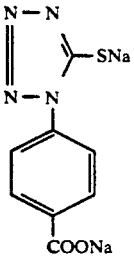

Sample 115

Coupler ExC-5 of the third layer of Sample 101 was replaced with 0.5 times its molar amount of ExC-18, Coupler ExY-11 of the sixth and seventh layers was replaced with 3 times its molar amount of ExY-19, and furthermore Coupler ExY-13 of the ninth, eleventh and twelfth layers was replaced with 3 times its molar amount of ExY-19; apart from this, the preparation was the same as for Sample 101.

Sample 116

The silver iodobromide emulsion A-1 of the fourth, seventh and twelfth layers of Sample 115 was replaced with B-2; apart from this, the preparation was the same as for Sample 115.

Sample 117

The silver iodobromide emulsion A-1 of the fourth, seventh and twelfth layers of Sample 115 was replaced with C-2; apart from this, the preparation was the same as for Sample 115.

Sample 118

Coupler ExC-18 of the third layer of Sample 117 was increased 4-fold in terms of the number of mols, and Coupler ExY-19 of the sixth and seventh layers was increased 3-fold in terms of the number of mols; apart from this, the preparation was the same as for Sample 117.

After these samples had been kept for 14 hours in conditions of 40° C. and 70% relative humidity, exposure was made for the purpose of sensitometry, and the following color development processing was carried out.

Density measurements were made with a red color filter, green color filter and blue color filter on the processed samples.

Treatment Method (1)

Color development was carried out according to the following treatment process at 38° C.

| | |
|---|---|
| Color Development | 3 minutes 15 seconds |
| Bleaching | 6 minutes 30 seconds |
| Water Wash | 2 minutes 10 seconds |
| Fixing | 4 minutes 20 seconds |
| Water Wash | 3 minutes 15 seconds |
| Stabilization | 1 minute 05 seconds |

The composition of the processing solution was as follows for each process.

| | |
|---|---|
| Color Development Solution: | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water added to | 1.0 l |
| pH | 10.0 |
| Bleach Solution: | |
| Ethylenediaminetetraacetic acid ferric ammonium salt | 100.0 g |
| Ethylenediaminetetraacetic acid disodium salt | 10.0 g |
| Ammonium bromide | 150.0 g |
| Ammonium nitrate | 10.0 g |
| Water added to | 1.0 l |
| pH | 6.0 |
| Fixing Solution: | |
| Ethylenediaminetetraacetic acid disodium salt | 1.0 g |
| Sodium sulfite | 4.0 g |
| Aqueous solution of ammonium thiosulfate (70%) | 175.0 ml |
| Sodium bisulfite | 4.6 g |
| Water added to | 1.0 l |
| pH | 6.6 |
| Stabilization Solution: | |
| Formaldehyde (40%) | 2.0 ml |
| Polyoxyethylene p-monononylphenyl ether (average degree of polymerization 10) | 0.3 g |
| Water added to | 1.0 l |

Next, after these samples had been kept for 14 hours under conditions of 40° C. and 70% relative humidity, photography of a Macbeth chart was carried out under daylight tungsten lighting, and the above-mentioned color development was performed. From the negatives of this photographed Macbeth chart, by matching the gray color on color paper (Fuji color paper AgL No. 653-258), printing was performed by hand, and 18 colors of the prints obtained were denoted by U* V* W* representative color series (explained hereinbelow). To represent how far each of these points had moved out of position from the original color point on the Macbeth chart, the average color difference $\overline{\Delta Euv}$ was calculated as defined by the following equation.

$$\overline{\Delta Euv} = \frac{\sum_{i=1}^{n}}{n} [(Upi - Uoi)^2 + (Vpi - Voi)^2 + (Wpi - Woi)^2]1/2$$

Here Up*i, Vp*i, Wp*i denote the value of the i-th U*, V*, W* of the Macbeth chart, on the color print; Uo*i, Vo*i, Wo*i denote the original U*, V*, W* of the Macbeth chart In order to assess the color reproduction of silver halide photosensitive materials, a comparison of the difference between the color obtained on color print paper by photographing and printing and the actual color of the sample is often used. As the color sample, the American Macbeth Corporation's make of Color Checker may be mentioned as a representative one; when the white, gray and black in this are reproduced on color print paper, to what extent the remaining 18 color patches can be accurately reproduced on color print paper, is quantitatively assessed by instrument measurements and sensory estimation. The quantitative test method for this color difference is instrument measurement of both colors; for examples, in Yoshinobu Naya et al., *Industrial Color Science*, (Asakura Booksellers), the photographed sample and the reproduced color print are both instrumentally measured under the same illumination conditions, and various proposals have been made by many researchers on calculation of representative color values and color difference equations from the obtained tristimulus values.

In the present invention, color reproduction was quantitatively tested by means of the color difference equation proposed in a paper by David Eastwood published in Farbe Magazine, Vol. 24, No. 1, page 97 ff.

Further, the gray gradation on the paper was about r=1.25.

The results obtained on photographic performance and $\overline{\Delta Euv}$ values are shown in Table 4. With regard to the photographic performance results, the respective sensitivities of the red-sensitive layer, green-sensitive layer and blue-sensitive layer were recorded as relative sensitivity, taking the sensitivity of Sample 101 as 100.

TABLE 4

| Sample | Red-Sensitive Layer Sensitivity | Green-Sensitive Layer Sensitivity | Blue-Sensitive Layer Sensitivity | $\overline{\Delta Euv}$ |
|---|---|---|---|---|
| 101 (1)* | 100 | 100 | 100 | 8.9 |
| 102 (2) | 115 | 117 | 110 | 8.2 |
| 103 (2) | 128 | 130 | 120 | 7.6 |
| 104 (2) | 125 | 125 | 117 | 7.4 |
| 105 (2) | 113 | 115 | 109 | 8.3 |
| 106 (2) | 125 | 125 | 118 | 7.9 |
| 107 (2) | 120 | 122 | 114 | 7.8 |
| 108 (1) | 75 | 76 | 73 | 8.6 |
| 109 (1) | 85 | 87 | 84 | 8.0 |
| 110 (1) | 70 | 72 | 71 | 8.3 |
| 111 (1) | 82 | 80 | 76 | 7.7 |
| 112 (1) | 102 | 101 | 94 | 8.6 |
| 113 (2) | 109 | 109 | 108 | 7.9 |
| 114 (2) | 115 | 116 | 115 | 7.8 |
| 115 (1) | 102 | 105 | 100 | 15.2 |
| 116 (1) | 130 | 133 | 121 | 18.4 |
| 117 (1) | 127 | 125 | 119 | 18.3 |
| 118 (1) | 100 | 108 | 98 | 10.3 |

*(1): Comparison example
(2): Present invention

Samples 108 to 111, in which were used silver halide grains of other than the present invention, have low sensitivity when compared with standard Samples 101, 112. Samples 102 to 107, 113, 114, 116, 117, using the silver halide grains used in the present invention, in comparison with standard Samples 101, 112, 115, had high sensitivity, further, graininess was also equal or above. Furthermore, Samples 101 to 114 which possess the DIR couplers shown in general formula (I) of the present invention, in comparison with comparative example Samples 115 to 118, which do not contain the DIR couplers shown in general formula (I), had a smaller value for the average color difference $\Delta\overline{Euv}$; they are recognized as having faithful color reproduction with high chroma. Further, by means of the DIR couplers shown in general formula (I), the improved results in color reproduction are conspicuous for the silver halide grains of the present invention (the difference in $\Delta\overline{Euv}$ of Samples 103 and 116, and the difference in $\Delta\overline{Euv}$ of Samples 106 and 117, is greater than the difference in $\Delta\overline{Euv}$ of Samples 101 and 115). Accordingly, with the combined use of the silver halide grains of the present invention and the DIR couplers shown in general formula (I), the sensitivity/grain ratio and color reproduction in Samples 102 to 107, 113, 114 of the present invention are both recognized to be conspicuously improved results.

Furthermore, among the samples of the present invention, Samples 103, 104, 106, 107, 114, in which sulfur-containing silver halide solvents were utilized, showed particularly desirable results.

Furthermore, the samples before exposure kept for 3 days under conditions of 45° C. and 80% relative humidity were used for separation exposure and development processing at the same time as samples which had not been kept under these conditions; as against the large change due to the difference in storage conditions for standard Samples 101, 112, Samples 102 to 107, 113, 114 of the present invention showed excellent results in that there was hardly any influence of the storage conditions.

EXAMPLE 2

Sample 103 was cut to a width of 35 mm, and after performing photography in a standard manner, it was processed using the processing method (2) as described below, using an automatic developing machine, until the cumulative replenishment amount of color development solution had reached 3 times the capacity of its mother solution tank.

| Treatment Method (2) | | | | |
|---|---|---|---|---|
| Process | Treatment Time | Treatment Temperature (°C.) | Replenishment Amount (ml) | Tank Capacity (l) |
| Color Development | 3 min 15 sec | 38 | 15 | 20 |
| Bleaching | 6 min 30 sec | 38 | 10 | 40 |
| Water Wash | 2 min 10 sec | 35 | 10 | 20 |
| Fixing | 4 min 20 sec | 38 | 20 | 30 |
| Water Wash (1) | 1 min 05 sec | 35 | Counter-current flow pipe system from (2) to (1) | 10 |
| Water Wash (2) | 1 min 00 sec | 35 | 20 | 10 |
| Stabilization | 1 min 05 sec | 38 | 10 | 10 |
| Drying | 4 min 20 sec | 55 | | |

Replenishment amounts are for 35 mm width, per 1 m length.

The compositions of the processing solutions are as follows:

| | Mother Solution (g) | Replenishment Solution (g) |
|---|---|---|
| Development Solution: | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.9 |
| Potassium carbonate | 30.0 | 30.0 |
| Potassium bromide | 1.4 | — |
| Potassium iodide | 1.5 mg | — |
| Hydroxylamine sulfate | 2.4 | 3.6 |
| 4-(N-Ethyl-N-β-hydroxyethylamino)-2-methylaniline sulfate | 4.5 | 7.2 |
| Water to make | 1.0 l | 1.0 l |
| pH | 10.05 | 10.10 |
| Bleach Solution: | | |
| Ethylenediaminetetraacetic acid ferrous sodium salt.$3H_2O$ | 100.0 | 140.0 |
| Ethylenediaminetetraacetic acid disodium salt | 10.0 | 11.0 |
| Ammonium bromide | 140.0 | 180.0 |
| Ammonium sulfate | 30.0 | 40.0 |
| Aqueous ammonia (27%) | 6.5 ml | 2.5 ml |
| Water to make | 1.0 l | 1.0 l |
| pH | 6.0 | 5.5 |
| Fixing Solution: | | |
| Ethylenediaminetetraacetic acid disodium salt | 0.5 | 1.0 |
| Sodium sulfite | 7.0 | 12.0 |
| Sodium bisulfite | 5.0 | 9.5 |
| Ammonium thiosulfate aqueous solution (70%) | 170.0 ml | 240.0 ml |
| Water to make | 1.0 l | 1.0 l |
| pH | 6.7 | 6.6 |

Water Wash Solution: Mother Solution, Replenishment Solution

City water was treated by passing it through a mixed bed type column packed with an H-form strong acid cation exchange resin (Rohm and Haas make, Amberlite IR-120B) and an OH-form anion exchange resin (same, Amberlite IR-400), reducing calcium and magnesium concentrations to below 3 mg/liter, then sodium dichloroisocyanurate (20 mg/liter) and sodium sulfate (150 mg/liter) were added.

The pH of this solution was in the range 6.5 to 7.5.

| | Mother Solution (g) | Replenishment Solution (g) |
|---|---|---|
| Stabilizing Solution: | | |
| Formaldehyde (37%) | 2.0 ml | 3.0 ml |
| Polyoxyethylene-p-monononylphenyl ether (average degree of polymerization 10) | 0.3 | 0.45 |
| Ethylenediaminetetraacetic acid disodium salt | 0.05 | 0.08 |
| Water to make | 1.0 l | 1.0 l |
| pH | 5.0–8.0 | 5.0–8.0 |

After the above process, the treatment process of Example 1, apart from treatment by the above-mentioned treatment method (2), was performed similarly, and the same kind of results were obtained as for Example 1.

EXAMPLE 3

ExM-8 used in the seventh layer of Samples 101 to 104 of Example 1, was replaced with an equimolar amount of ExM-20, and Samples 201 to 204 were prepared.

ExM-20

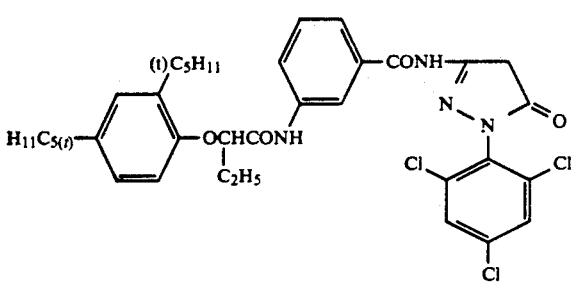

Sensitometry exposures were performed on the above samples similarly to Example 1; the green-sensitive layer sensitivity obtained and the average color difference $\Delta\overline{Euv}$, obtained as in Example 1, are shown in Table 5.

TABLE 5

| Sample No. | Green-Sensitive Layer Sensitivity | $\Delta\overline{Euv}$ |
|---|---|---|
| 101 Comparison Example | 100 | 8.9 |
| 102 Present Invention | 117 | 8.2 |
| 103 Present Invention | 130 | 7.6 |
| 104 Present Invention | 125 | 7.4 |
| 201 Comparison Example | 92 | 8.6 |
| 202 Present Invention | 97 | 8.0 |
| 203 Present Invention | 102 | 7.5 |
| 204 Present Invention | 100 | 7.2 |

The results in Table 5 show that the present invention is particularly remarkable in combination with a 2-equivalent coupler.

EXAMPLE 4

Octagonal monodispersed silver iodobromide core grains having an iodine content of 24 mol% were prepared by the control double jet method in the presence of ammonia. An aqueous solution (500 cc) containing 100 g of $AgNO_3$ and 500 cc of an aqueous solution containing KBr and KI were added into 1,000 cc of an aqueous solution containing 3% of gelatin and 45 cc of 25% $NH_3$. At a reaction temperature of 70° C., the silver potential was controlled at 10 mV; the flow amount was accelerated such that it finally became 4 times the initial flow amount. After the above-mentioned emulsions had been washed with water, addition of a pure silver bromide shell was performed by means of a control double jet method until the silver amount of the core part and shell parts became equal. An aqueous solution containing 100 g of $AgNO_3$ (500 cc) and an aqueous solution containing KBr (500 cc) were simultaneously added in the reaction vessel. At a reaction temperature of 75° C., the silver potential was controlled at −20 mV, and the flow amount was accelerated to finally became 2 times the initial flow amount. The obtained grains had an octagonal form of an average size of 1.9 μm. By X-ray diffraction, there was observed 2 peaks in the diffraction angle corresponding to the lattice constants of about 22 mol% and about 2 mol% silver iodobromide, establishing that there was a 2-fold silver iodobromide structure of a total silver iodide content of 12 mol%. This emulsion was called K.

By a method similar to that of Emulsion K, exchanging KI for an equimolar amount of KBr, Emulsions L to P as shown in Table 6 were prepared.

Emulsions K to P were chemically sensitized using sodium thiosulfate, potassium chloroaurate, and sulfur-containing silver halide solvent SSS-1 (structural formula is given hereinbefore) at an exposure of 1/100" to show optimum sensitivity.

The silver iodobromide emulsion of the twelfth layer of Sample 101 of Example 1 was replaced, and Samples 301 to 306 were respectively prepared by coating of 1.5 g/m² of Emulsions K to P.

Sensitometric exposure of the above samples similarly to Example 1 was performed; the blue-sensitive layer sensitivity obtained and the average color difference value $\Delta\overline{Euv}$ obtained in a similar way to Example 1 are shown in Table 7. The sensitivity of Sample 301 was taken as 100.

TABLE 6

| Emulsion Name | Grain Size (spherical equivalent diameter) (μm) | Core/Shell Ratio (volume ratio) | Iodine Content Core/Shell | Average Iodine Content (%) | Surface Iodine Content (XPS) |
|---|---|---|---|---|---|
| K Comparative Example | 1.9 | 1/1 | 22/2 | 12 | 3.2 |
| L Present Invention | 1.9 | 1/1 | 19/3 | 12 | 6.7 |
| M Present Invention | 1.9 | 1/1 | 22/2* | 12.1 | 7.3 |
| N Comparative Example | 1.9 | 1/1 | 8/2 | 5 | 2.5 |
| O Comparative Example | 1.9 | 1/1 | 8/5 | 6.5 | 6.3 |
| P Comparative Example | 1.9 | 1/1 | 8/2* | 5.1 | 6.5 |

*After Emulsions M and P had been manufactured in the same way as Emulsions K and N respectively, manufacture was by the addition of an aqueous solution of potassium iodide at the time when silver nitrate addition had been completed.

TABLE 7

| Sample No. | Blue-Sensitive Layer Sensitivity | $\overline{\Delta Euv}$ |
|---|---|---|
| 301 Comparative Example | 100 | 9.2 |
| 302 Present Invention | 115 | 8.8 |
| 303 Present Invention | 109 | 8.7 |
| 304 Comparative Example | 75 | 9.3 |
| 305 Present Invention | 80 | 8.6 |
| 306 Present Invention | 79 | 8.9 |

It can be seen from the results in Table 7 that Samples 302, 303, 305 and 306 of the present invention had a higher sensitivity than standard Samples 301, 304; graininess was also the same or higher.

In particular, desirable results were obtained in Samples 302, 303, having a high total iodine content.

EXAMPLE 5

Octagonal monodispersed silver iodobromide core grains having a 14 mol% silver iodide content were prepared in the presence of ammonia by the controlled double jet method. An aqueous solution of 100 g of $AgNO_3$ (500 cc) and 500 cc of an aqueous solution containing KBr and KI were added into 1,000 cc of an aqueous solution containing 3% of gelatin and 10 cc of 25% $NH_3$. At a reaction temperature of 60° C., the silver potential was controlled at 10 mV, and the initial flow amount was accelerated to a 4-fold final flow amount. After the above-mentioned emulsion had been washed with water, addition of a pure silver bromide shell was performed by means of the control double jet method until the silver contents of the core part and the shell part became equal. An aqueous solution containing 100 g $AgNO_3$ (500 cc) and 500 cc of an aqueous solution of KBr were simultaneously added. At a reaction temperature of 75° C., the silver potential was controlled at −20 mV, and as against the initial flow amount, the flow amount was accelerated to a 2-fold final flow amount. The grains obtained had an octagonal shape of an average size of 0.7 μm. By X-ray diffraction, there was observed 2 peaks in diffraction angle corresponding to the lattice constants of about 22 mol% and about 2 mol% silver iodobromide, establishing that there was a 2-fold silver iodobromide structure of a total silver iodide content of 12 mol%. This emulsion was called Q.

By a similar method as for Emulsion Q, but with replacement of KI with an equimolar amount of KBr, or of KBr with an equimolar amount of KI, and furthermore by addition of an aqueous solution of potassium iodide after the conclusion of silver nitrate addition, Emulsions Q to T as shown in Table 8 were prepared.

Multilayer color sensitive Sample 401 was prepared by multilayer coating to a cellulose triacetate support, prepared with an undercoat, of the various layers of compositions as shown below.

Photosensitive Layer Composition

The numbers corresponding to the various components show the coated amounts in g/m² or, with regard to the silver halide, the coated amount expressed as silver. However, the sensitizing dyes are shown as a coated amount in molar units per mol of silver halide in the same layer.

| | |
|---|---|
| Layer 1: Antihalation Layer | |
| Black colloidal silver | 0.2 |
| Gelatin | 2.6 |

-continued

| | |
|---|---|
| Cpd-8 | 0.2 |
| Solv-5 | 0.02 |
| Layer 2: Intermediate Layer | |
| Fine grain silver bromide (average grain diameter 0.07 μm) | 0.15 |
| Gelatin | 1.0 |
| Layer 3: Low Sensitivity Red-Sensitive Emulsion Layer | |
| Monodispersed silver iodobromide emulsion (silver iodide 5.5 mol %, average grain diameter 0.3 μm, coefficient of variation of grain diameter (abbreviated below simply as coefficient of variation) 19%). | 1.5 |
| Gelatin | 3.0 |
| ExS-12 | $2.0 \times 10^{-4}$ |
| ExS-13 | $1.0 \times 10^{-4}$ |
| ExS-14 | $0.3 \times 10^{-4}$ |
| ExC-21 | 0.7 |
| ExC-22 | 0.1 |
| ExC-23 | 0.02 |
| Cpd-6 | 0.01 |
| Solv-5 | 0.8 |
| Solv-6 | 0.2 |
| Solv-8 | 0.1 |
| Layer 4: High Sensitivity Red-Sensitive Emulsion Layer | |
| Monodispersed silver iodobromide emulsion (Emulsion T, average grain diameter 0.68 μm, coefficient of variation 18%) | 1.2 |
| Gelatin | 2.5 |
| ExS-12 | $3 \times 10^{-4}$ |
| ExS-13 | $1.5 \times 10^{-4}$ |
| ExS-14 | $0.45 \times 10^{-4}$ |
| ExC-24 | 0.15 |
| ExC-25 | 0.05 |
| ExC-22 | 0.03 |
| ExC-23 | 0.01 |
| Solv-5 | 0.05 |
| Solv-6 | 0.3 |
| Layer 5: Intermediate Layer | |
| Gelatin | 0.8 |
| Cpd-7 | 0.05 |
| Solv-7 | 0.01 |
| Layer 6: Low Sensitivity Green-Sensitive Emulsion Layer | |
| Monodispersed silver iodobromide emulsion (silver iodide 5 mol %, average grain diameter 0.3 μm, coefficient of variation 19%) | 0.4 |
| Monodispersed silver iodobromide emulsion (silver iodide 7 mol %, average grain diameter 0.5 μm) | 0.8 |
| Gelatin | 3.0 |
| ExS-15 | $1 \times 10^{-4}$ |
| ExS-16 | $4 \times 10^{-4}$ |
| ExS-17 | $1 \times 10^{-4}$ |
| ExM-26 | 0.2 |
| ExM-27 | 0.4 |
| ExM-28 | 0.16 |
| ExC-29 | 0.05 |
| Solv-6 | 1.2 |
| Solv-8 | 0.05 |
| Solv-9 | 0.01 |
| Layer 7: High Sensitivity Green-Sensitive Emulsion Layer | |
| Polydispersed silver iodobromide emulsion (Emulsion T, average grain diameter 0.68 μm, coefficient of variation 18%) | 0.9 |
| Gelatin | 1.6 |
| ExS-15 | $0.7 \times 10^{-4}$ |
| ExS-16 | $2.8 \times 10^{-4}$ |
| ExS-17 | $0.7 \times 10^{-4}$ |
| ExM-27 | 0.05 |
| ExM-28 | 0.04 |
| ExC-29 | 0.01 |
| Solv-5 | 0.08 |
| Solv-6 | 0.3 |
| Solv-8 | 0.03 |
| Layer 8: Yellow Filter Layer | |
| Yellow colloid silver | 0.2 |
| Gelatin | 0.9 |

-continued

| | |
|---|---|
| Cpd-7 | 0.2 |
| Solv-6 | 0.1 |
| Layer 9: Low Sensitivity | |
| Blue-Sensitive Emulsion layer | |
| Monodispersed silver iodobromide emulsion (silver iodide 6 mol %, average grain diameter 0.3 μm, coefficient of variation 20%) | 0.4 |
| Monodispersed silver iodobromide emulsion (silver iodide 5 mol %, average grain diameter 0.6 μm, coefficient of variation 17%) | 0.4 |
| Gelatin | 2.9 |
| ExS-18 | $1 \times 10^{-4}$ |
| ExS-19 | $1 \times 10^{-4}$ |
| ExY-30 | 1.2 |
| ExC-23 | 0.05 |
| Solv-6 | 0.4 |
| Solv-8 | 0.1 |
| Layer 10: High Sensitivity | |
| Blue-Sensitive Emulsion Layer | |
| Monodispersed silver iodobromide emulsion (silver iodide 6 mol %, average grain diameter 1.5 μm, coefficient of variation 14%) | 0.5 |
| Gelatin | 2.2 |
| ExS-18 | $5 \times 10^{-5}$ |

-continued

| | |
|---|---|
| ExS-19 | $5 \times 10^{-5}$ |
| ExY-30 | 0.4 |
| ExC-23 | 0.02 |
| Solv-6 | 0.1 |
| Layer 11: First Protective Layer | |
| Gelatin | 1.0 |
| Cpd-8 | 0.1 |
| Cpd-9 | 0.1 |
| Cpd-10 | 0.1 |
| Cpd-11 | 0.1 |
| Solv-5 | 0.1 |
| Solv-8 | 0.1 |
| Layer 12: Second Protective Layer | |
| Fine grain silver bromide emulsion (average grain diameter 0.07 μm) | 0.25 |
| Gelatin | 1.0 |
| Polymethyl methacrylate grains (diameter 1.5 μm) | 0.2 |
| Cpd-13 | 0.5 |

Apart from these, Surfactant Cpd-12, Film Hardener H-2 were added.

The sample prepared as above was called Sample 401.

ExS-12

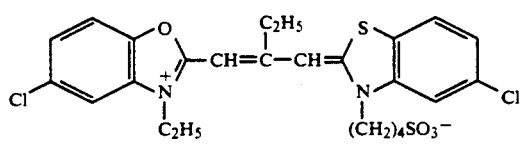

ExS-13

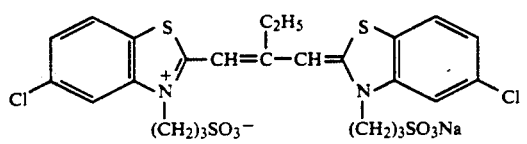

ExS-14

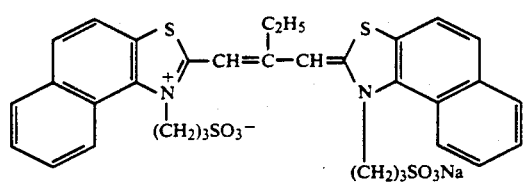

ExS-20

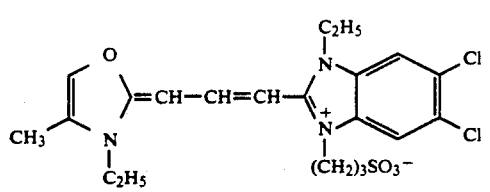

ExS-15

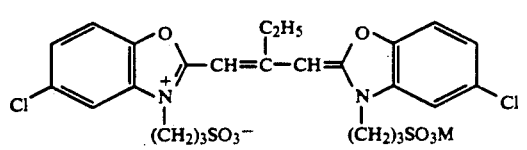

ExS-16

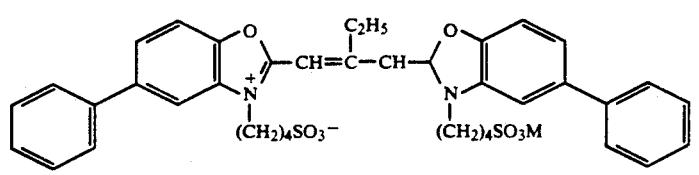

-continued
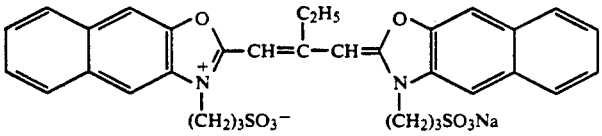
ExS-17
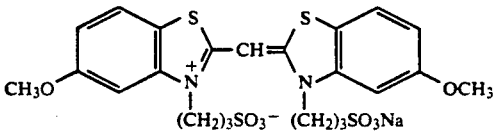
ExS-18
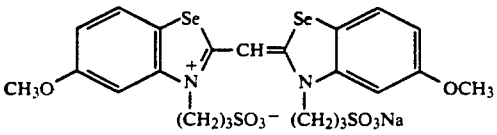
ExS-19
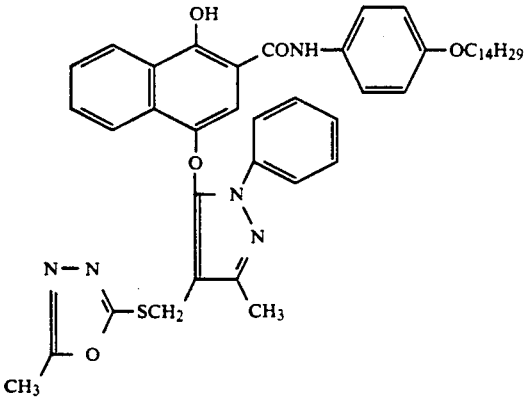
ExC-23
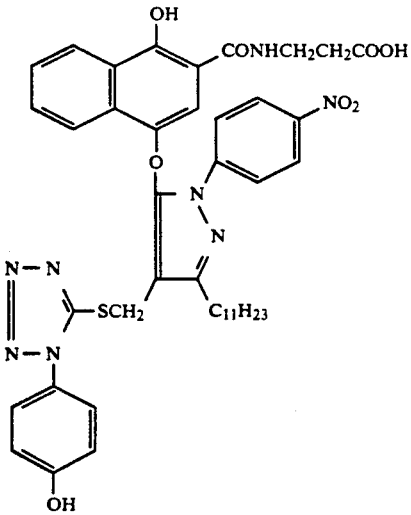
ExC-29

-continued
Cpd-6
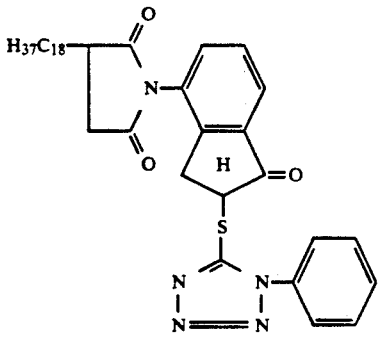
ExC-24
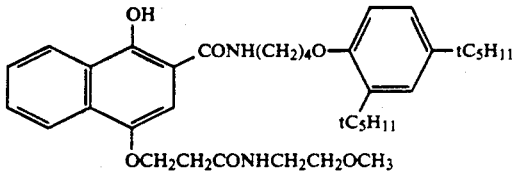
ExC-25
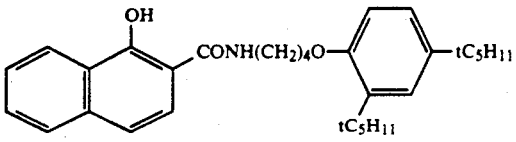
ExC-21
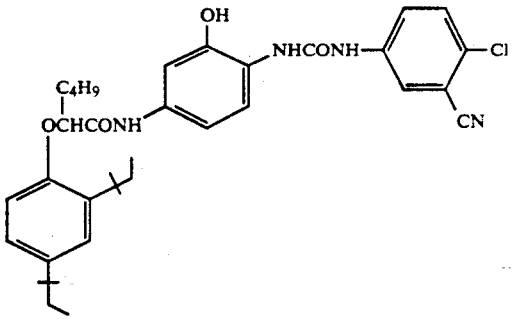
ExC-22
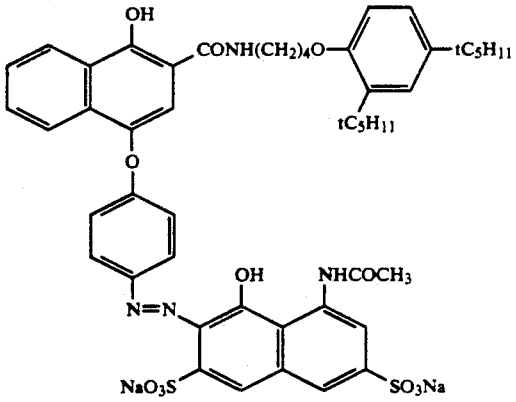

-continued
ExM-26
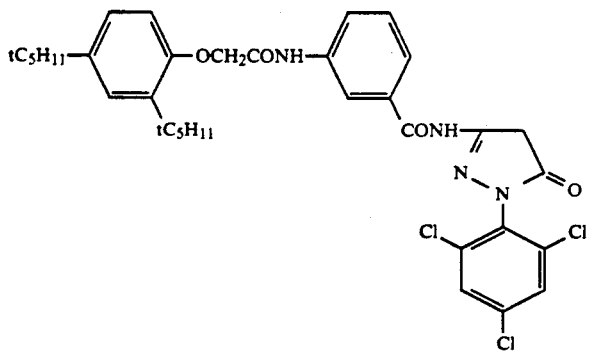
ExM-27
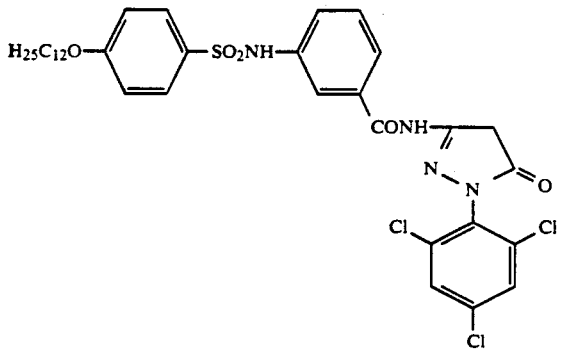
ExM-28
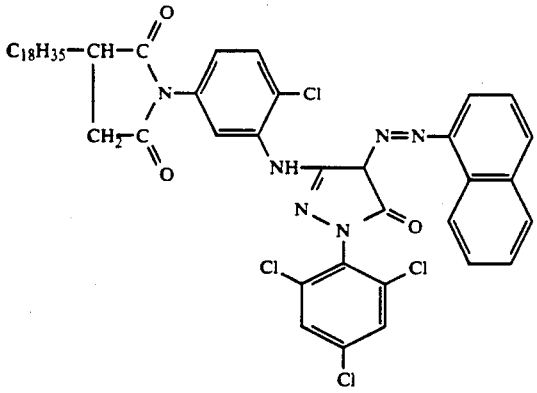
ExY-30
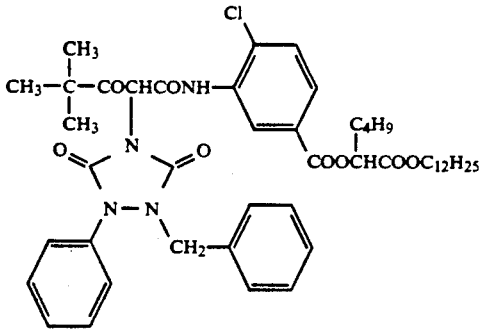

-continued
ExC-31
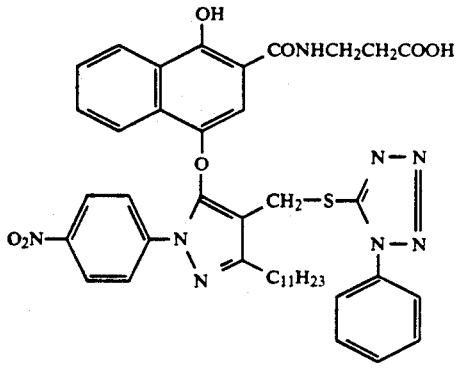
ExC-32
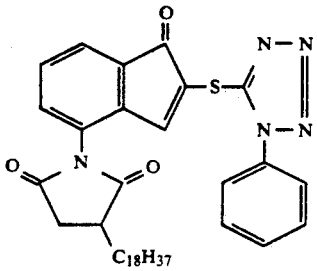
Cpd-8
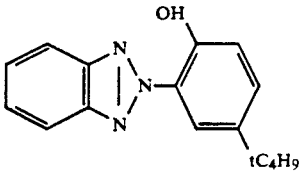
Cpd-9
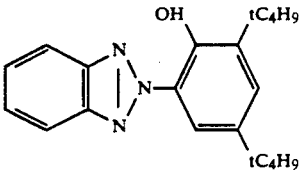
Cpd-10
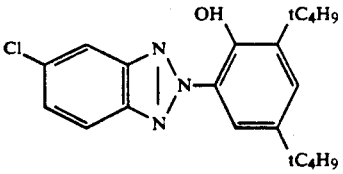
Cpd-11
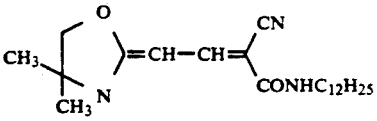
Solv-7
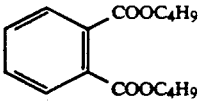
Solv-6
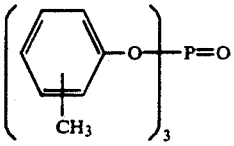

-continued

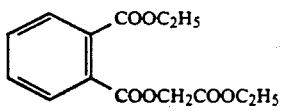

Solv-8

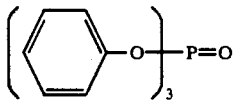

Solv-9

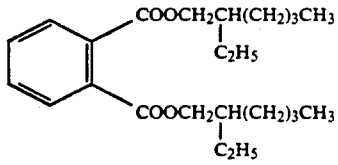

Solv-5

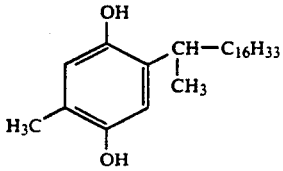

Cpd-7

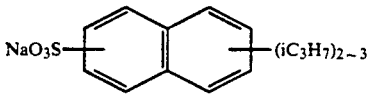

Cpd-12

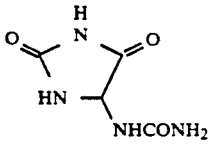

Cpd-13

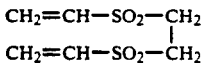

H-2

Sample 402

In Sample 401, in layer 3, Coupler ExC-23 was made 1.4 times as large, 0.013 mol of Coupler ExM-26 per mol of silver was added, and the mount of silver coated was made 1.1 times as large; in layer 9, Coupler ExY-30 was made 1.15 times as large; and in layer 10, Coupler ExY-30 was made 1.1 times as large; otherwise, the preparation was the same as for Sample 401.

Sample 403

In Sample 401, in layer 3, Coupler ExY-30 was added in a proportion of 0.030 mol per mol of silver; in layer 9, Coupler ExY-30 was decreased to 0.18 mols per mol of silver; and in layer 10, Coupler ExY-30 was decreased to 0.041 mol/mol of silver; otherwise the preparation was the same as for Sample 401.

Sample 404

In Sample 401, in layer 3, Coupler ExC-23 was made 1.6 times the amount, 0.07 mol of Coupler ExY-30 per mol of silver was added, and the amount of silver coated was made 1.15 times as large; in layer 6, Couplers ExM-26, ExM-27 and ExM-28 were made 1.25 times as large; and in layer 7, Couplers ExM-27 and ExM-28 were made 1.15 times as large; otherwise the preparation was the same as for Sample 401.

Sample 405

Respectively, 0.01 mol and 0.008 mol per mol of silver of Couplers ExM-26 and ExM-27 were added to layer 3, a reduced amount of 0.016 mol and 0.32 mol per mol of silver of Couplers ExM-26 and ExM-27 were added to layer 6, and a reduced amount of 0.01 mol and 0.007 mol per mol of silver of Couplers ExM-27 and ExM-28 were added to layer 7, of Sample 401; otherwise the preparation was the same as for Sample 401.

Sample 406

In layer 6, Couplers ExM-26 and ExM-27 were made 1.5 times the amount in Sample 401, 0.02 mol per mol of silver of Coupler ExC-21 was added, and the amount of silver coated was made 1.15 times the amount; in layer 9, Coupler ExY-30 was made 1.15 times the amount; and in layer 1, Coupler ExY-30 was made 1.05 times the amount; otherwise the preparation was the same as for Sample 401.

Sample 407

Coupler ExC-23 in layer 6 of Sample 401 was added as 0.028 mol per mol of silver, Coupler ExY-30 in layer 9 was reduced to 0.23 mol per mol of silver and Coupler ExY-30 in layer 10 was reduced to 0.052 mol per mol of silver; otherwise the preparation was the same as for Sample 401.

Sample 408

In Sample 401, in layer 6, Coupler ExC-29 was made 1.7 times larger, 0.032 mol of Coupler ExY-30 per mol of silver was added, and the amount of silver coated was made 1.2 times larger; in layer 3, Coupler ExC-21 was made 1.25 times larger; and in layer 4, Coupler ExC-21 was made 1.15 times larger; otherwise the preparation was the same as for Sample 401.

Sample 409

In Sample 401, in layer 6, 0.027 mol of Coupler ExC-21 was added per mol of silver; in layer 3, the amount of Coupler ExC-21 was decreased to 0.081 mol per mol of silver; in layer 4, the amount of Coupler ExC-21 was decreased to 0.036 mol per mol of silver; otherwise the preparation was the same as for Sample 401.

Sample 410

In Sample 401, in layer 9, Coupler ExC-23 was made 1.3 times larger, 0.01 mol of Coupler ExC-21 per mol of silver was added, and the amount of silver applied was made 1.15 times larger; in layer 6, Couplers ExM-26 and ExM-27 were made 1.20 times larger; and in layer 7, Couplers ExM-26 and ExM-27 were made 1.10 times larger; otherwise the preparation was the same as for Sample 401.

Sample 411

In Sample 401, in layer 9, respectively 0.02 mol of Coupler ExM-26 and 0.02 mol of Coupler ExM-27 per mol of silver were added; in layer 6, the amounts of Couplers ExM-26 and ExM-27 per mol of silver were reduced to 0.015 mol and 0.03 mol, respectively; and in layer 7, the amounts of Couplers ExM-26 and ExM-27 per mol of silver were respectively reduced to 0.01 mol and 0.01 mol; otherwise the preparation was the same as for Sample 401.

Sample 412

In Sample 401, in layer 9, Coupler ExC-23 was eliminated; in layer 3, Coupler ExC-21 was made 1.20 times larger; and in layer 4, Coupler ExC-21 was made 1.10 times larger; otherwise the preparation was the same as for Sample 401.

Sample 413

In Sample 401, in layer 9, the amount of Coupler ExC-21 was made 0.065 mol per mol of silver; in layer 3, Coupler ExC-21 was decreased to 0.08 mol per mol of silver; and in layer 4, Coupler ExC-21 was decreased to 0.032 mol per mol of silver; otherwise the preparation was the same as for Sample 401.

Sample 414

In Sample 401, in layers 4 and 7, the monodispersed silver iodobromide emulsion was changed from Emulsion T to Emulsion S; otherwise the preparation was the same as for Sample 401.

Sample 415

In Sample 401, in layers 4 and 7, the monodispersed silver iodobromide emulsion was changed from Emulsion T to Emulsion Q; otherwise the preparation was the same as for Sample 401.

Sample 416

In Sample 401, in layers 4 and 7, the monodispersed silver iodobromide emulsion was changed from Emulsion T to Emulsion R; otherwise the preparation was the same as for Sample 401.

Sample 417

In Sample 401, in layers 3 and 4, ExS-12 was made 0.7 times smaller, and ExS-13 was made 3 times larger; otherwise the preparation was the same as for Sample 401.

Sample 418

In Sample 401, in layers 6 and 7, ExS-15 was made 0.8 times smaller, and ExS-17 was made 1.3 times larger; otherwise the preparation was the same as for Sample 401.

Sample 419

In Sample 401, in layer 9, ExS-18 and ExS-19 were made 0.8 times smaller, and $1.0\times10^{-5}$ mol of ExS-10 per mol of silver was added; and in layer 10, ExS-18 and ExS-19 were made 0.8 times larger, and $8.0\times10^{-6}$ mol of ExS-10 per mol of silver was added; otherwise the preparation was the same as for Sample 401.

Sample 420

In the Sample 401, in layers 3 and 4, ExS-12 was made 0.2 times larger, ExS-13, 3 times, and ExS-14, 7 times larger; otherwise the preparation was the same as for Sample 401.

Sample 421

In Sample 401, in layers 6 and 7, ExS-15 was made 0.6 times larger, and ExS-17 was made 1.6 times larger; otherwise the preparation was the same as for Sample 401.

Sample 422

In Sample 401, in layer 9, ExS-18 and ExS-19 were made 0.4 times larger, and $4.1\times10^{-5}$ mol of ExS-20 per mol of silver was added; in layer 10, ExS-18 and ExS-19 were made 0.4 times larger, and $2.8\times10^{-5}$ mol of ExS-10 per mol of silver was added; otherwise the preparation was the same as for Sample 401.

Sample 423

In Sample 401, in layers 3, 4, 9 and 10, ExC-23 was replaced by equimolar amounts of ExC-31; otherwise the preparation was the same as for Sample 401.

Sample 424

In Sample 401, in layers 3, 4, 9 and 10, ExC-23 was replaced by equimolar amounts of ExC-32; otherwise the preparation was the same as for Sample 401.

Sample 425

In Sample 423, in layers 4 and 7, the monodispersed silver iodobromide Emulsion T was replaced with Emulsion S; otherwise the preparation was the same as for Sample 423.

Sample 426

In Sample 401, in layers 9 and 10, ExC-23 was replaced with equimolar amounts of ExC-31; furthermore, in layer 7, Coupler ExM-27 was made 0.2 times larger, and Coupler ExM-28 was made 1.75 times larger; otherwise the preparation was the same as for Sample 401.

After these samples had been kept under conditions of 40° C., 70% relative humidity for 14 hours, exposures to white light of 4,800° K. for sensitometric purposes and photography of a Macbeth chart were performed; color development shown below was carried out.

The development processing used here was as follows.

| Treatment Method | | |
|---|---|---|
| Process | Treatment Time | Treatment Temperature (°C.) |
| Color Development | 3 min 15 sec | 38 |
| Bleaching | 1 min 00 sec | 38 |
| Bleach Fixing | 3 min 15 sec | 38 |
| Water Wash (1) | 40 sec | 35 |
| Water Wash (2) | 1 min 00 sec | 35 |
| Fixing | 40 sec | 38 |
| Drying | 1 min 15 sec | 55 |

The compositions of the treatment solutions are described below.

| | (Unit: g) |
|---|---|
| Color Development Solution: | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-Ethyl-N-hydroxyethylamino)-2-methylaniline sulfate | 4.5 |
| Water to make | 1.0 l |
| pH | 10.05 |
| Bleach Solution: | |
| Ethylenediaminetetraacetic acid ferrous ammonium dihydrate salt | 120.0 |
| Ethylenediaminetetraacetic acid disodium salt | 10.0 |
| Ammonium bromide | 100.0 |
| Ammonium sulfate | 10.0 |
| Bleach promotion agent | 0.005 mol |

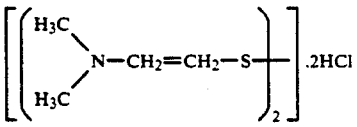

| | |
|---|---|
| Aqueous ammonia (27%) | 15.0 ml |
| Water to make | 1.0 l |
| pH | 6.3 |
| Bleach Fixing Solution: | |
| Ethylenediaminetetraacetic acid ferrous ammonium dihydrate salt | 50.0 |
| Ethylenediaminetetraacetic acid disodium salt | 5.0 |
| Sodium sulfite | 12.0 |
| Aqueous solution of ammonium thiosulfate (70%) | 240.0 ml |
| Aqueous ammonia (27%) | 6.0 ml |
| Water to make | 1.0 l |
| pH | 7.2 |

Water Wash Solution

City water was treated by passage through a column packed with an H-type strongly acidic cation exchange resin (Rohm & Haas make, Amberlite IR-120B) and an OH-type anion exchange resin (same maker, Amberlite IR-400), and the calcium and magnesium ion concentration was reduced to 3 mg/liter or below. Following this, 20 mg/liter of sodium dichloroisocyanurate and 150 mg/liter of sodium sulfate were added.

The pH of this solution is within the range 6.5 to 7.5.

| Stabilization Solution: | (Unit: g) |
|---|---|
| Formaldehyde (37%) | 2.0 ml |
| Polyoxyethylene-p-monononylphenyl ether (average degree of polymerization = 10) | 0.3 |
| Ethylenediaminetetraacetic acid disodium salt | 0.05 |
| Water to make | 1.0 l |
| pH | 5.0–8.0 |

Secondly, in order to evaluate the graininess of the red-sensitive layer and green-sensitive layer, the RMS was measured using an aperture 48 μm in diameter with a red filter and a green filter. The relative value of the RMS was determined at a fog concentration upwards of 0.2. A smaller value represents better graininess.

Thirdly, the above-mentioned multilayer effect evaluation exposure was performed and the above-mentioned color development processing was carried out.

Figure 2:
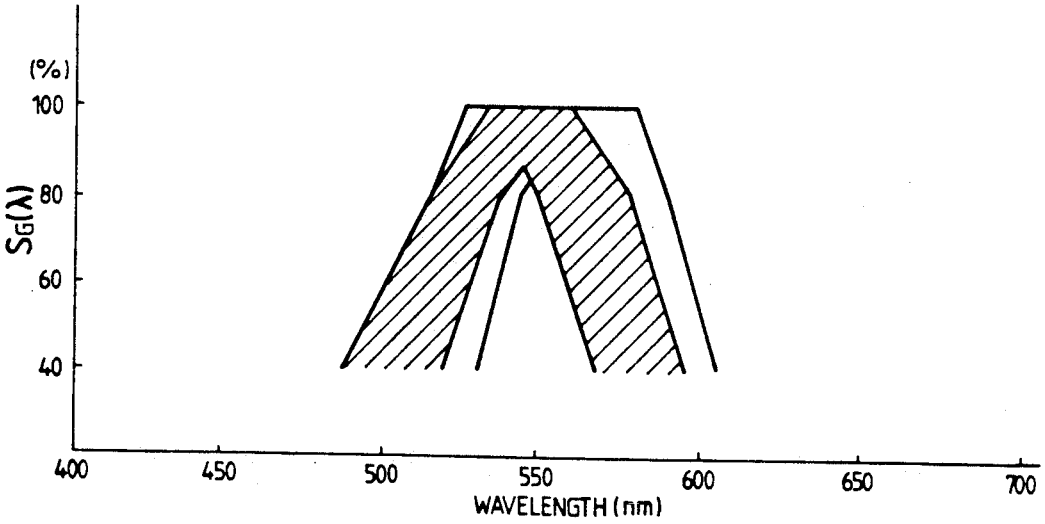
FIG. 2 shows, by way of the portion with oblique lines, the range of spectral sensitivity distribution of the green-sensitive layer, as stipulated in claim 3.
Figure 3:
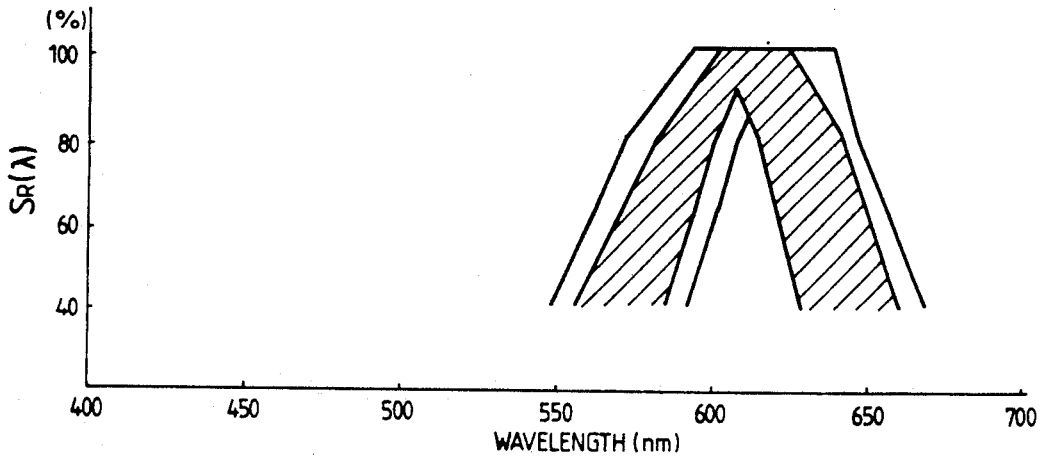
FIG. 3 shows, by way of the portion with oblique lines, the range of spectral sensitivity distribution of the red-sensitive layer, as stipulated in claim 3.
Figure 5:
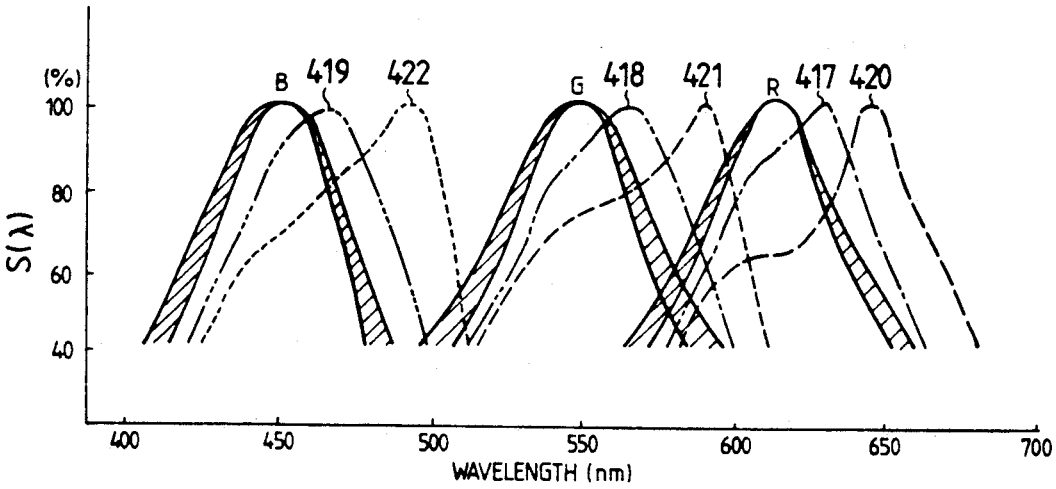
FIG. 5 is the spectral sensitivity distribution of Samples 401 to 426. The oblique line parts are the slightly changed width between Samples 401 to 416, 423 to 426; the portions with oblique lines represent the slightly changed width between Samples 401 to 416 and 423 to 426; - - - - and —·—·—·—respectively represent Samples 420 and 417 in which only the spectral sensitivity distribution of the red-sensitive layer changed in regard to the spectral sensitivity distribution of Samples 401 to 416 and 423 to 426; --------- and —··—··—··—respectively represent Samples 421 and 418 in which only the spectral sensitivity of the green-sensitive layer changed, and ..... and —···—···—···—respectively represent Samples 422 and 419 in which only the spectral sensitivity of the blue-sensitive layer changed. B, G, R, respectively, signify the blue-sensitive layer, green-sensitive layer, and red-sensitive layer.

The results of the above are shown in Table 9, and the spectral sensitivity distribution is shown in FIG. 5. Furthermore, the range of the spectral sensitivity distribution of each photosensitive layer, inductively derived from FIG. 5, is shown in FIGS. 1 to 3.

When the red light transmission density and green light transmission density of Samples 401 to 426, obtained by development processing as mentioned above, were measured using filters consistent with the spectral sensitivity distribution of Fuji color papers AGL #653–258, magenta and cyan color images possessing characteristic curves the same as in FIG. 4 were obtained.

In the case of the green-sensitive emulsion layer developed from the unexposed part (point A) to the exposed part (point B), the extent of the interlayer effect is shown by the Δx inhibition received by a uniformly fogged cyan emulsion layer.

Accordingly, in FIG. 4, the curve A-B shows the characteristic curve for magenta color development of the green sensitive layer; curve a-b shows the cyan color development density of the red-sensitive layer due to uniform red exposure. P shows the fog part of the magenta color development; Q shows the exposure (P+1.5) which provides the magenta color development density of fog density+Δy.

The difference of the cyan color development density (a) in exposure P and the cyan color development density (b) in exposure Q similarly was found and taken as Δx. The ratio (Δx/Δy) of the change in cyan color development density corresponding to the change in magenta color development density was the measure of the interlayer effect ($D_R/D_G$) from the green-sensitive layer to the red-sensitive layer In the case where the value of Δx is negative, an interlayer inhibition effect is acting; its magnitude is denoted by the negative value. Furthermore, in the case where Δx is positive, an interlayer inhibition effect is not acting (colors are turbid); its magnitude is denoted by the positive value.

In a similar manner, the interlayer effect was sought in relation to Samples 401 to 426 from the blue-sensitive layer to the red-sensitive layer, from the green-sensitive layer to the blue-sensitive layer, from the red-sensitive layer to the blue-sensitive layer, and from the red-sensitive layer to the green-sensitive layer.

The above-mentioned values are shown in Table 9.

As is clear from Table 9, Samples 401 to 413, 416 to 424, and 426, in comparison with Samples 414, 415 and 425 which used emulsion structures outside the scope of the present invention, have an excellent ratio of sensitivity/graininess of the silver halide emulsion layers, i.e., even though the grains are small, sensitivity which accompanies large grains is obtained; or at the same sensitivity the graininess is good.

Next, the Macbeth chart was photographed in daylight tungsten light and under a fluorescent lamp, with all of the conditions the same.

From the negatives of these Macbeth chart photographs, by matching the gray color on color paper (Fuji color paper AGL #653-258), hand-made prints were performed, and 18 colors of the prints obtained were denoted by the U*V*W* color system (explained below). In order to denote to what extent each of these points had shifted from the original chromaticity point of the Macbeth chart, the average dye $\Delta\overline{Euv}$ was calculated as defined in the following equation.

These results are shown in Table 10.

$$\Delta\overline{Euv} = \frac{\sum_{i=1}^{n}}{n} [(Upi - Uoi)^2 + (Vpi - Voi)^2 + (Wpi - Woi)^2]^{1/2}$$

Here Up*i, Vp*i, Wp*i denote the value of the i-th U*, V*, W* of the Macbeth chart, on the color print; Uo*i, Vo*i, Wo*i denote the original U*, V*, W* of the Macbeth chart.

In order to assess the color reproduction of the silver halide photosensitive materials, a well accepted method is photographing a color sample in practice, making prints and making a comparative investigation of the disparity of ,the color obtained on the color print paper. As the color sample, the United States Macbeth Corporation Color Checker may be mentioned as a representative one; in this there are white color, gray color and black color which, when reproduced on color print paper, the extent to which the remaining 18 color patches can be accurately reproduced on color print paper, is quantitatively assessed by instrument measurements and with sensory tests. The quantitative test method for this color difference is instrument measurement of both colors; for example, in Yoshinobu Naya et al., *Industrial Color Science* (Asakura Shoten) the photographed sample and the reproduced color print are both instrumentally measured under the same illumination conditions, and various proposals have been made by many researchers on calculation of representative color values and color difference equations from the tristimulus values obtained.

In the present invention, color reproduction was quantitatively tested by means of the color difference equation proposed in a paper by David Eastwood published in Farbe Magazine, Vol. 24, No. 1, page 97ff.

Further, the gray gradation on the paper was about r=1.25.

Table 10 gives the $\Delta\overline{Euv}$ under each light source, and respectively under each light source, the average color difference of the shift from the original color point. It is clear from Table 10 that Samples 401, 416 to 422, 426 of the present invention have a smaller average color difference $\Delta\overline{Euv}$ and exhibits more faithful color reproduction at higher chroma as compared with Samples 402 to 413 and 423 to 425, all of which have an interlayer effect which are outside of claim 2 of this invention.

Furthermore, compared with Samples 420 to 422 which are outside the scope of claim 3 of this invention, with the spectral sensitivity distribution of Samples 401 and 417 to 419, the value of the average color difference $\Delta\overline{Euv}$ is small in addition to which, the change in the average color difference photographed under tungsten lighting and fluorescent lighting, in respect to photography under daylight, is small, and a faithful reproduction at high chromaticity is shown. It will be understood that they are particularly excellent in that there is no change in color reproduction due to changes in the photographic light sources.

In Tables 9 and 10, Samples 401, 416 to 422, 426 of the present invention are excellent with regard to sensitivity/graininess ratio, in comparison with Samples 402 to 415, 423 to 425. Moreover, they show faithful color reproduction at high chroma, and the effects of the present invention are excellent. Furthermore, among them, Sample 401 is also more excellent with regard to high chroma than Sample 426; it is also better than Samples 417 to 422, in the point that the change in color reproduction due to a change in photographic light source is small.

TABLE 8

| Emulsion Name | Grain Size (sphere equivalent Diameter) (μm) | Iodine Content (mol %) Core/Shell/Surface | Average Iodine Content |
|---|---|---|---|
| Q (Comparative Example) | 0.70 | 22/2/3.2 | 12.0 |
| R (Present Invention) | 0.67 | 22/2/7.3 | 12.1 |
| S (Comparative Example) | 0.71 | 15/2/2.6 | 8.0 |
| T (Present Invention) | 0.68 | 15/2/6.0 | 8.1 |

Emulsions R and T, after having been prepared in the same manner as Emulsion Q and S, are prepared by addition of an aqueous solution of potassium iodide at the termination of silver nitrate addition.

TABLE 9

| Sample No. | Emulsion of Layer 4, Layer 7 | Interlayer Effect | | | | | | 4,800°K White Exposure Sensitivity (relative value) | | RMS Value (relative value) | |
|---|---|---|---|---|---|---|---|---|---|---|---|
| | | $(D_B/D_R)$ | $(D_G/D_R)$ | $(D_B/D_G)$ | $(D_R/D_G)$ | $(D_G/D_B)$ | $(D_R/D_B)$ | Red-Sensitive Layer | Green-Sensitive Layer | Red-Sensitive Layer | Green-Sensitive Layer |
| 401 (Invention) | T | −0.03 | −0.30 | −0.19 | −0.30 | −0.19 | +0.10 | 108 | 107 | 84 | 82 |

TABLE 9-continued

| Sample No. | Emulsion of Layer 4, Layer 7 | Interlayer Effect | | | | | | 4,800°K White Exposure Sensitivity (relative value) | | RMS Value (relative value) | |
|---|---|---|---|---|---|---|---|---|---|---|---|
| | | $(D_B/D_R)$ | $(D_G/D_R)$ | $(D_B/D_G)$ | $(D_R/D_G)$ | $(D_G/D_B)$ | $(D_R/D_B)$ | Red-Sensitive Layer | Green-Sensitive Layer | Red-Sensitive Layer | Green-Sensitive Layer |
| 402 (Invention) | T | −0.20 | −0.31 | −0.14 | −0.32 | −0.16 | +0.11 | 104 | 106 | 80 | 81 |
| 403 (Invention) | T | +0.26 | −0.27 | −0.21 | −0.35 | −0.17 | +0.08 | 109 | 104 | 85 | 79 |
| 404 (Invention) | T | −0.06 | −0.78 | −0.19 | −0.24 | −0.18 | +0.07 | 110 | 108 | 86 | 83 |
| 405 (Invention) | T | −0.04 | +0.03 | −0.18 | −0.34 | −0.20 | +0.10 | 105 | 105 | 81 | 80 |
| 406 (Invention) | T | −0.05 | −0.31 | −0.52 | −0.32 | −0.15 | +0.09 | 107 | 102 | 83 | 77 |
| 407 (Invention) | T | −0.06 | −0.29 | +0.05 | −0.26 | −0.22 | +0.08 | 107 | 109 | 83 | 84 |
| 408 (Invention) | T | −0.03 | −0.25 | −0.22 | −1.18 | −0.18 | +0.10 | 106 | 102 | 82 | 77 |
| 409 (Invention) | T | −0.04 | −0.35 | −0.16 | −0.06 | −0.20 | +0.11 | 108 | 109 | 84 | 84 |
| 410 (Invention) | T | −0.05 | −0.29 | −0.15 | −0.30 | −0.51 | +0.10 | 108 | 107 | 84 | 82 |
| 411 (Invention) | T | −0.02 | −0.32 | −0.21 | −0.28 | +0.01 | +0.08 | 108 | 107 | 84 | 82 |
| 412 (Invention) | T | −0.01 | −0.31 | −0.21 | −0.28 | −0.19 | −0.11 | 108 | 107 | 84 | 82 |
| 413 (Invention) | T | −0.07 | −0.32 | −0.20 | −0.32 | −0.19 | +0.42 | 109 | 106 | 85 | 81 |
| 414 (Comparison) | S | −0.09 | −0.38 | −0.28 | −0.45 | −0.10 | +0.25 | 100 | 100 | 100 | 100 |
| 415 (Comparison) | Q | +0.08 | −0.20 | −0.10 | −0.20 | −0.29 | +0.05 | 102 | 101 | 99 | 101 |
| 416 (Invention) | R | +0.10 | −0.12 | −0.09 | −0.15 | −0.32 | +0.01 | 111 | 112 | 86 | 88 |
| 417 (Invention) | T | −0.03 | −0.31 | −0.18 | −0.30 | −0.19 | +0.11 | 109 | 107 | 84 | 82 |
| 418 (Invention) | T | −0.02 | −0.30 | −0.19 | −0.29 | −0.20 | +0.10 | 108 | 108 | 85 | 81 |
| 419 (Invention) | T | −0.04 | −0.29 | −0.19 | −0.31 | −0.18 | +0.11 | 108 | 107 | 84 | 82 |
| 420 (Invention) | T | −0.03 | −0.31 | −0.20 | −0.29 | −0.17 | +0.10 | 110 | 107 | 83 | 81 |
| 421 (Invention) | T | −0.02 | −0.30 | −0.18 | −0.30 | −0.20 | +0.40 | 108 | 109 | 84 | 82 |
| 422 (Invention) | T | −0.03 | −0.29 | −0.19 | −0.30 | −0.19 | +0.09 | 108 | 107 | 84 | 82 |
| 423 (Invention) | T | +0.10 | −0.25 | −0.06 | −0.06 | −0.16 | +0.39 | 104 | 108 | 92 | 90 |
| 424 (Invention) | T | +0.18 | −0.24 | −0.03 | +0.01 | −0.14 | +0.70 | 102 | 107 | 96 | 94 |
| 425 (Comparison) | S | +0.04 | −0.33 | −0.15 | −0.21 | −0.10 | +0.39 | 98 | 101 | 102 | 103 |
| 426 (Invention) | T | +0.10 | −0.25 | −0.06 | −0.20 | −0.17 | +0.30 | 106 | 107 | 90 | 89 |

Relative values are shown with the degree of Sample 414 = 100.

TABLE 10

| Sample No. | $\overline{\Delta Euv}$ (18 colors) Exposure under Daylight | Exposure under Tungsten Light | Exposure under Fluorescent Lamp | Spectral Sensitivity Distribution (FIG. 5) |
|---|---|---|---|---|
| 401 (Invention) | 7.3 | 8.6 | 8.4 | Inside range stipulated in Claim 3 of this invention |
| 402 (Invention) | 15.1 | | | Inside range stipulated in Claim 3 of this invention |
| 403 (Invention) | 12.5 | | | Inside range stipulated in Claim 3 of this invention |
| 404 (Invention) | 15.9 | | | Inside range stipulated in Claim 3 of this invention |
| 405 (Invention) | 16.3 | | | Inside range stipulated in Claim 3 of this |

TABLE 10-continued

| Sample No. | Exposure under Daylight | $\overline{\Delta Euv}$ (18 colors) Exposure under Tungsten Light | Exposure under Fluorescent Lamp | Spectral Sensitivity Distribution (FIG. 5) |
|---|---|---|---|---|
| | | | | invention |
| 406 (Invention) | 14.8 | | | Inside range stipulated in Claim 3 of this invention |
| 407 (Invention) | 15.0 | | | Inside range stipulated in Claim 3 of this invention |
| 408 (Invention) | 13.6 | | | Inside range stipulated in Claim 3 of this invention |
| 409 (Invention) | 14.6 | | | Inside range stipulated in Claim 3 of this invention |
| 410 (Invention) | 14.2 | | | Inside range stipulated in Claim 3 of this invention |
| 411 (Invention) | 14.3 | | | Inside range stipulated in Claim 3 of this invention |
| 412 (Invention) | 13.7 | | | Inside range stipulated in Claim 3 of this invention |
| 413 (Invention) | 13.4 | | | Inside range stipulated in Claim 3 of this invention |
| 414 (Comparison) | 9.0 | | | Inside range stipulated in Claim 3 of this invention |
| 415 (Comparison) | 9.2 | | | Inside stipulated range |
| 416 (Invention) | 7.5 | | | Inside stipulated range |
| 417 (Invention) | 7.8 | 9.3 | 8.9 | Inside stipulated range (Red-sensitive layer rather long wave) |
| 418 (Invention) | 7.9 | 9.2 | 9.0 | Inside stipulated range (Green-sensitive layer rather long wave) |
| 419 (Invention) | 7.8 | 8.9 | 8.9 | Inside stipulated range (Blue-sensitive layer rather long wave) |
| 420 (Invention) | 10.3 | 12.8 | 11.8 | Outside stipulated range (red-sensitive layer, long wave) |
| 421 (Invention) | 10.8 | 11.0 | 10.0 | Outside stipulated range (green-sensitive layer, long wave) |
| 422 (Invention) | 10.0 | 10.6 | 10.5 | Outside stipulated range (blue-sensitive layer, long wave) |
| 423 (Invention) | 12.8 | | | Inside stipulated range |
| 424 (Invention) | 16.2 | | | Inside stipulated range |
| 425 (Comparison) | 13.0 | | | Inside stipulated range |
| 426 (Invention) | 9.8 | | | Inside stipulated range |

The effect of the present invention is clear from the above.

Furthermore, in order to confirm the universality of the present invention, when the same kind of test was carried out on color paper using the pyrazoloazole couplers recorded in U.S. Pat. Nos. 3,725,067, 4,500,630, EP-A-119,860 as magenta couplers, the strong points of the present invention, which are faithfulness of color reproduction and small change in color reproduction when the photographic light source is changed, remained unchanged. The results showed that there was a notable improvement in red, magenta, violet, blue, etc., chroma; a notable improvement showing extremely successful color reproduction. Further, in the case in which color paper is utilized, the preferred values of the interlayer effect from the green photosensitive layer to the red photosensitive layer:

$$-0.52 \leqq (D_R/D_G) \leqq -0.15$$

were found to slip in the smaller direction as shown above.

The silver halide color photographic materials of the present invention have an excellent sensitivity/graininess ratio, and furthermore, faithfully reproduce the primary colors and intermediate colors in high chroma.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising at least one layer of, respectively, a blue-sensitive silver halide emulsion layer containing a yellow color coupler, a green-sensitive silver halide emulsion layer containing a magenta color coupler, and a red-sensitive silver halide emulsion layer containing a cyan color coupler, on a support; wherein a coupler of the general formula (I) shown below is contained in at least one of the above-mentioned photosensitive silver halide emulsion layers, and wherein chemically sensitized silver halide grains are contained in at least one of the above-mentioned silver halide emulsion layers and are composed of grains with an interior core part consisting of a silver halide containing 10 to 40 mol% of silver iodide, wherein the core part is covered with a silver halide of a lower silver iodide content, and the surface of the grains, when analyzed by means of the XPS (X-Ray Photoelectron Spectroscopy) surface analysis method, consists of a silver halide containing between 7 mol% and 15 mol% or more of silver iodide $$A\text{-}(TIME)_n\text{-}B \qquad (I)$$

wherein A denotes a coupler radical eliminating $(TIME)_n$-B by means of the coupling reaction with the oxidized form of a primary aromatic amine developer, TIME denotes a timing group discharging B after elimination from A due to the coupling reaction bonding at the active coupling position of A, B denotes a group represented by general formulae (IIa), (IIb), (IIc), (IId), (IIe), (IIf), (IIg), (IIh), (IIi), (IIj), (IIk), (IIl), (IIm), (IIn), (IIo) or (IIp) mentioned below, and n denotes an integer equal to 0 or 1, with the proviso that when n is 0 B is directly bonded to A, (IIa)

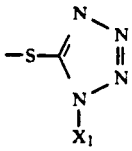

(IIb)

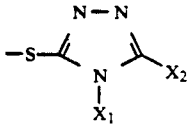

(IIc)

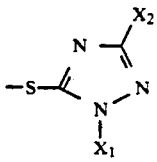

(IId)

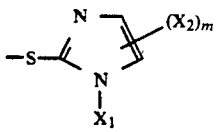

(IIe)

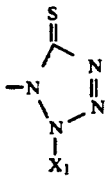

(IIf)

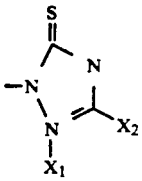

-continued (IIg)

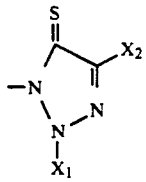

(IIh)

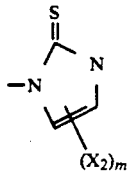

(IIi)

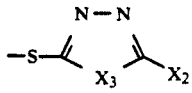

(IIj)

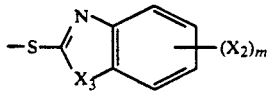

(IIk)

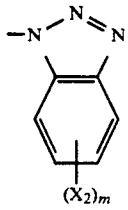

(IIl)

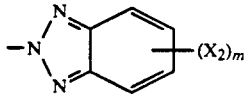

(IIm)

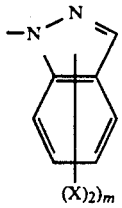

(IIn)

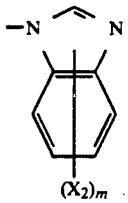

(IIo)

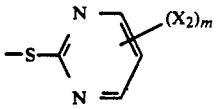

(IIp)

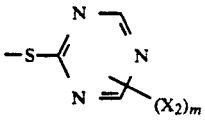

wherein $X_1$ is a substituted or unsubstituted aliphatic group with 1 to 4 carbon atoms, wherein the substituent group is selected from the group consisting of an alkoxy group, an alkoxycarbonyl group, a hydroxyl group, an acylamino group, a carbamoyl group, a sulfonyl group, a sulfonamido group, a sulfamoyl group, an amino group, an acyloxy group, a cyano group, a ureido group, an acyl group, a halogen atom and an alkylthio group, wherein the number of carbon atoms contained in these substituent groups is 3 or less, or a substituted phenyl group, wherein the substituent group is selected from the group consisting of a hydroxyl group, an alkoxycarbonyl group, an acylamino group, a carbamoyl group, a sulfonyl group, a sulfonamido group, a sulfamoyl group, an acyloxy group, a ureido group, a carboxyl group, a cyano group, a nitro group, an amino group, and an acyl group, wherein the number of carbon atoms contained in these substitutent groups is 3 or less, wherein $X_2$ denotes a hydrogen atom, an aliphatic group, a halogen atom, a hydroxyl group, an alkoxy group, an alkylthio group, an alkoxycarbonyl group, an acylamino group, a carbamoyl group, a sulfonyl group, a sulfonamide group, a sulfonamoyl group, an acyloxy group, a ureido group, a cyano group, a nitro group, an amino group, an alkoxycarbonylamino group, an aryloxycarbonyl group, or an acyl group, wherein $X_3$ is an oxygen atom, a sulfur atom, or an imino group with 4 or less carbon atoms, wherein m denotes an integer equal to 1 or 2, with the proviso that the total number m of carbon atoms contained in $X_2$ is 8 or less, and when m is 2, two $X_2$ groups are the same or different.

2. The silver halide color photographic material as in claim 1, wherein the interlayer effect of the above-mentioned blue-sensitive silver halide emulsion layer, green-sensitive silver halide emulsion layer and red-sensitive silver halide emulsion layer is $$-0.15 \leqq D_B/D_R \leqq +0.20$$

$$-0.70 \leqq D_G/D_R \leqq 0.00$$

$$-0.50 \leqq D_B/D_G \leqq 0.00$$

$$-1.10 \leqq D_R/D_G \leqq -0.10$$

$$-0.45 \leqq D_G/D_B \leqq -0.05$$

$$-0.05 \leqq D_R/D_B \leqq +0.35$$

wherein $D_B/D_R$ is the blue-sensitive layer from the red-sensitive layer, $D_G/D_R$ is the green-sensitive layer from the red-sensitive layer, $D_B/D_G$ is the blue-sensitive layer from the green-sensitive layer, $D_R/D_G$ is the red-sensitive layer from the green-sensitive layer, $D_G/D_B$ is the green-sensitive layer from the blue-sensitive layer, $D_R/D_B$ is the red-sensitive layer from the blue-sensitive layer, respectively, showing the interlayer effects.

3. The silver halide color photographic photosensitive material as in claim 2, wherein the spectral sensitivity distribution $S_B(\lambda)$ of the above-mentioned blue-sensitive silver halide emulsion layer is:

(a) at maximum $S_B(\lambda)$ the wavelength $\lambda^{max}{}_B$ is $$406\ nm \leqq \lambda^{max}{}_B \leqq 475\ nm$$

(b) when $S_B(\lambda)$ is 80% of $S_B(\lambda^{max}{}_B)$ the wavelength $\lambda^{80}{}_B$ is $$395\ nm \leqq \lambda^{80}{}_B \leqq 485\ nm$$

(c) when $S_B(\lambda)$ is 60% of $S_B(\lambda^{max}{}_B)$ the wavelength $\lambda^{60}{}_B$ is $$392\ nm \leqq \lambda^{60}{}_B \leqq 440\ nm$$

$$451\ nm \leqq \lambda^{60}{}_B \leqq 495\ nm$$

(d) when $S_B(\lambda)$ is 40% of $S_B(\lambda^{max}{}_B)$ the wavelength $\lambda^{40}{}_B$ is $$388\ nm \leqq \lambda^{40}{}_B \leqq 435\ nm$$

$$466\ nm \leqq \lambda^{40}{}_B \leqq 500\ nm$$

wherein the spectral sensitivity distribution of the above green-sensitive silver halide emulsion layer is:

(a) at maximum $S_G(\lambda)$ the wavelength $\lambda^{max}{}_G$ is $$527\ nm \leqq \lambda^{max}{}_G \leqq 580\ nm$$

(b) when $S_G(\lambda)$ is 80% of $S_G(\lambda^{max}{}_G)$ the wavelength $\lambda^{80}{}_G$ is $$515\ nm \leqq \lambda^{80}{}_G \leqq 545\ nm$$

$$551\ nm \leqq \lambda^{80}{}_G \leqq 590\ nm$$

(c) when $S_G(\lambda)$ is 40% of $S_G(\lambda^{max}{}_G)$ the wavelength $\lambda^{40}{}_G$ is $$488\ nm \leqq \lambda^{40}{}_G \leqq 532\ nm$$

$$568\ nm \leqq \lambda^{40}{}_G \leqq 605\ nm$$

wherein the spectral sensitivity distribution of the above red-sensitive silver halide emulsion layer is:

(a) at maximum $S_R(\lambda)$ the wavelength λhu $max_R$ is $$594\ nm \leqq \lambda^{max}{}_R \leqq 639\ nm$$

(b) when $S_R(\lambda)$ is 80% of $S_R(\lambda^{max}{}_R)$ the wavelength $\lambda^{80}{}_R$ is $$572\ nm \leqq \lambda^{80}{}_R \leqq 608\ nm$$

$$614\ nm \leqq \lambda^{80}{}_R \leqq 645\ nm$$

(c) when $S_R(\lambda)$ is 40% of $S_R(\lambda^{max}{}_R)$ the wavelength $\lambda^{40}{}_R$ is $$498\ nm \leqq \lambda^{40}{}_R \leqq 592\ nm$$

$$628\ nm \leqq \lambda^{40}{}_R \leqq 668\ nm.$$

4. The silver halide photographic material as in claim 1, wherein said grains consist of a silver halide containing 15 to 40 mol% of silver iodide.

5. The silver halide photographic material as in claim 4, wherein said grains consist of a silver halide containing 20 to 40 mol% of silver iodide.

6. The silver halide photographic material as in claim 1, wherein said couplers are employed in an amount of from 0.01 mol% to 20 mol% with respect to the silver halide present in the same layer or in an adjacent layer.

7. The silver halide photographic material as in claim 6, wherein said couplers are employed in an amount of from 0.5 mol% to 10 mol% with respect to the silver halide present in the same layer or in an adjacent layer.

8. The silver halide photographic material as in claim 1, wherein the silver halide grains are spectrally sensitized by at least one sensitizing dye selected from the group consisting of the compounds represented by the following formulae (I') or (II'):

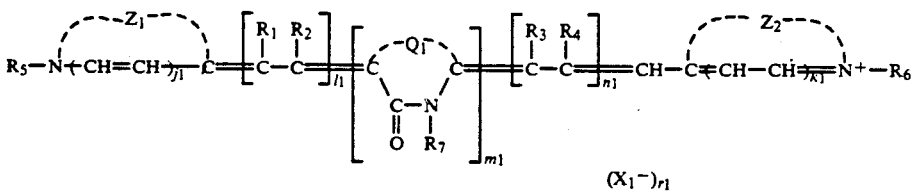

(I')

wherein $Z_1$ and $Z_2$ are the same or different and denote nitrogen-containing groups to form a 5- or 6-membered heterocyclic ring, $Q_1$ denotes a nitrogen-containing group to form a 5- or 6-membered ketomethylene cyclic ring, $R_1$, $R_2$, $R_3$ and $R_4$ denote a hydrogen atom, a lower alkyl group, a phenyl group which may be substituted, or an aralkyl group, and when $l_1$ denotes or 3, and when n denotes 2 or 3, different $R_1$ and $R_1$, $R_2$ and $R_2$, $R_3$ and $R_3$, or $R_4$ and $R_4$ are linked to form a 5- or 6-membered ring, $R_5$ and $R_6$ denote alkyl groups with 10 or less carbon atoms or alkenyl groups with 10 or less carbon atoms, $l_1$ and $n_1$ denote 0 or positive integers up to 3, with $l_1+n_1$ up to 3; when $l_1$ is 1, 2 or 3, $R_5$ and $R_1$ may be linked to form a 5- or 6-membered ring, $j_1$, $k_1$ and $m_1$ denote 0 or 1, $X_1^-$ denotes an acid anion, $r_1$ denotes 0 or 1;

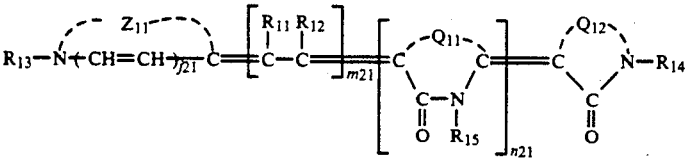

(II')

wherein $Z_{11}$ denotes a nitrogen-containing group to form a 5- or 6-membered heterocyclic ring, $Q_{11}$ denotes a nitrogen-containing group to form a 5- or 6-membered ketomethylene ring, $Q_{12}$ denotes a nitrogen-containing group to form a 5- or 6-membered ketomethylene ring, $R_{11}$ denotes a hydrogen atom or an alkyl group with up to 4 carbon atoms, $R_{12}$ denotes a hydrogen atom, a phenyl group or an alkyl group, and when $m_{21}$ denotes 2 or 3, the different $R_{11}$ and $R_{12}$ are linked to form a 5- or 6-membered ring which contains an oxygen atom, a sulfur atom or a nitrogen atom, $R_{13}$ denotes an alkyl group with up to 10 carbon atoms or an alkenyl group with up to 10 carbon atoms, $R_{14}$ and $R_{15}$ denote a hydrogen atom, an alkyl group with up to 10 carbon atoms, an alkenyl group with up to 10 carbon atoms, or a monocyclic aryl group, $m_{21}$ denotes 0 or a positive integer up to 3, $j_{21}$ denotes 0 or 1, and $n_{21}$ denotes 0 or 1.

9. The silver halide photographic material as in claim 1, wherein the silver halide grains contain at least one sulfur-containing silver halide solvent selected from the group consisting of the compounds represented by general formulae (IV'), (V') or (VI'):

$$R_{16}\text{-}(S\text{-}R_{18})_m\text{-}S\text{-}R_{17} \qquad \text{(IV')}$$

wherein m denotes 0 or an integer of 1 to 4, $R_{16}$ and $R_{17}$ are the same or different, and denote lower alkyl groups with 1–5 carbon atoms or substituted alkyl groups with 1–30 carbon atoms, and $R_{16}$ and $R_{17}$ may be linked to form a cyclic thioether, $R_{18}$ denotes an alkylene group,

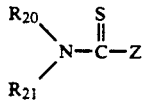

(V')

wherein Z denotes

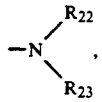

$-OR_{24}$ or $-SR_{25}$, wherein $R_{20}$, $R_{21}$, $R_{22}$, $R_{23}$, $R_{24}$ and $R_{25}$ are the same or different, and denote alkyl groups, alkenyl groups, aralkyl groups, aryl groups or heterocyclic groups, and furthermore, $R_{20}$ and $R_{21}$, $R_{22}$ and $R_{23}$, or $R_{20}$ and $R_{22}$, $R_{20}$ and $R_{24}$, $R_{20}$ and $R_{25}$ may be linked to form a 5- or 6-membered hetero ring;

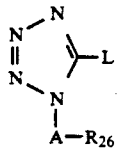

(VI')

wherein A denotes an alkylene group, $R_{26}$ denotes $-NH_2$, $-NHR_{27}$,

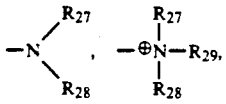
—CONHR$_{30}$, —OR$_{30}$, —COOM, —COOR$_{27}$,
—SO$_2$NHR$_{30}$, —NHCOR$_{27}$ or SO$_3$M, when R$_{26}$ is
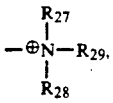
L denotes —S$^{\ominus}$, and when it is other than this, —SM,
where R$_{27}$, R$_{28}$ and R$_{29}$ respectively denote alkyl groups,
R$_{30}$ denotes a hydrogen atom or alkyl group,
M denotes a hydrogen atom or a positive ion.
* * * * *